US012747573B2

(12) United States Patent
Monteer

(10) Patent No.: US 12,747,573 B2
(45) Date of Patent: Sep. 29, 2026

(54) DECK CONSTRUCTION SYSTEM

(71) Applicant: Gary R Monteer, Herriman, UT (US)

(72) Inventor: Gary R Monteer, Herriman, UT (US)

( * ) Notice: Subject to any disclaimer, the term of this patent is extended or adjusted under 35 U.S.C. 154(b) by 0 days.

(21) Appl. No.: 18/853,704

(22) PCT Filed: Apr. 4, 2023

(86) PCT No.: PCT/US2023/065342
§ 371 (c)(1),
(2) Date: Oct. 2, 2024

(87) PCT Pub. No.: WO2023/196822
PCT Pub. Date: Oct. 12, 2023

(65) Prior Publication Data

US 2025/0223791 A1 Jul. 10, 2025

Related U.S. Application Data

(60) Provisional application No. 63/362,448, filed on Apr. 4, 2022.

(51) Int. Cl.
*E04B 1/00* (2006.01)
*E04B 1/38* (2006.01)

(52) U.S. Cl.
CPC ..... *E04B 1/003* (2013.01); *E04B 1/388* (2023.08)

(58) Field of Classification Search
CPC ..... E04B 1/003; E04B 1/388
USPC ..... 52/289, 301
See application file for complete search history.

(56) References Cited

U.S. PATENT DOCUMENTS 3,286,404 A * 11/1966 Harrison ..... E04F 10/08 52/75
3,914,913 A * 10/1975 Roberts ..... E04B 5/10 52/579
4,077,334 A * 3/1978 Svirklys ..... B65D 19/0097 52/579
5,765,328 A * 6/1998 Moore ..... E04B 1/003 52/302.1
6,226,941 B1 * 5/2001 Stevens ..... E04D 13/0477 52/537
6,279,271 B1 * 8/2001 Burkart, Jr. ..... E04D 13/0477 52/14

(Continued)

FOREIGN PATENT DOCUMENTS

EP 2977517 A1 7/2015
KR 102097339 B1 5/2020

*Primary Examiner* — James J Buckle, Jr.
(74) *Attorney, Agent, or Firm* — Dobbin IP Law, P.C.; Geoffrey E. Dobbin

(57) ABSTRACT

A deck with improved construction components and methods may feature weather and UV resistant components which intermesh with each other in forming the finished deck product. The components, when assembled, will also feature a water diversion system that will direct water that falls on the deck surface, whether through precipitation or for cleaning purposes, and direct said water away from the foundation of the deck and the foundation of associated building. The diversion system features two tiers, an upper tier formed primarily from deck plank troughs (310) and wall transition planks troughs (630) and a lower tier formed from mullion troughs (410) and edge cap troughs (510) all in fluid communication with water ejection spouts (720).

18 Claims, 49 Drawing Sheets

(56) References Cited

U.S. PATENT DOCUMENTS

| | | | | |
|---|---|---|---|---|
| 6,427,403 | B1 * | 8/2002 | Tambakis | E04B 1/28 52/309.1 |
| 6,651,398 | B2 * | 11/2003 | Gregori | E04B 5/02 52/489.1 |
| 7,434,358 | B2 * | 10/2008 | Smith | E04B 1/34342 52/302.1 |
| 8,082,712 | B1 * | 12/2011 | Butler | E04F 17/00 52/302.1 |
| 8,250,821 | B1 * | 8/2012 | Gibson | E04F 15/02183 52/302.1 |
| 8,739,489 | B2 * | 6/2014 | Weber | E04F 11/1846 52/510 |
| 9,228,345 | B2 * | 1/2016 | Weber | E04B 1/19 |
| 10,844,615 | B2 * | 11/2020 | Esh, Jr. | E04B 1/003 |
| 12,134,890 | B2 * | 11/2024 | Swain | E03F 3/046 |
| 2002/0032990 | A1 * | 3/2002 | Burkart, Jr. | E04D 13/0477 52/14 |
| 2003/0074850 | A1 * | 4/2003 | Ready | E04B 5/12 52/302.1 |
| 2004/0025464 | A1 * | 2/2004 | Williams | E04C 2/36 52/483.1 |
| 2004/0035069 | A1 | 2/2004 | Jackson | |
| 2005/0252151 | A1 * | 11/2005 | Kindred | E04F 17/00 52/650.3 |
| 2007/0193148 | A1 * | 8/2007 | Simko | E06B 1/705 52/456 |
| 2009/0120033 | A1 * | 5/2009 | Thomas | E04F 15/02 52/741.3 |
| 2011/0214369 | A1 | 9/2011 | Weber et al. | |
| 2012/0042580 | A1 * | 2/2012 | Manson | E04D 13/0477 52/302.1 |
| 2019/0218766 | A1 | 7/2019 | Winter | |
| 2021/0340760 | A1 * | 11/2021 | Burt | E04C 3/07 |
| 2023/0407636 | A1 | 12/2023 | Jessop | |

* cited by examiner

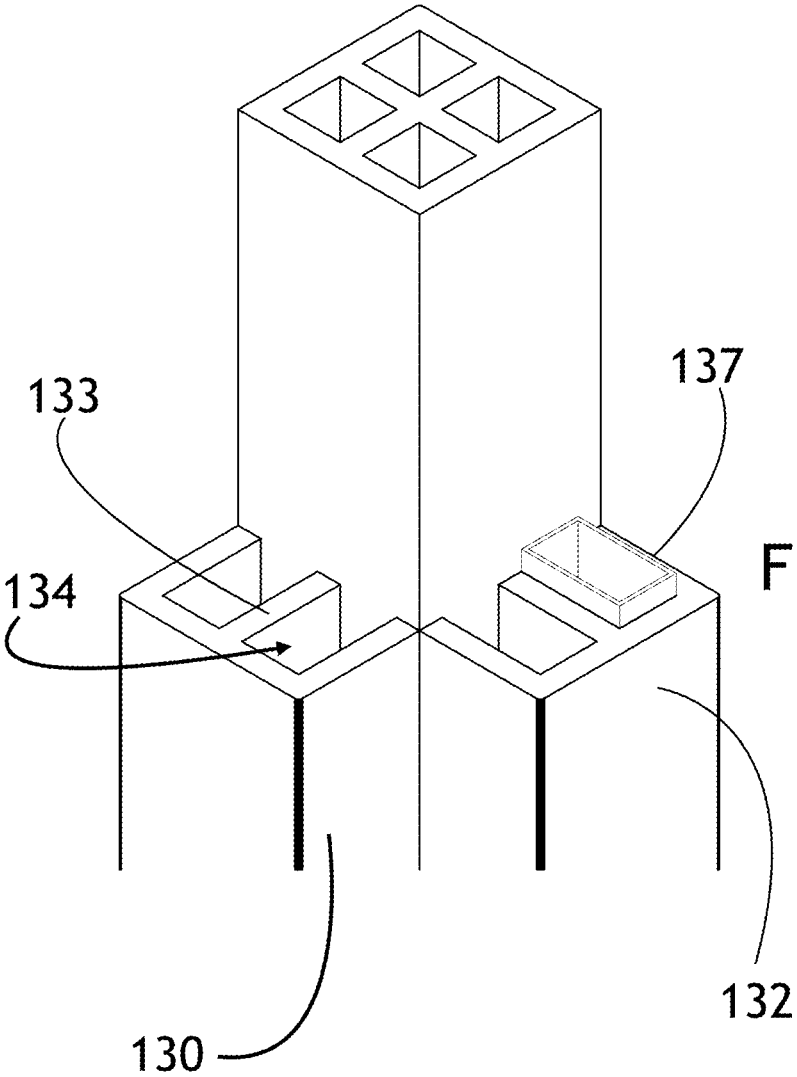
FIG. 5
FIG. 6
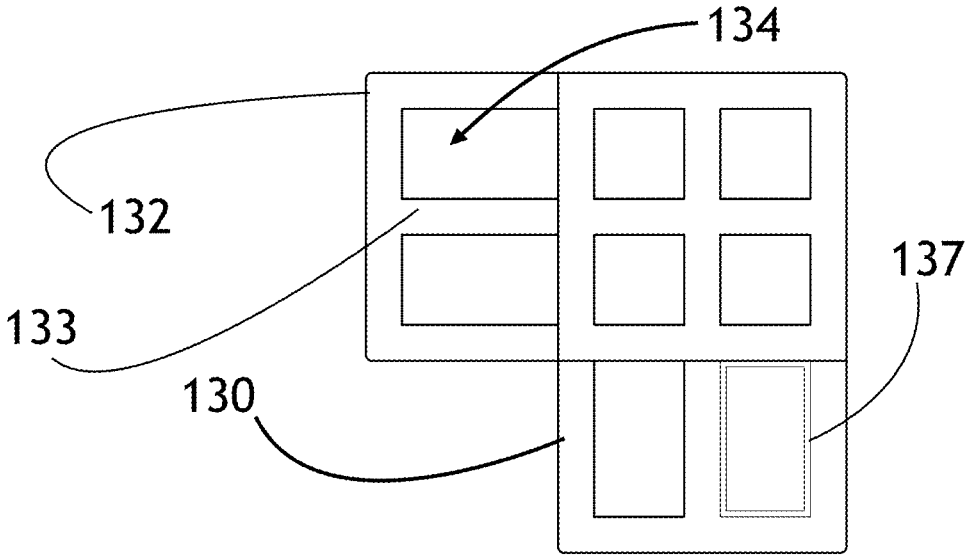

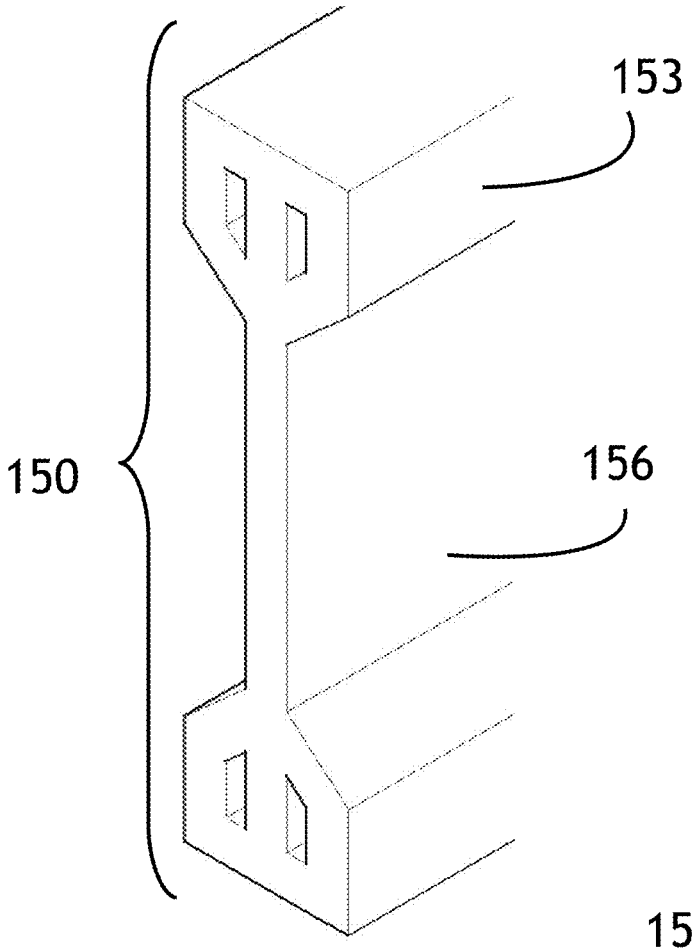
FIG.13
FIG. 14
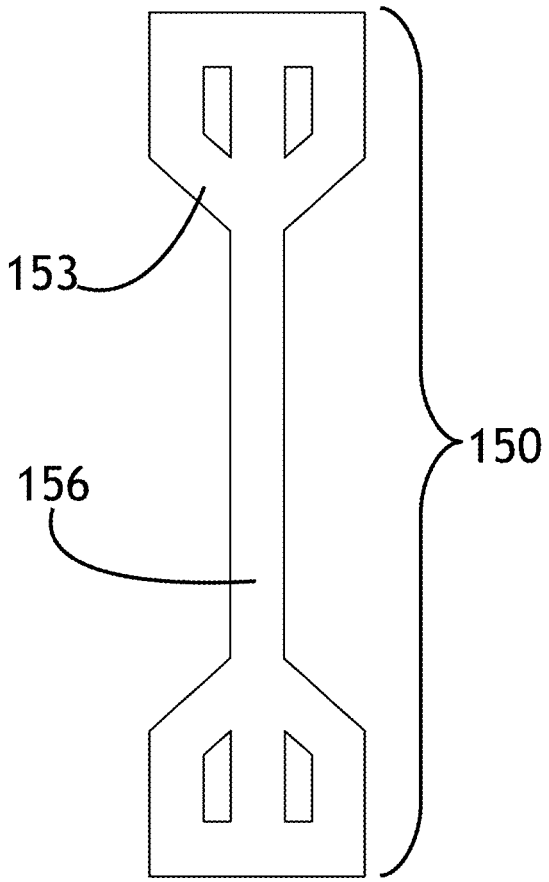

DECK CONSTRUCTION SYSTEM

CROSS-REFERENCES TO RELATED APPLICATIONS

The present invention claims priority under 35 USC § 371 to PCT Application PCT/US2023/65342, filed Apr. 4, 2023 which in turn claims the benefit of prior filed U.S. Application No. 63/362,448, filed on Apr. 4, 2022, and incorporates the same by reference herein in their entirety.

FIELD OF THE INVENTION

The present invention relates to the field of building construction and more particularly relates to a comprehensive full deck system for the long-term performance related to the forces against mother nature, as well as a systematic, effective, and efficient installation process for constructing a deck, with an integrated water control and diversion system, whether attached or detached to a dwelling. The deck system also provides the all-inclusive entire support sub-structure to receive the complete deck's finished surface, stairs, and railings over the support structure.

BACKGROUND OF THE INVENTION

One common improvement to a home is the addition of a deck—a raised patio, usually extending from one of the home's walls but may also be a stand-alone structure. Decks may be positioned anywhere on a home but are usually in line with a ground floor or a second story. In the event of placing a deck on a second story, a deck may be utilized as an extended roof over the area beneath it, like a covered patio.

The construction of a deck may be summarized as follows regardless of if the deck is attached or detached: first a foundation is prepared and when it has been prepared a support structure of posts, joists, and beams is then constructed thereupon. Obviously, a higher deck will have higher posts than a lower one. Posts raise the deck to the desired level while joists and beams define a planar area on which the deck planks are positioned. Blocking may be added between joists for torsional support, especially for longer joists. If the deck is attached to the building, it will usually be anchored through one or more ledger boards positioned on the side of the building. After the support structure is built, then deck planks and other components such as wall transition planks, edge caps, stairs, and finally, the railings are installed and secured over the posts, joists, and beam of the support structure These deck planks and other components define the floor of the deck. Stairs and roofing, such as a trellis or awning, may be added during construction as needed. There are, therefore, many connection points needed to hold a deck together. At the very least, the posts may be securely attached to the foundation. Joists are mechanically connected to beams and beams need to be mechanically connected to any mid-span posts, top and bottom, and mechanically connected at corner posts, top and bottom, (often with ledger board) or butt joints. Each connection structure may be improved for easier construction with a durable material to create an easily assembled deck that will last longer than prior art decks.

One concern with decks is that they are, by necessity, exposed to the environment and will eventually succumb to damage from water, solar radiation, and the natural expansion and contraction of components with temperature changes. Therefore, a deck should be constructed with materials that will resist each of these environmental threats. Ideally, a deck will also have some manner of diverting water to prevent water from standing on the surface of the deck, which would normally enhance degradation due to water. The ideal deck should also allow for both the support structure and deck finished surface parts and components, to work in harmony, allowing for the natural expansion and contraction of deck components without placing stress on the components' inherent structure. Finally, the components would ideally have internal structure which would help to counteract temperature extremes, particularly with extreme heat.

The present invention is a deck system which is not only constructed from weather resistant materials, but also is designed with an integrated water diversion system. The system is also constructed from modular components which are easily adaptable to a given project. The present invention represents a departure from the prior art in that the deck system of the present invention allows for an easily designed and constructed weather resistant deck to be built while containing an integrated water control system.

SUMMARY OF THE INVENTION

In view of the foregoing disadvantages inherent in the known types of decks, an improved deck construction system may provide a deck construction system that meets the following objectives: that it be easily designed and constructed, that it incorporate weather resistant materials, that its components are readily modified to a given project, that it may provide more than just deck construction, and that the finished deck will have an integrated water diversion system to lessen the incidence of standing water on the deck surface and sub-structure. As such, a new and improved deck system may be comprised of deck components with multiple interior water control channels at least two different elevations and multi-directional containment waterways located underneath the deck surface which will cascade water contained in the multi-level water troughs and divert water into a controlled exit. The system may also comprise standard construction pieces which adapt with connectors to construct not only the deck, but also related deck structures and accessories such as furniture. The system should also be constructed from a wood/polymer composite to facilitate weather resistance; however, any suitable and durable material, such as wood, polymer, or metal, will suffice in the actual building of the structure.

The more notable features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in several ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions as far as they do not depart from the spirit and scope of the present invention.

BRIEF DESCRIPTION OF THE DRAWINGS

To describe the way the above-recited and other advantages and features of the invention can be obtained, a more particular description of the invention briefly described above will be rendered by reference to specific example embodiments thereof which are illustrated in the appended drawings. Understanding that these drawings depict only typical embodiments of the invention and are therefore not to be considered as limiting of its scope, the invention will be described and explained with additional specificity and detail using the accompanying drawings.

FIG. 5 is a perspective view of a corner support post and exemplifies post beam and factory support shoulder as used in the deck of FIG. 2.

FIG. 6 is a top plan view of the corner support post of FIG. 5.

FIG. 13 is a perspective view of a single joist as used in the deck of FIG. 2.

FIG. 14 is a front elevation of the single joist of FIG. 13.

INDEX OF REFERENCE NUMERALS

Figure 1:
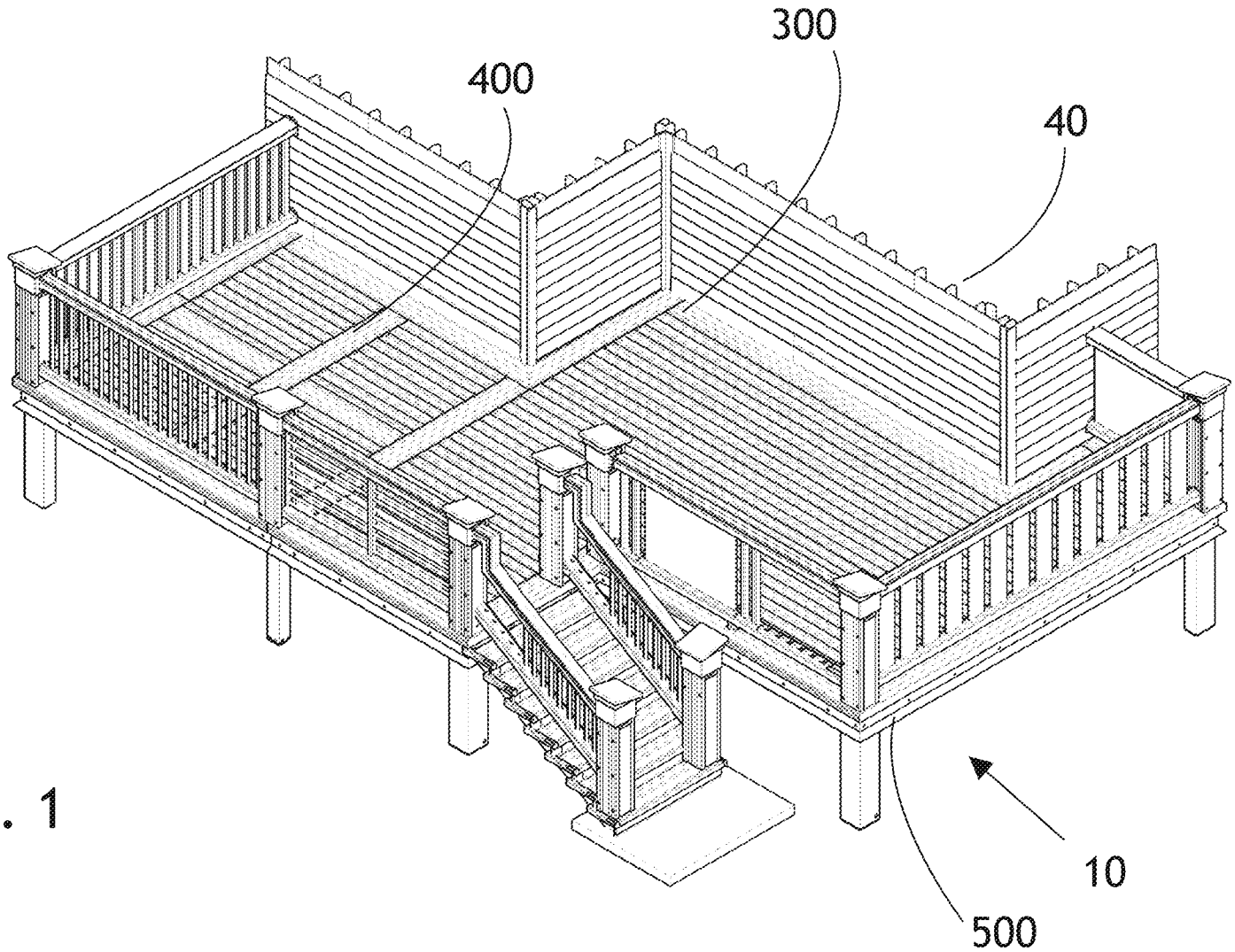
FIG. 1 is a perspective view of an exemplary deck constructed utilizing the teachings of the invention in a preferred embodiment. All references to the subsequent figures are inherently references to FIG. 1.

10—Deck
40—Exterior Wall of House
45—Wall Siding
50—Stucco Wall
55—Stucco Groove
70—Deck Substructure
100—Concrete Slab
104—Spot Footing
110—Center Post
114—Center Post Internal Cell
117—Center Post Structural Insert
120—Center Post Base Bracket
124—Center Post Mounting Fins
127—Center Post Mounting Port
130—Corner Post
132—Corner Post Support Shoulder
134—Corner Post Internal Cell
137—Corner Post Structural Insert
140—Corner Post Base Bracket
144—Corner Post Mounting Fins
147—Corner Post Mounting Port
148—Inside Beam Corner Cap
150—Single Joist
153—Single Joist Head
156—Single Joist Wall
160—Double Joist
163—Double Joist Head
164—Double Joist Cells
166—Double Joist Walls
167—Double Joist Structural Insert
170—Triple Joist
173—Triple Joist Head
174—Triple Joist Cells
176—Triple Joist Walls
177—Triple Joist Structural Insert
180—Center Post Head Bracket Hold-Down
182—Center Post Top Bracket
184—Center Post Mounting Fins
186—Center Post Beam Bracket
188—Center Post Beam Bracket Interface Bosses
190—Corner Post Beam Bracket
192—Corner Post Beam Bracket Interface Bosses
200—Ledger Board
210—Hanger Shield
215—Hanger Shield/Beam Slot
220—Joist Hanger Structural Bracket/End Cap
225—Joist Hanger Shield Slot Boss
230—Joist Hanger
240—Joist Blocking Hanger
245—Joist Blocking Connection Tabs
250—Single Beam Bridging Support
255—Joist Hanger Anchor Slot
270—Perimeter Beam
300—Deck Plank
301—Water Control Inlet Seams
310—Deck Plank Upper Water Control Trough
320—Deck Edge Cap and Deck Plank Locking Slot
330—Deck Plank Sliding Slot Lock
340—Surface Plank Interlock Clip
345—Surface Plank Interlock Clip Tenon
350—Undermount Hold-down Clip
355—Undermount Hold-down Clip-T-head
360—Undermount Hold-down Clip Receiving Slot
400—Field Mullion Plank
410—Field Mullion Lower Water Trough/Support Shoulder
500—Deck Perimeter Edge Cap
510—Deck Perimeter Edge Cap Lower Water Trough/Support Shoulder
520—Deck Perimeter Edge Cap Joist Attachment Flange
530—Beam Apron Head Slot
540—Beam Apron
541—Beam Apron Straight Spline
542—Beam Apron Incorporated Drip Edge
545—Beam Apron Attachment Port
550—Beam Apron Outside Corner
560—Beam Apron Inside Corner
570—Attachment Screw
580—Screw Grommet
590—Screw Shoulder
600—Wall Transition Plank
610—Wall Transition Plank Cantilever Finger
620—Wall Transition Waterway Flashing for Siding
630—Wall Transition Waterway Flashing Lower Water Trough for Siding
636—Wall Transition Waterway Flashing Flange
640—Wall Transition Waterway Flashing for Stucco

643—Stucco Wall Waterway Spline Inside, outside corners and center spline
646—Stucco Wall Waterway Snap-fit Cover
649—Stucco Wall Waterway End Cap
650—Deck Perimeter Edge Cap Transition Flashing
652—Deck Perimeter Edge Cap Transition Flashing Bosses
654—Deck Perimeter Edge Cap Transition Flashing Back Water Trough
656—Deck Perimeter Edge Cap Transition Flashing Back Nail Flange
658—Deck Perimeter Edge Cap Transition Flashing Lower Water Trough/Shoulder
660—Wall Transition Waterway Straight Spline
670—Interior Corner Wall Transition Waterway Component, with Integrated Tenons
700—Water Ejection Downspout Structure
710—Water Ejection Downspout Port
720—Water Ejection Water Displacement Spout
810—Deck Perimeter Edge Cap Corner Joint Water Control Spline
820—Deck Perimeter Edge Cap Butt Joint Water Control Spline
900—Deck Railing Top Rail
905—Deck Railing Bottom Rail
910—Deck Railing Post Base Bracket
920—Deck Railing Post
930—Deck Railing Top Rail Anchor
935—Deck Railing Bottom Rail Anchor
940—Stair Stringer
945—Stair Stringer Bracket
950—Stair Tread
955—Stair Waterway Trough
957—Stair Tie-down Slot
960—Stair Riser
965—Stair Riser Foot
970—Trellis Joist
975—Trellis Joist Slip-fit Collared End Cap
980—LED and Solar Adapted End Cap.

DETAILED DESCRIPTION OF THE PREFERRED EMBODIMENT

With reference now to the drawings, a preferred embodiment of the deck construction system is herein described. It should be noted that the articles "a," "an," and "the," as used in this specification, include plural referents unless the content clearly dictates otherwise.

MATERIALS

The deck components are specially engineered for the practice of the invention. Deck components are ideally made from a wood/polymer composite and extruded to standard lengths. In this manner, the components may be designed to have maximum strength at a minimum weight while also containing the features described below for water control, air flow and ease of assembly. Components may then be cut to length at a factory or on-site and utilized within a construction project. The use of a wood/polymer composite allows the components to utilize sawdust and other waste wood from other industries in their own manufacture, thereby utilizing what would otherwise be waste in a functional, durable, and aesthetically pleasing finished product. While wood/polymer composites are preferred, the practice of this invention is by no means limited to the use of such materials as any suitable building material may be utilized. Assembly hardware will typically be made from metals, such as aluminum or steel though any suitable metal or alloy may be utilized.

While other materials could be used, wood/polymer composite has several other distinct advantages over more traditional construction materials which make it more suitable for the practice of the present invention system. First, wood/polymer composite is inherently water resistant and when proper polymers are used the resultant material is also UV and solar resistant. Second, when wood/polymer components are extruded, the components have hollow cells designed within the component's volume. These hollow cells not only lighten the component while maintaining structural strength, but also provide passage for air currents to help equalize temperature differentials and aid in resisting weather damage due to excessive temperatures. Third, along with the internal cells, connection and water control structures may also be fashioned within the body of the deck components while they are being extruded.

Construction

Figure 2:
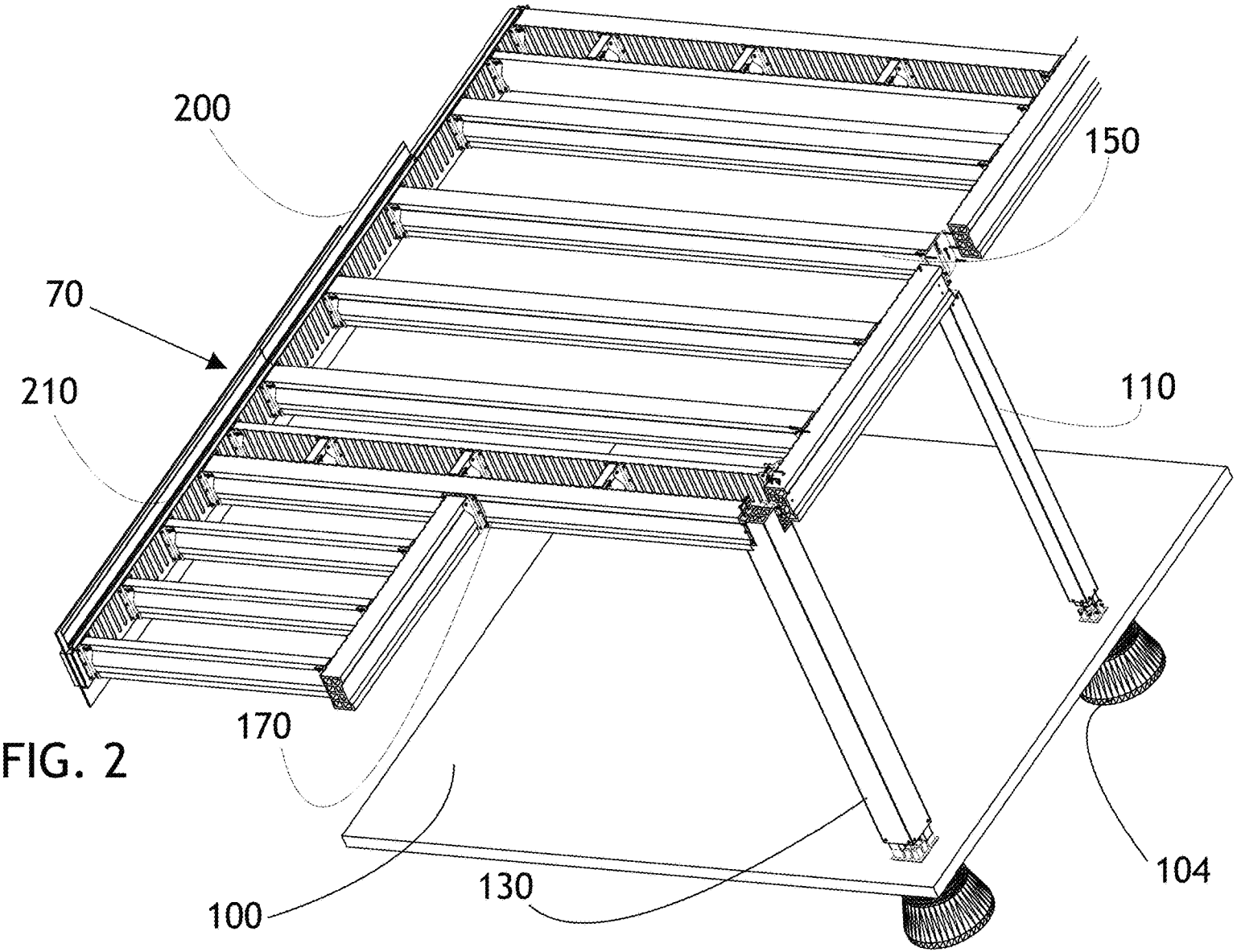
FIG. 2 is a partially exploded view of the deck of FIG. 1.

With reference to FIGS. 1 and 2, a deck 10 is built next to an exterior wall of a house 40. The deck's surface is constructed of a matrix of deck planks 300 contained within three outer deck perimeter edge caps 500 and 600 connecting the exterior wall 40 (for a rectangular, attached deck). If appropriate, at least one field mullion 400 may be present in the matrix, running perpendicular to the deck planks 300. This deck surface is supported on a scaffolding 70 of joists and beams supported by a combination of center and corner posts. Posts 110, 130 stand on a footing or foundation and support the beams 170. Typically, perimeter beams 270 define the perimeter of the deck, combined with the ledger board 200 for an attached deck, and may be added inside the perimeter for additional support as needed e.g., to support a heavy feature like a hot tub. Joists 150 are found inside the perimeter and provide support for the deck planks, edge caps, and mullions. Blocking is often added between joists and beams to provide torsional support to the joists and to support field mullion plank running parallel to joist.

In the preferred embodiment of the invention, each component has been designed to maximize efficiency of construction while providing longer term resistance to wear-and-tear from use and the environment. It should be readily understood that each component could be used individually as each one represents an improvement on the prior art while standing alone and, therefore, the invention should not be read to require the inclusion of every component herein described, but rather, should be interpreted based upon the wording of the appended claims.

Each deck, when properly built, should be supported on some form of foundation. Usually this is a concrete slab 100 or a plurality of concrete footings 104 upon which posts rest. Often, spot footings 104 will be positioned and then a slab 100 laid over the spot footings 104, with the spot footings 104 located where the posts 110, 130 will be positioned. In the absence of a slab 100, the bottom of the post and the foundation may be buried for added support. This post-foundation interface is a key structural point that supports the deck. This interface is improved by introducing both a modified post and a specially constructed post base bracket to provide a durable interface.

Figure 3:
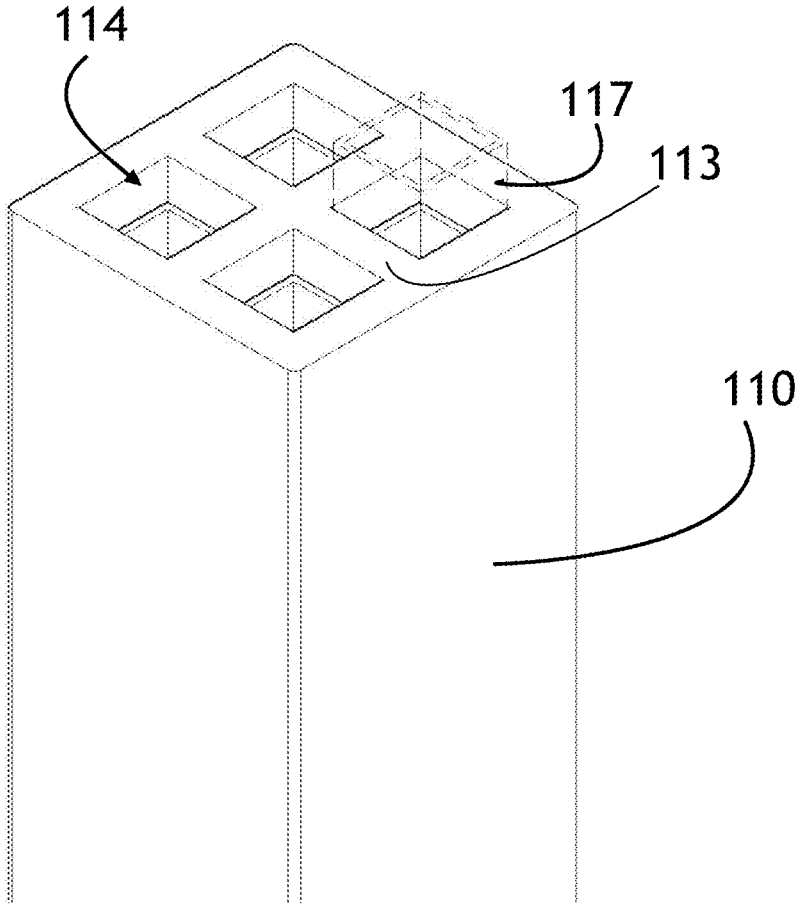
FIG. 3 is a perspective view of a center support post as used in the deck of FIGS. 1 and 2.
Figure 4:
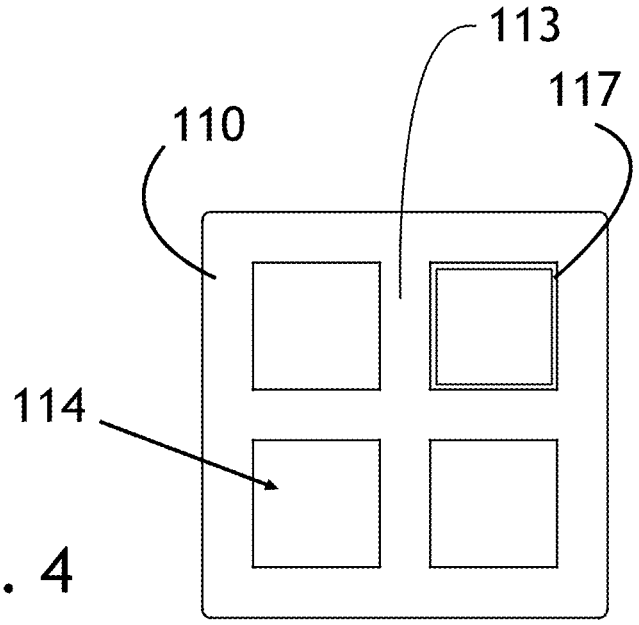
FIG. 4 is a top plan view of the center support post of FIG. 3.
Figure 19:
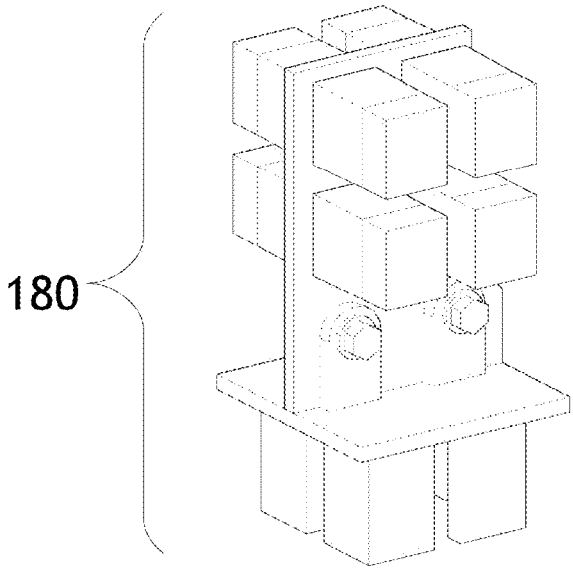
FIG. 19 is a perspective view of a center post head bracket hold-down as used in the deck of FIG. 2.
Figure 20:
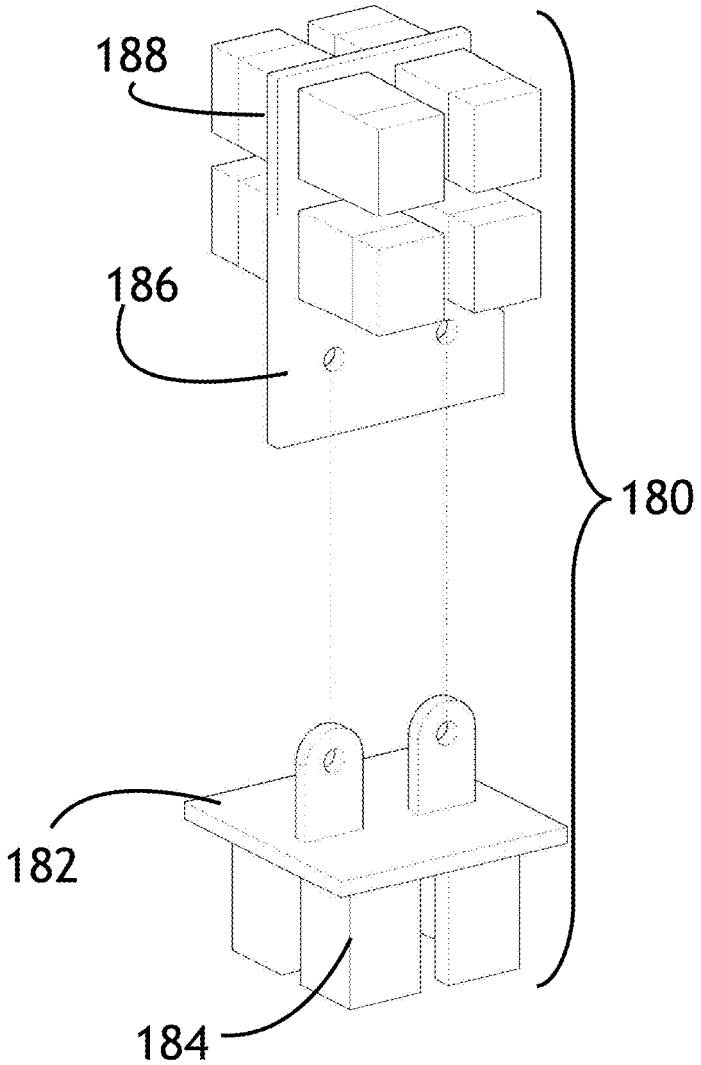
FIG. 20 is an exploded view of the center post head bracket hold-down of FIG. 19.
Figure 21:
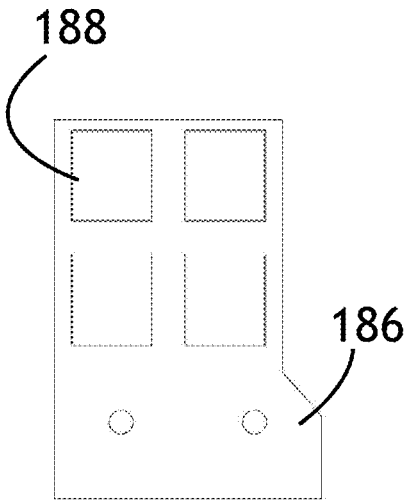
FIG. 21 is a front elevation of the center post beam bracket of the center post head bracket hold-down of FIG. 20.
Figure 23:
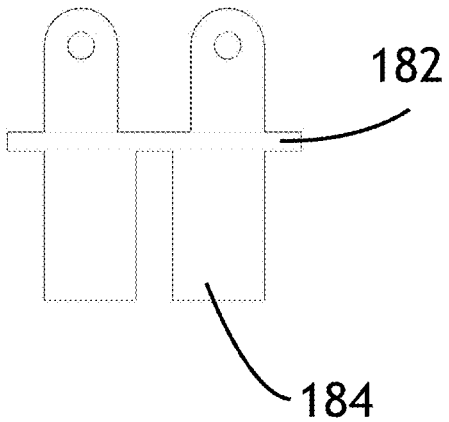
FIG. 23 is a front elevation of the center post top bracket of the center post head bracket hold-down of FIG. 20.
Figure 22:
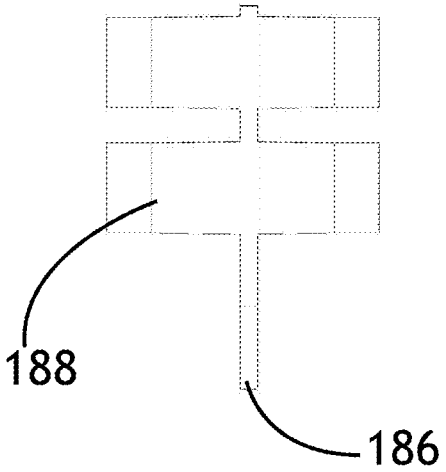
FIG. 22 is a side elevation of the center post beam bracket of FIG. 21.
Figure 24:
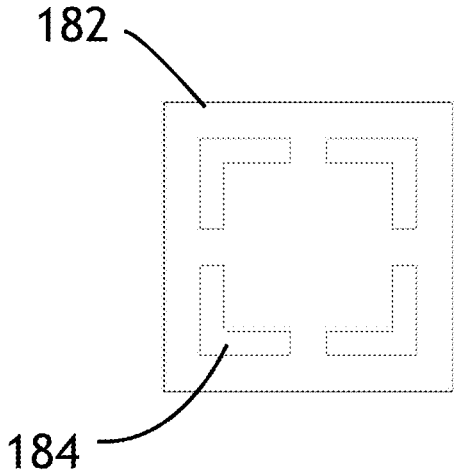
FIG. 24 is a bottom plan view of the center post top bracket of FIG. 23.

Posts will typically be square or rectangular, though corner posts 130 will feature a unique L-shape and other shapes could be designed. For a square, center, post 110 (FIGS. 3 & 4), typically six inches by six inches, a square perimeter having two perpendicular interior supports 113 will be extruded, forming a post with four internal cells 114 running the length of the post. These cells 114 are then used to interface with both the post base bracket 120 (FIG. 7) and mounting hardware 180 (FIG. 19) for the beams. Supportive inserts 117 may also be manufactured to fit inside the cells 114. These inserts 117 are preferably made of aluminum or some other suitable metal or a composite. Corner posts 130 (FIGS. 5 & 6) are used to interface with beams forming corners of the perimeter of the deck and are typically L-shaped with two legs that are each ten inches long and six inches wide. The corner of the L mimics the construction of a square corner post and has four internal cells, while each leg may have at least one support 133 running its length, forming at least two additional internal cells 134. These additional cells may also be reinforced with an internal structural insert 137. The shoulders 132 of the corner post 130 could be rabbeted at the factory or may be done on site.

Figure 7:
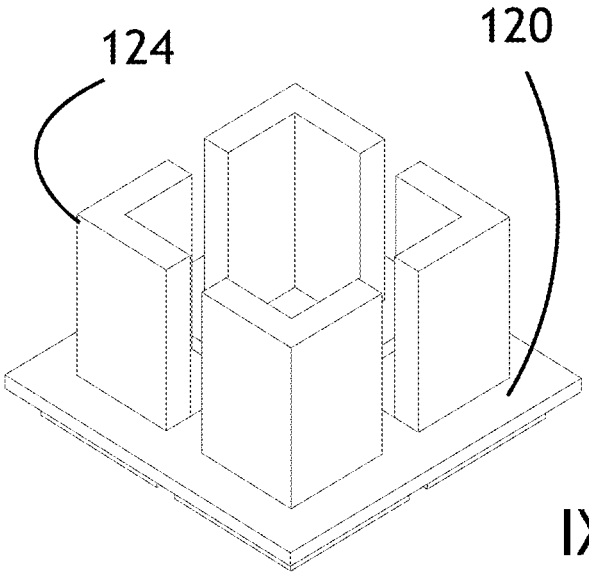
FIG. 7 is a perspective view of a center support post base anchor as used in the deck of FIG. 2.
Figure 8:
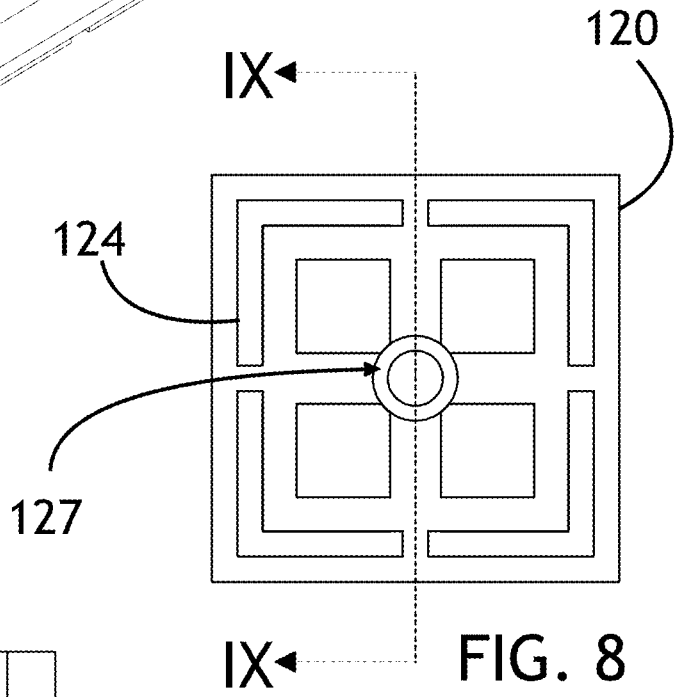
FIG. 8 is a top plan view of the center support post base anchor of FIG. 7.
Figure 9:
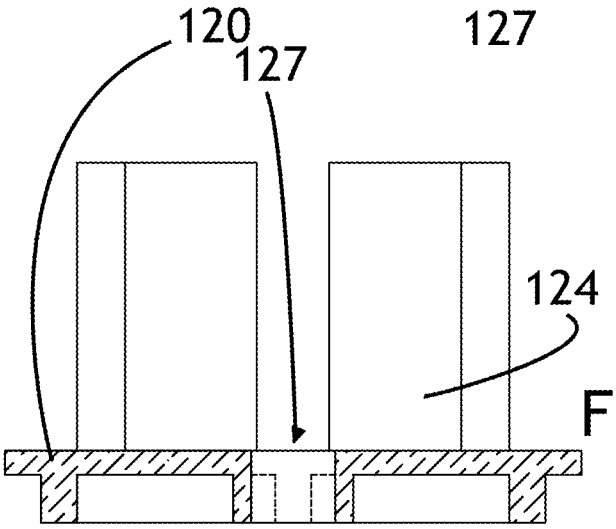
FIG. 9 is a sectional view of the center support post base anchor of FIG. 7, taken along line IX-IX.
Figure 10:
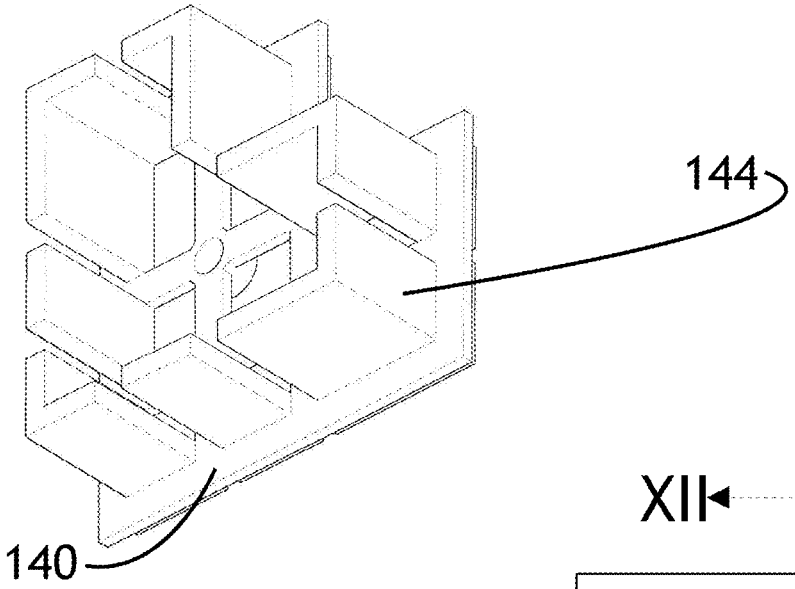
FIG. 10 is a perspective view of a 90-deg. corner support post base anchor as used in the deck of FIG. 2.
Figure 11:
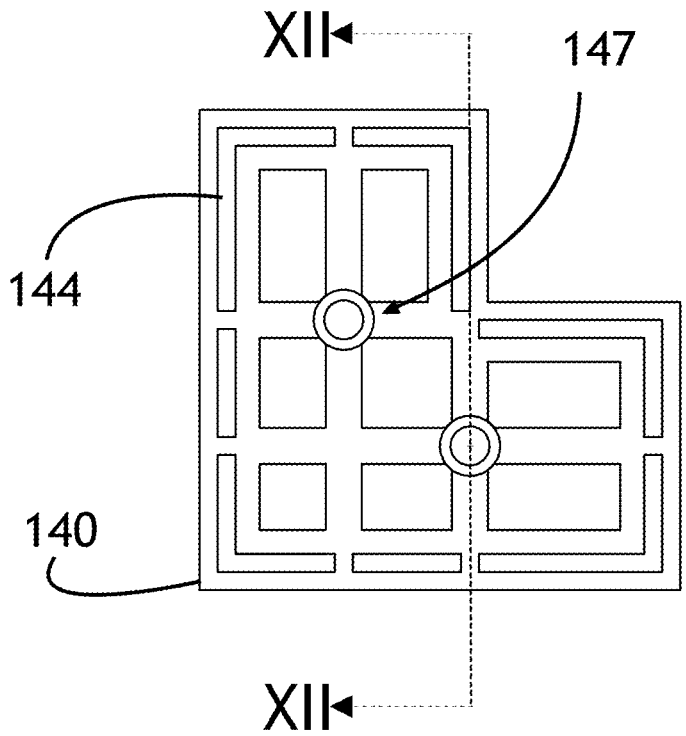
FIG. 11 is a top plan view of the 90-deg. corner support post base anchor of FIG. 10.
Figure 12:
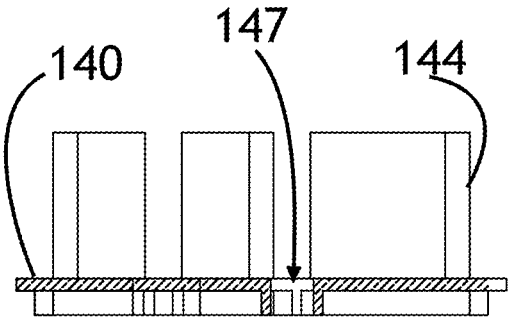
FIG. 12 is a sectional view of the 90-deg. corner support post base anchor of FIG. 11, taken along line XII-XII.
Figure 15:
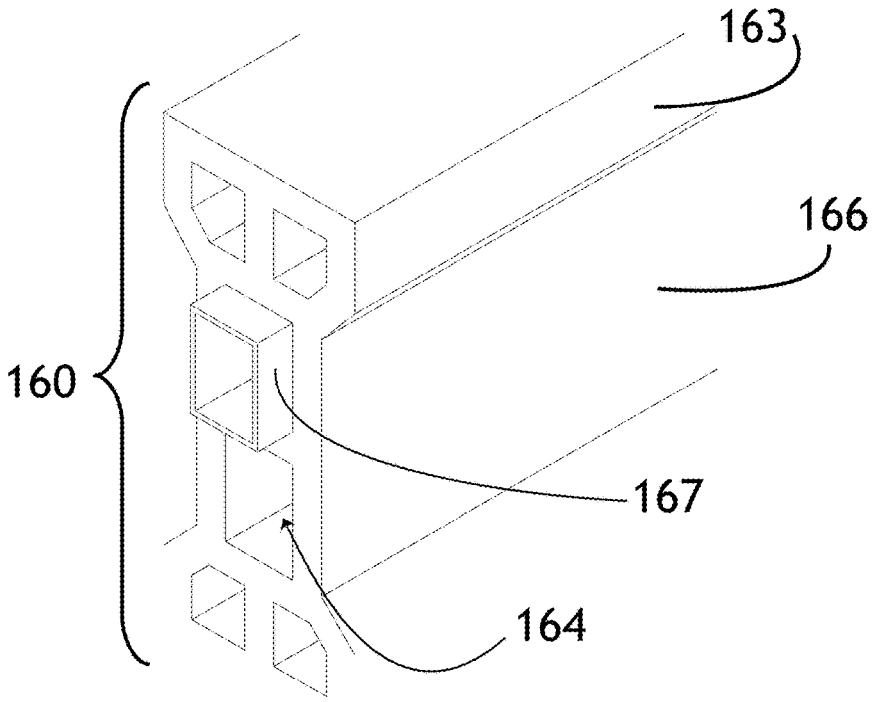
FIG. 15 is a perspective view of a double joist as used in the deck of FIG. 12.
Figure 16:
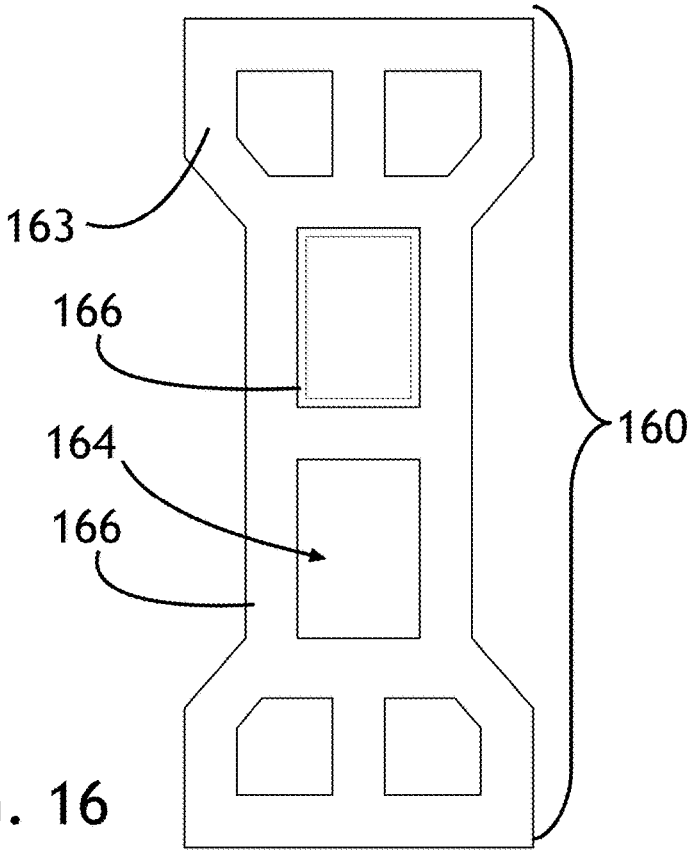
FIG. 16 is a front elevation of the double joist and double joist structural insert of FIG. 15.

The square post base bracket 120, shown in FIGS. 7-9, is manufactured to interface with the post 110. It is ideally formed from machined aluminum. One of the more noticeable features of the post base bracket is the presence of four dorsal mounting fins 124. In use, the post base bracket is mounted through port 127 to the slab foundation over a spot footing and the post situated upon the post base bracket with each cell aligned with and encompassing one dorsal mounting fin 124. The post may then be screwed into each fin with one or more tapping screws. Similarly, a corner post base bracket 140, shown in FIGS. 10-12, having additional perpendicular dorsal fins 144 and two mounting ports 147, may be utilized, which may mate with a corner post 130.

Figure 17:
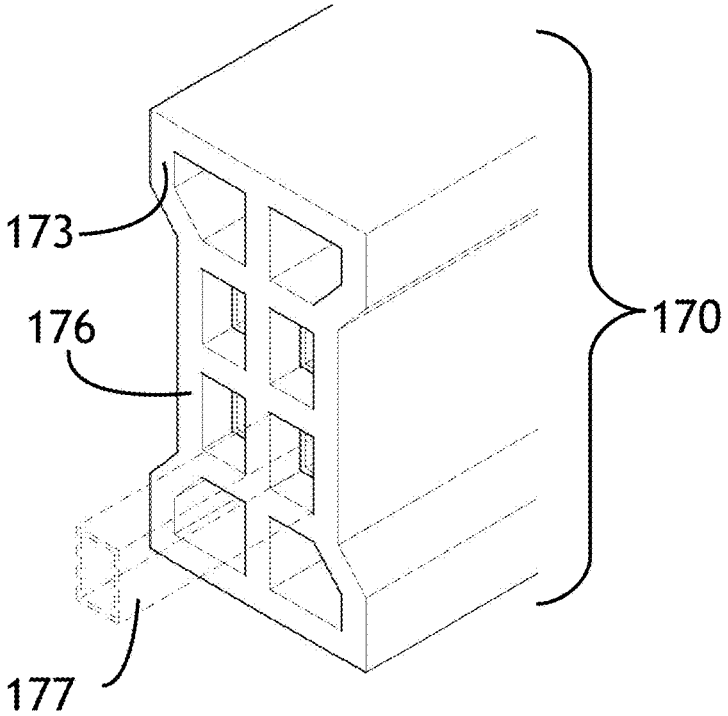
FIG. 17 is a perspective view of a triple joist as used in the deck of FIG. 2.
Figure 18:
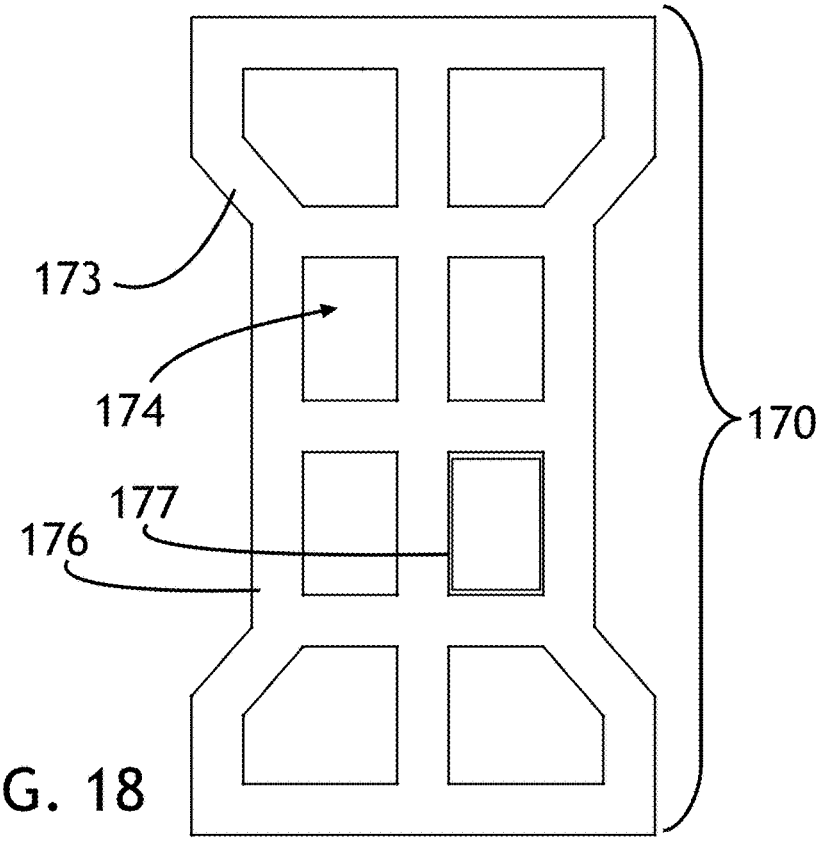
FIG. 18 is a front elevation of the triple joist and triple joist structural insert of FIG. 17.
Figure 36:
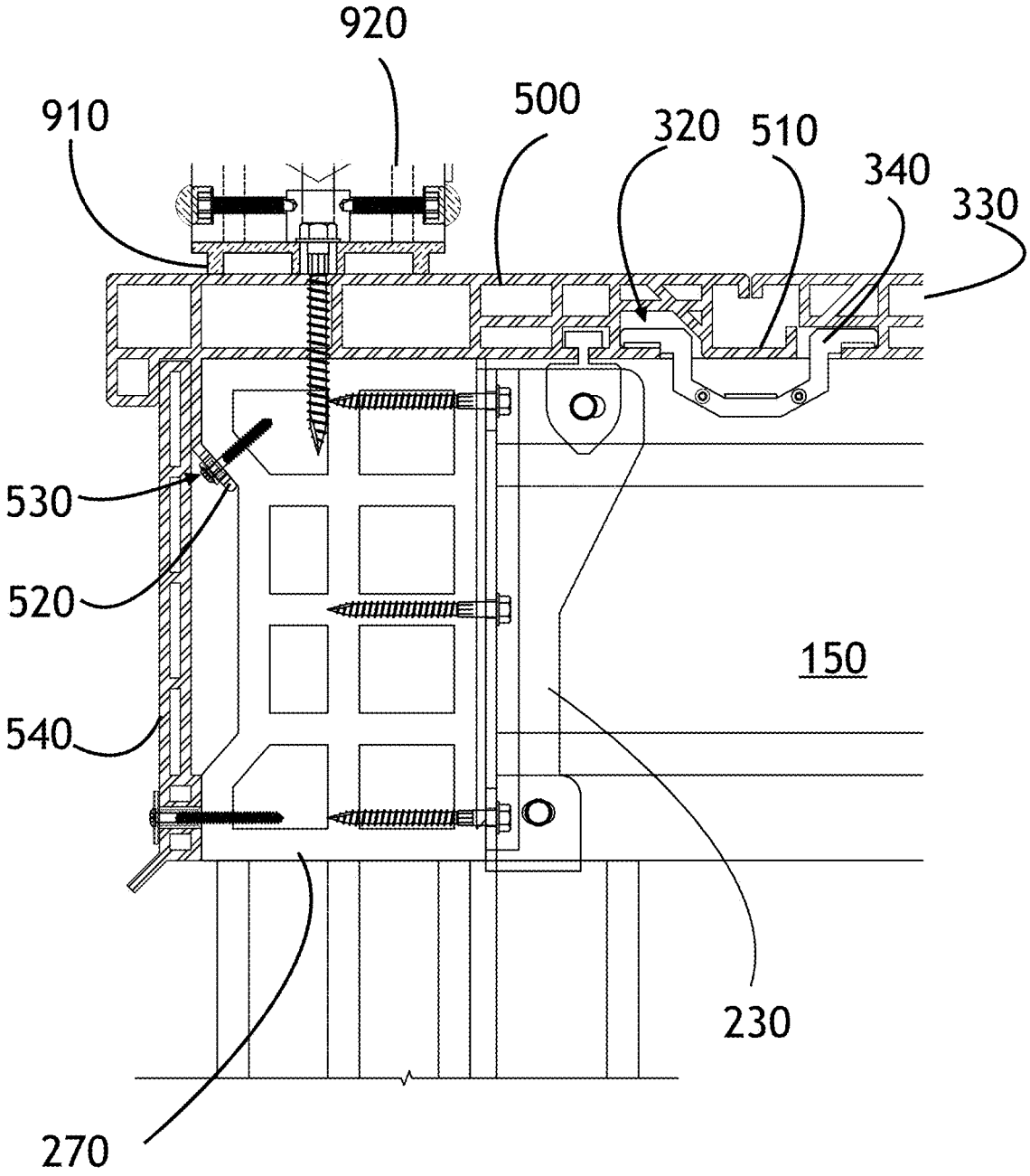
FIG. 36 is a close-up view of the deck landing of FIG. 29, focusing on the deck perimeter edge cap and beam apron, as well as side view of joist hanger, structural beam, and railing post bottom bracket and connection.

Beams and joists provide the platform upon which the deck planks are laid. Beams are typically broader and are supported by the posts while the beams then support the joists. In the preferred embodiments, shown in FIGS. 13-18 joists 150, 160, 170 have two heads 153, 163, 173 with single 156, double 166, or triple 176 vertical wall supports extending therebetween. Like the posts, these joists are extruded, with cells for decreasing mass in each head and between the vertical walls in the double 164 and triple 174 joist versions. The type of joist used will depend upon its function and the load desired to be borne by the component. Typically, single 150 and double 160 joists (FIGS. 13-16) will primarily be used to support the deck surface while triple joists, such as the one shown in FIGS. 17 and 18 would be used for greater load bearing capabilities. Perimeter beams 270 will be used as beams residing on the posts. Inserts 167 and 177, like those used in the support posts 110 or 130, may be fitted into the beams for added support. The cells 164, 714 may be manufactured with dimensions identical to cells 114 or 134 as described in the posts, above, thereby allowing use of the same inserts 117, 137 for multiple applications. It should also be understood that the inserts may mimic the shape of cells in the heads of each beam, as shown in FIG. 36.

Figure 25:
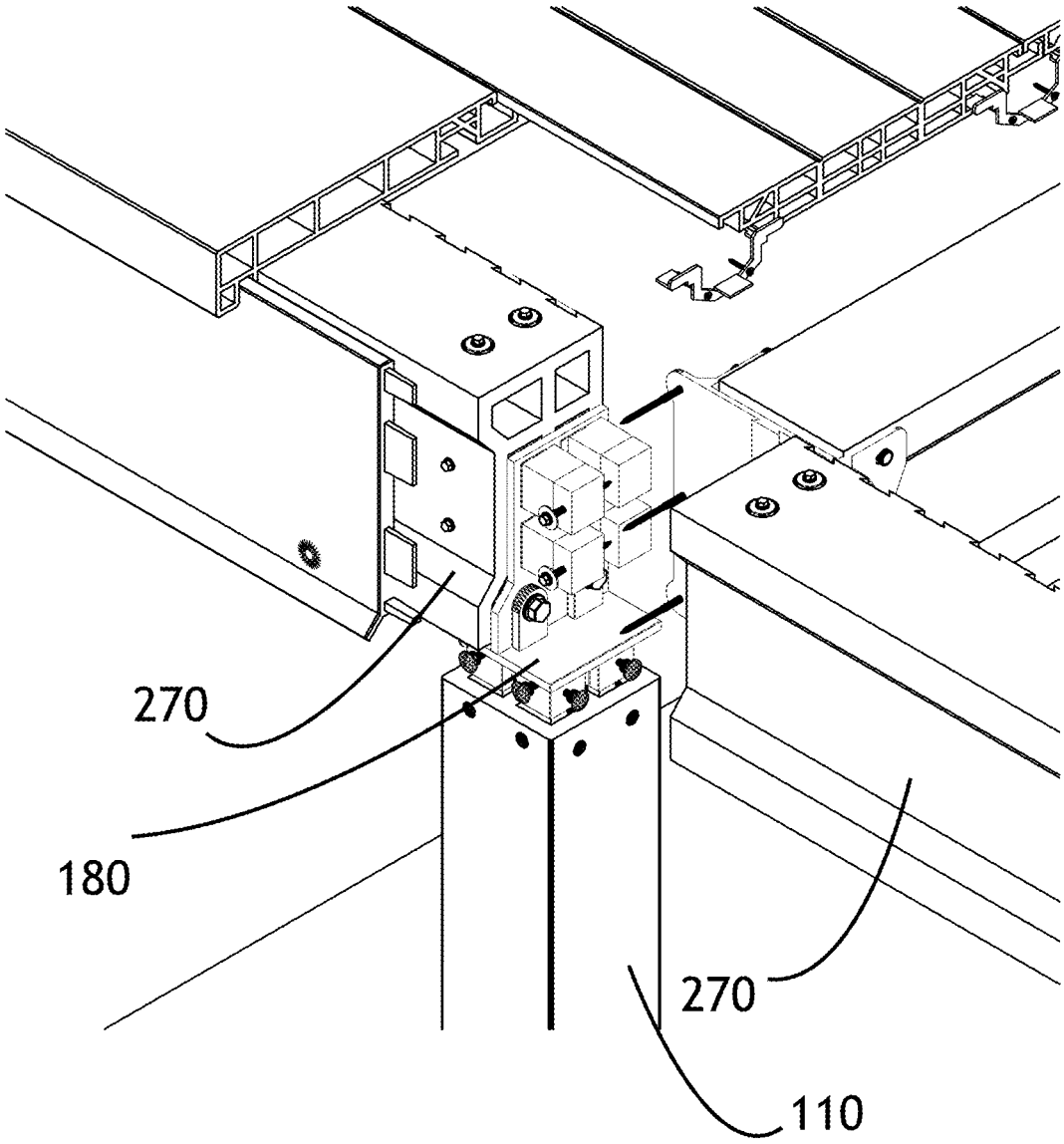
FIG. 25 is an exploded view of an assembled center post joint beam bracket as used in the deck of FIGS. 1 and 2.

Connecting the beams to the posts involves a combination of hold-downs that interface with the cells formed in the posts and the beams. One center post head bracket hold-down 180 is designed to work with center posts and beams abutting each other (FIGS. 19-24) while a corner post beam bracket 190 (FIGS. 28 & 29) is designed to work with corner posts and two beams at a right angle to each other. The center post head bracket hold-down 180 is formed from two pieces, a center post top bracket 182 and a center post beam bracket 186 which are bolted together. The center post beam bracket 186 is centrally located over the center post top bracket 182 and has bosses 188 on opposite sides for interfacing with the cells of two abutting perimeter beams, which will typically serve as exterior beams. The center post top bracket 182 has ventral fins 184, like the dorsal fins of the base brackets, that interface with a center post 110. When installed (FIG. 25), the center post top bracket 182 creates two shoulders when installed over said post 110 which in turn support beams 270.

Figure 26:
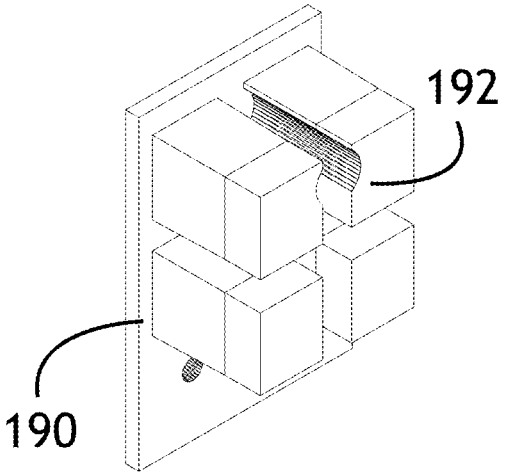
FIG. 26 is a perspective view of a corner post beam receiver bracket, used in the deck of FIG. 2.
Figure 27:
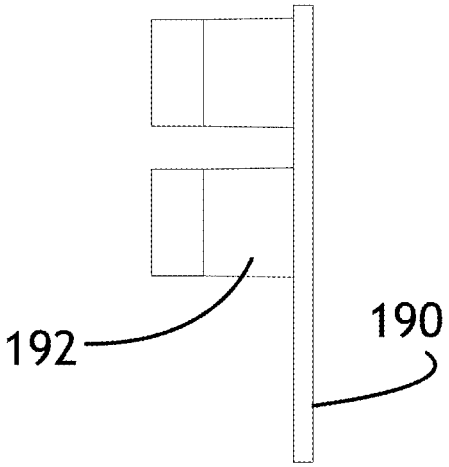
FIG. 27 is a side elevation of the corner post beam receiver bracket of FIG. 26.
Figure 28:
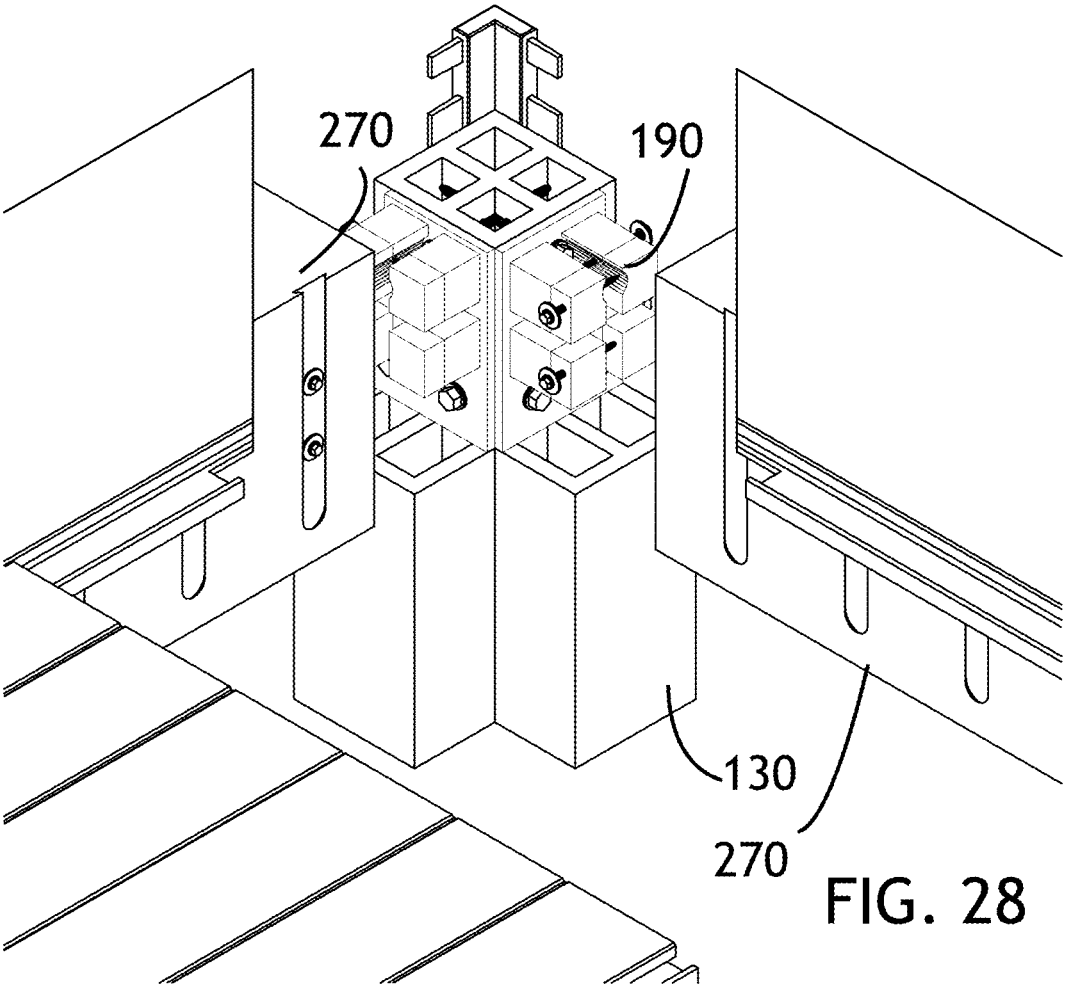
FIG. 28 is an exploded view of a corner joint, as used in the deck of FIG. 2.

To form the corner joint, the top of a corner post 130 is factory rabbeted at the two legs of the L, creating two perpendicular shoulders 132 about a central corner structure (FIGS. 5 & 6). This structure is unique to the practice of the present invention but is not the exclusive definition of the same. Two corner post beam brackets 190, shown in FIGS. 26 and 27, are then installed over the shoulders 132, on the remaining central corner structure of the corner posts. These beam brackets may be screwed into the body of the corner post. Each corner post beam bracket has a set of interface bosses 192, like the post base brackets, which interface with the spaces formed within the triple joist. As a triple joist 170 is positioned over the bosses, it then rests upon and is supported by a shoulder 132 in the corner post 130 (FIG. 28). The bosses may be of any shape that will adequately fit within the beam cells, as illustrated by the upper and lower sets of bosses in the Figures. In the depicted embodiment, the upper bosses maintain a general perimeter to fit within a cell, but also feature a rounded cut-out between the bosses to access allow for a ratchet head to tighten a screw into the beam in the process of securing the bracket to the beam.

Figure 29:
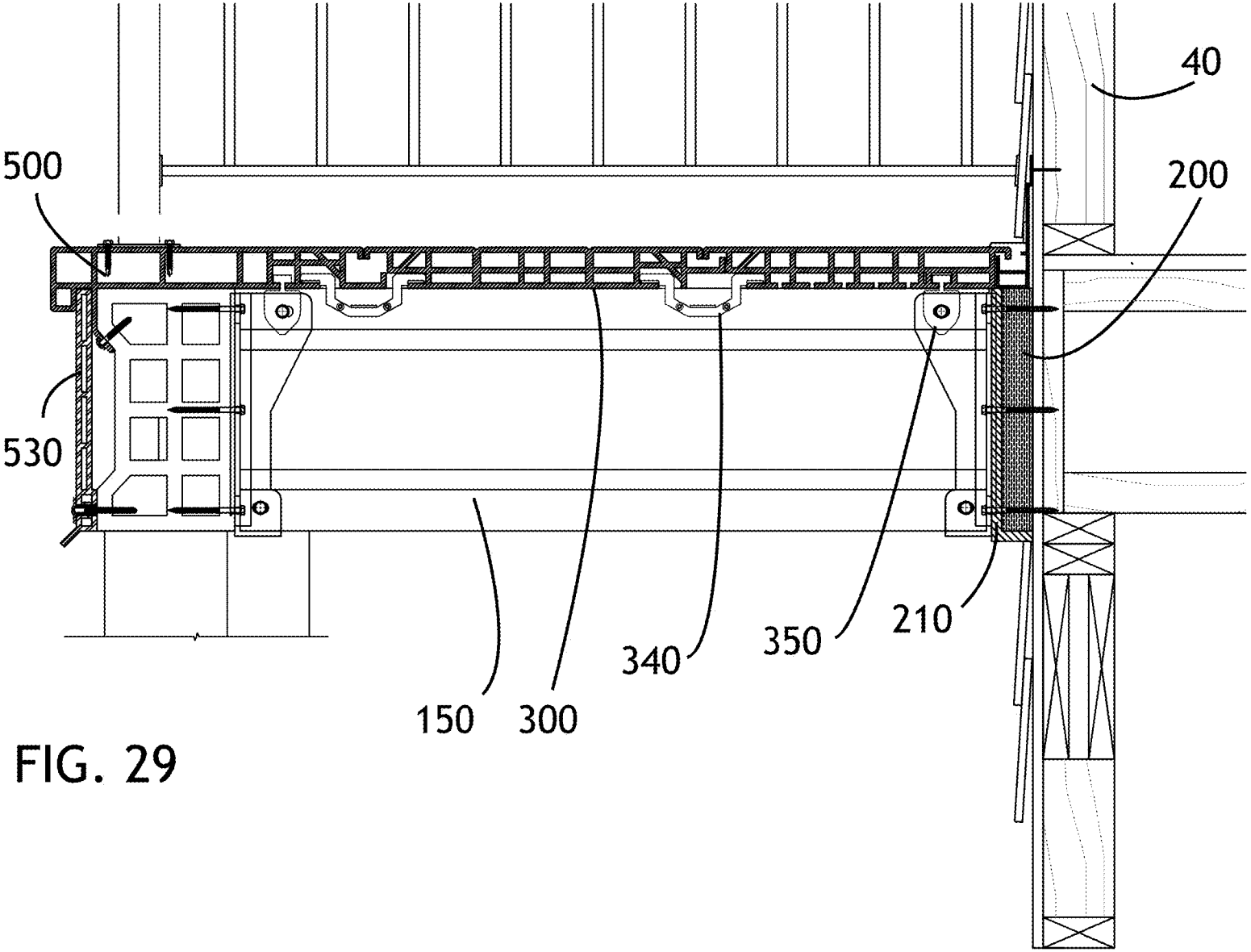
FIG. 29 is a sectional view of a deck landing constructed by utilizing the teachings of the invention in a preferred embodiment.
Figure 30:
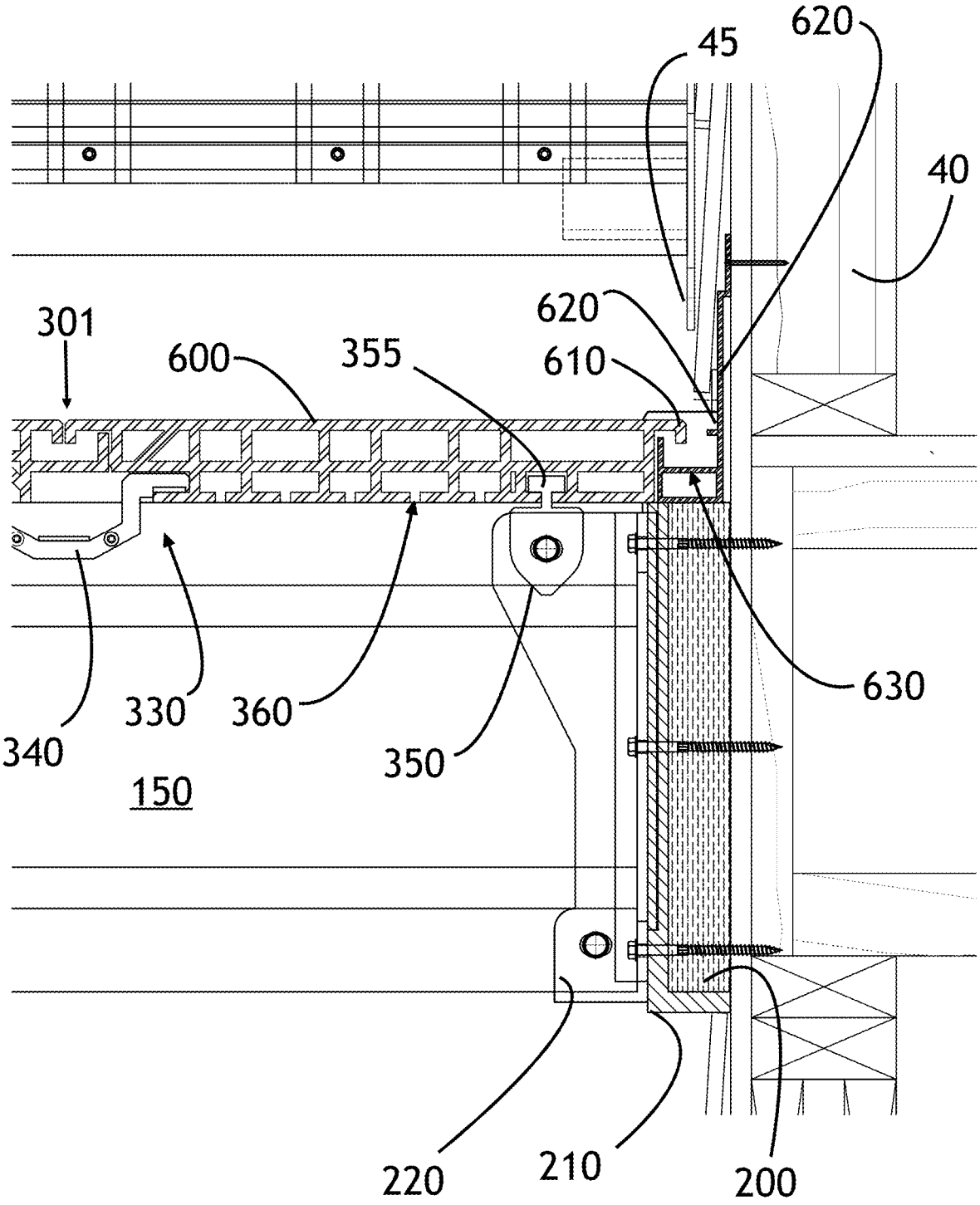
FIG. 30 is a close-up view of the deck landing of FIG. 29, focusing about the ledger board and upper waterway trough.
Figure 31:
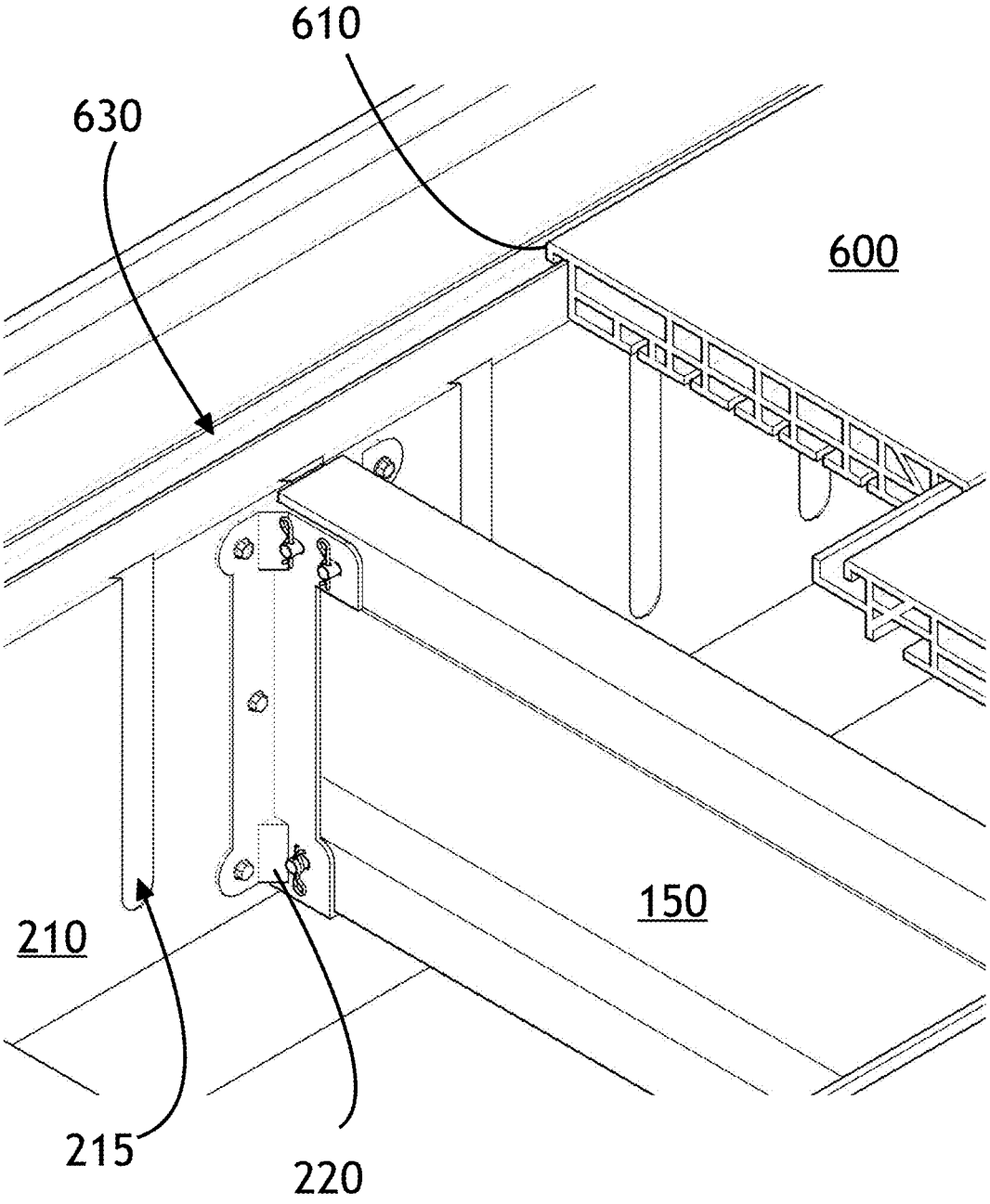
FIG. 31 is an exploded perspective view of the deck landing as shown in FIG. 30, including a joist hanger, hanger shield and hanger shield slots.
Figure 32:
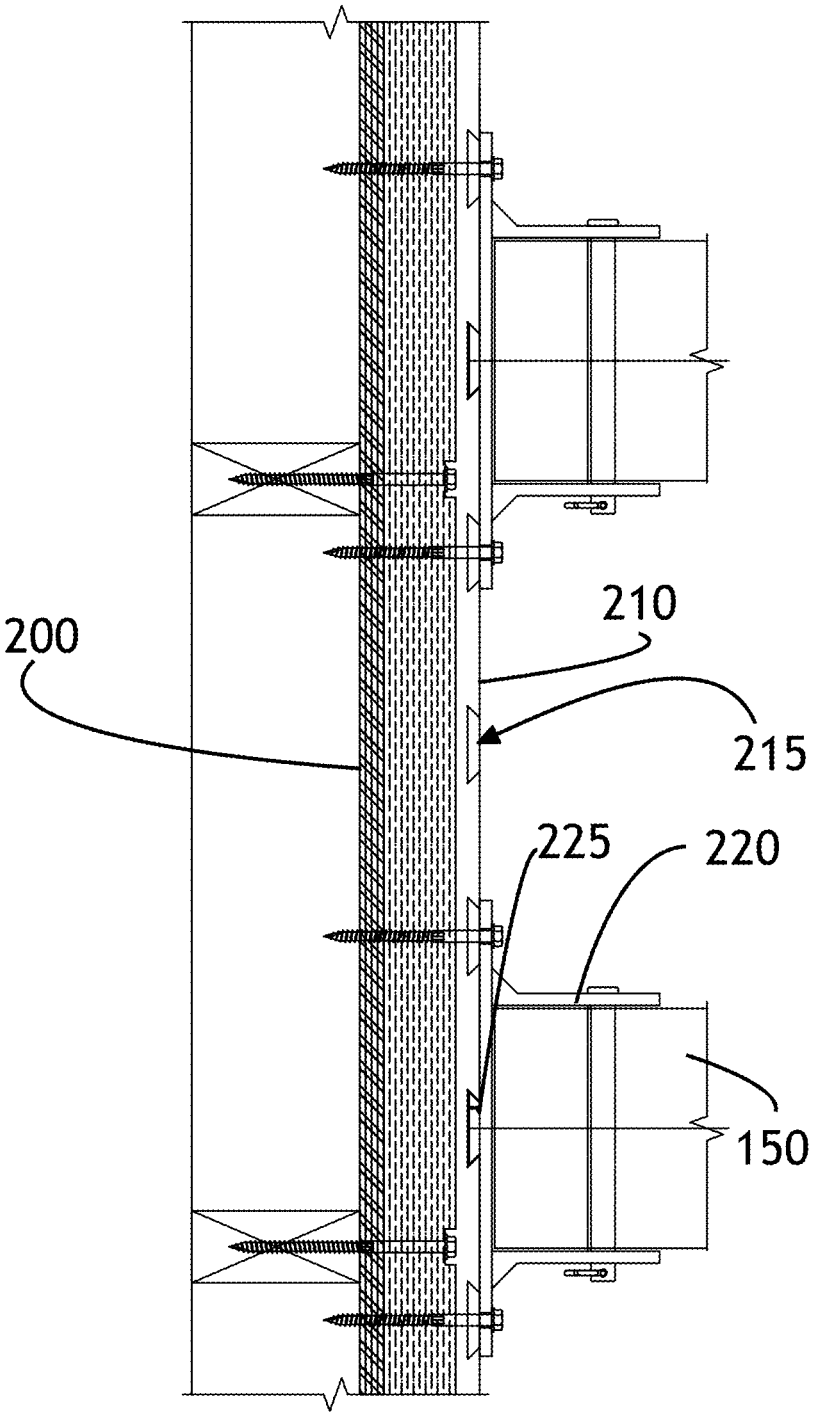
FIG. 32 is a top plan view of an assembled ledger board as used in the deck landing of FIG. 29 and FIG. 30, with the wall waterway flashing removed.
Figure 33:
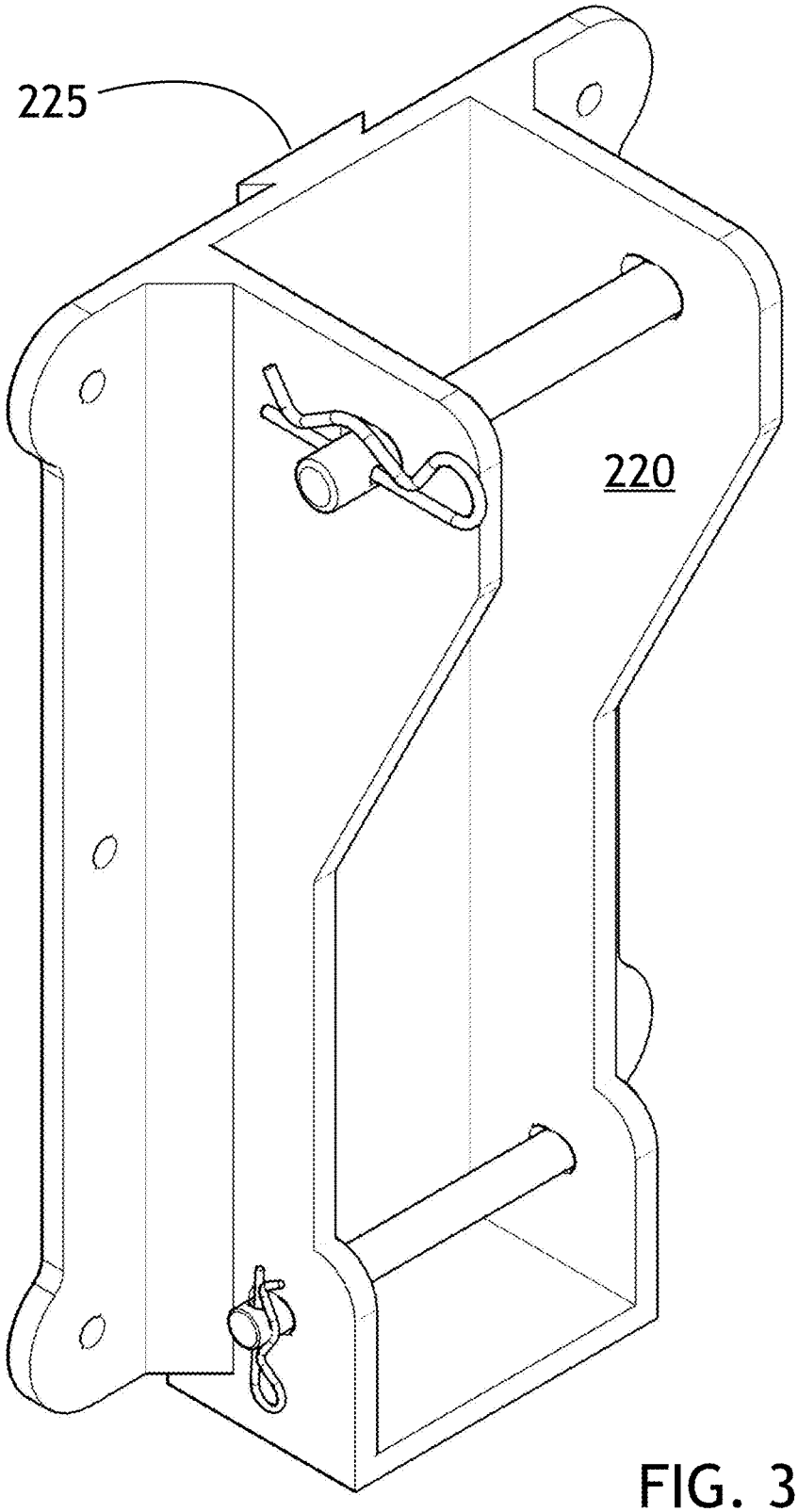
FIG. 33 is a perspective view of a joist hanger end cap.
Figure 34:
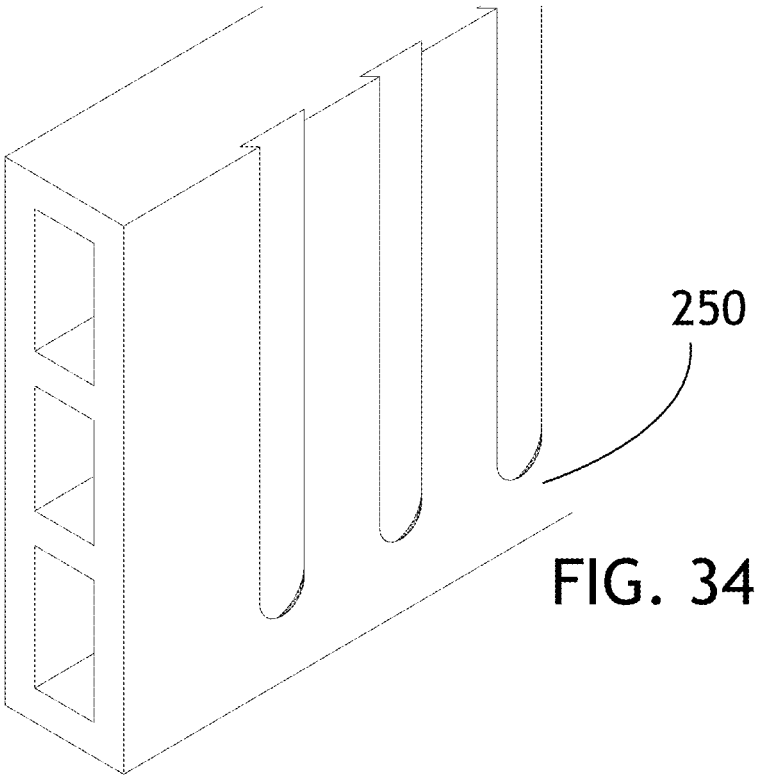
FIG. 34 is a perspective view of a single beam bridging support.
Figure 35:
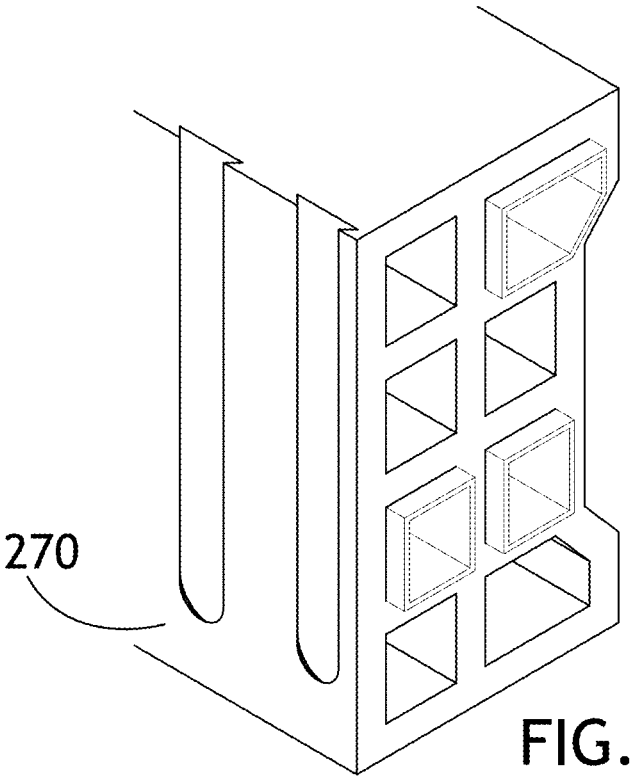
FIG. 35 is a perspective view of an alternate perimeter beam.

As shown in FIGS. 29 & 30, joists 150, 160, or 170 will then be positioned within the perimeter of the deck, generally perpendicular to the exterior wall 40 and ledger board 200 of the structure. Typically, the material of the joists, their thickness, and their length determine the spacing between the joists. The preferred deck construction will have a joist hanger shield 210 placed over the top of the building's ledger board 200, attached to the building 40. Stand-alone decks would have sets of opposed beams instead of a ledger board and hanger shield. Each hanger shield 210 has a plurality of evenly spaced vertical slots 215, as shown in FIGS. 31 & 32. Hanger shield slots 215 may be positioned at a uniform center distance apart, such as 4 or 6 inches, to provide variable spacing for the attached joists. Placement of joists will then follow similar logic as traditional placement—thinner and/or longer joists needing to be closer together while thicker and/or shorter joists may have greater spacing. In construction, a joist is measured and cut to length, then fitted with two end caps, which may then be secured to the joist with screws or other fasteners. One end cap is a joist hanger 220 which will be bolted through the joist hanger and hanger shield deep into the building's ledger board. Each joist hanger end cap (FIG. 33) presents a boss 225 that will fit within the slots 215 of a hanger shield 210. The joist hangar shield may be integrated with the beams to provide an opposed anchor point for the joists. FIGS. 34 and 35 depict such a fusion of the single beam bridging support 250 and perimeter beams 270. These may be used to support joists and beams in the structure. As seen in FIG. 36, opposite of the joist hanger shield, the beam 270 is designed to match both the specific layout and slots 215 to receive the opposing end cap 220 (with slip pins and carter lock pins for joist connection to 220) into the beam 270. The joist hanger 220 will then be screwed to the joist beam 270 securing joist on both ends of the joist. So, for assembly, the joist hanger 220 is simply positioned over one hanger shield slot and dropped into place per desired segmented layout shown in both FIG. 32 and FIG. 36, then secured into the hanger shield and mechanically screwed deep into the building ledger (FIG. 32) then matching the slots 215 inherent on opposing beam 270 on opposite side, then mechanically screwing hanger 220 (with slip pins and carter lock pins for joist connection to 220) into opposing beam 270. Thicker joists may also have joist hanger end caps 220 that would allow for insertion into two adjacent slots, if the slots are made close enough together on the hanger shield. If a triple joist is used, a corner post beam bracket 190 may also be used to secure the triple joist 170 as well as the perimeter beam 270 to the ledger board (FIG. 45), forgoing the hanger slot 215 at abutment to 650 and 190 FIG. 42. If beam 270 is used the hanger slot on 270 will be turned to the interior of the deck to receive "bridging supports" to support edge cap, when edge cap 500 is running parallel with the joist FIG. 2

Figure 37:
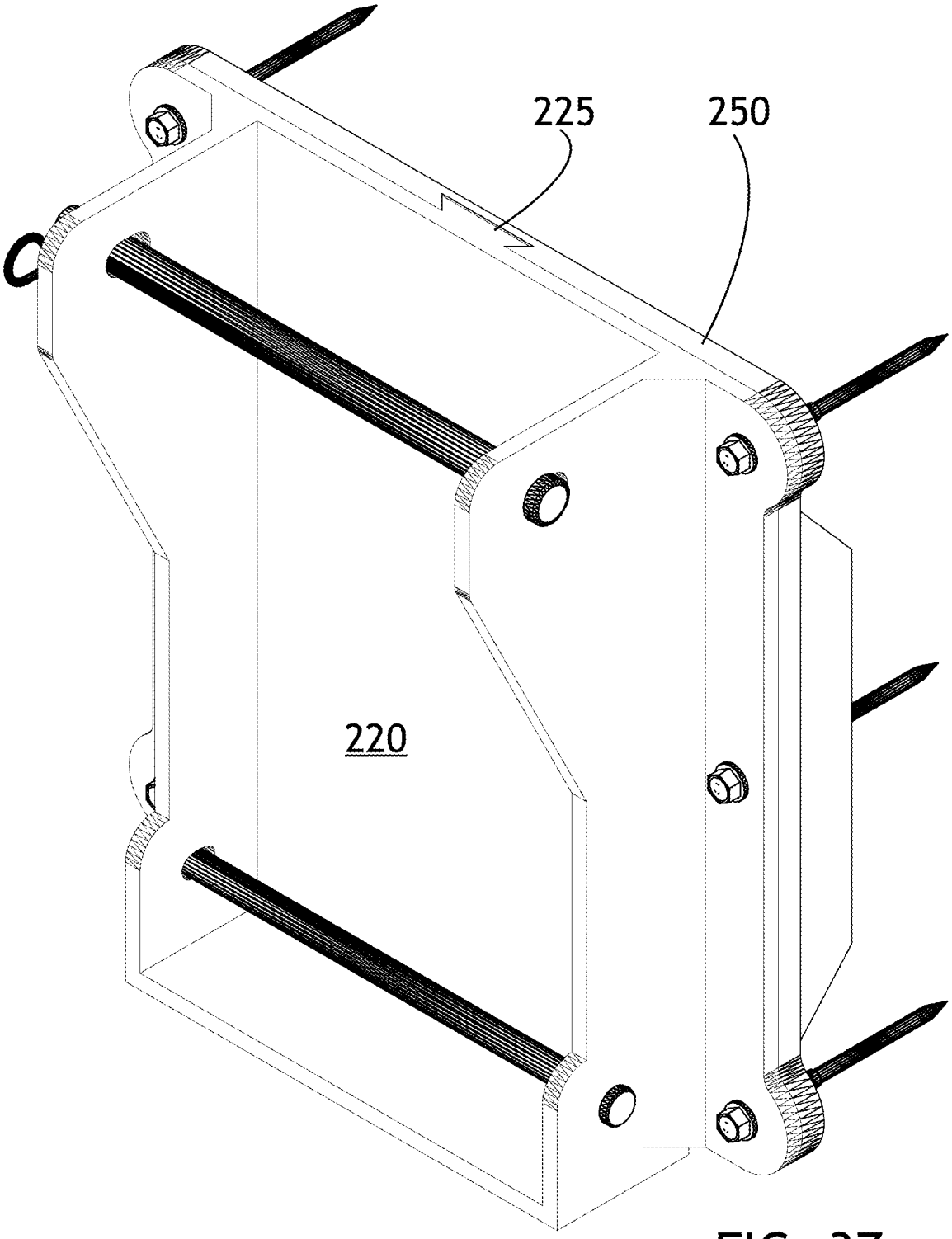
FIG. 37 is a perspective view of a joist hanger anchor and joist hanger bracket.

Bridging supports may be added between joists as needed, as is shown in FIG. 37. Individual joists 150 may be cut to fit between adjacent joists and positioned accordingly. Bridging supports are placed on layout to support mainly the edge cap and or field mullion generally, but not limited to, when edge cap 500 (FIG. 51) and or field mullion 400 (FIG. 39) are running parallel to the support joist that runs beam to ledger. By using single beam bridging support 250 (FIG. 38) in leu of 150 standard joist and using the hanger 220 inserted into 215 hanger shield/beam slots.

Figure 38:
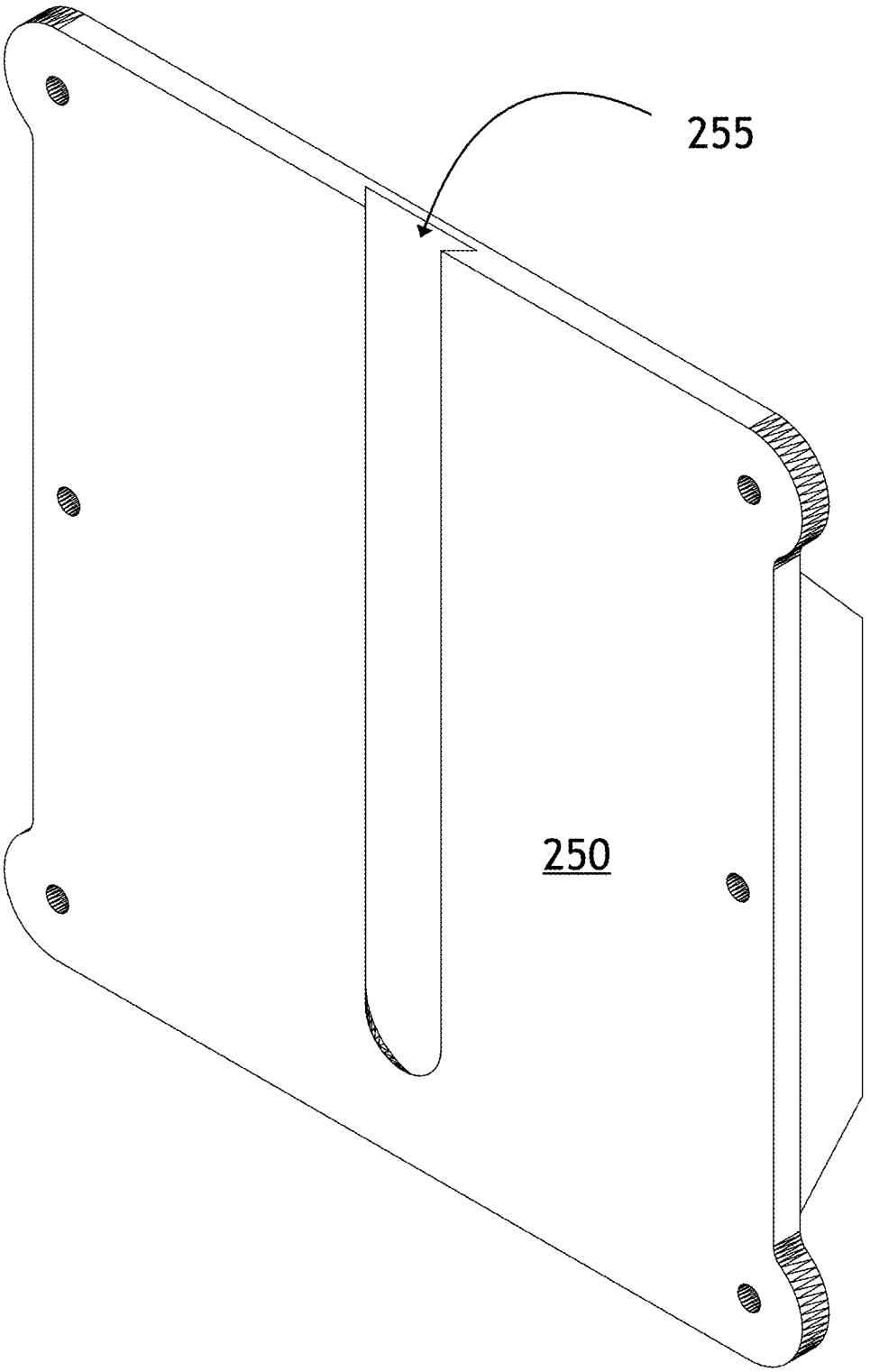
FIG. 38 is a perspective view of the joist hanger anchor of FIG. 37.

An alternate anchor may be supplied for joining beams, shown in FIGS. 37 and 38. This anchor adapts the boss 225 on the back of the brace 220 (a double beam brace being illustrated in these Figures) and provides a contoured back which will fit within the exterior contour of the beams 170 or 270. In this way, a joist or beam may be attached to the exterior side of the anchoring beam, which can be useful in creating beam connections right angles to each other.

After the joists are positioned, the surface components may be placed upon the joists, as shown in FIG. 29. The surface components comprise primarily of deck planks 300 (FIG. 31) but may also include mullions 400 (FIG. 39), wall transition planks 600 (FIG. 30), and deck perimeter edge caps 500 (FIG. 36). Each deck plank 300, shown in FIG. 40 has at least two ventral slots, one being a locking slot 320 with two solid stop walls, the other being a sliding slot 330 with only one stop wall. Typically, a deck perimeter edge cap 500 will have only the locking slot 320 (FIG. 36) while a wall transition plank 600 will have only the sliding slot 330 (FIG. 30). Surface plank interlock clips 340 are provided to hold the planks down on joist surface while interlocking the planks together simultaneously and allowing the deck planks, mullions, wall transitions, joists and beams to move about and absorb the majority of normal expansion and contraction without stress detorsion damage to the all-inclusive surface and beam, joist components. As seen in FIG. 40, the surface plank interlock clip 340 is a generally U-shaped bar with flared ends or tenons 345 with an install thumb tab for ease of installation. Each tenon will fit within the locking 320 and sliding 330 slots of the planks. The surface plank interlock clip 340 is rotated in relation to the plank to fit within the locking slot 320 of either a deck perimeter edge cap 500 or a regular deck plank 300. Then the clip 340 is rotated into locking slot 320 and mechanically secured to the top of the joist or beam. Then the next plank 300 to be set is positioned on deck joist surface and slid such that the sliding locking slot 330 of deck plank 300 encompasses the opposed tenon 345 of interlock clip 340. To secure plank in its intended position, the bend in the U allows the surface plank interlock clip 340 a positive connection to deck planks and deck joists and to avoid mechanical distortion between the deck and joist connection. At this point, a wall transition plank 600 (FIGS. 29-31) may be used to finish the pattern. This process may of course be reversed, beginning at the wall transition plank 600 and ending at a deck perimeter edge cap 500, but the positioning of the locking and sliding slots would also have to be reversed. The plank interlock clips 340 may be manufactured with a keying structure 443 to allow for further interplay with the plank structures.

Plank hold-down clips 350 are used to secure the individual planks to the underlying joists. The plank hold-down clips 350 are typically flat with a T-assembly 355 on their top edges. Receiving slots are positioned on the underside of the field mullions 400 (FIG. 39) and wall transition planks (FIG. 30) edge cap 500 (FIG. 36) but may also be positioned in the deck planks and deck perimeter edge caps. The T-assembly 355 is positioned in the slots 360 by rotating the T-assembly parallel to the slot 360 and twisting the plank hold-down clip 350 when the T-assembly is in place. The plank hold-down clips 350 are then positioned against joists and fastened thereto, holding the planks in position. The use of both types of clips allows the planks and joists to be loosely but assuredly secured with enough give to allow for thermal and other expansion and contraction to occur without stressing the components. This allowance provides for a longer life cycle for the finished deck.

Figure 39:
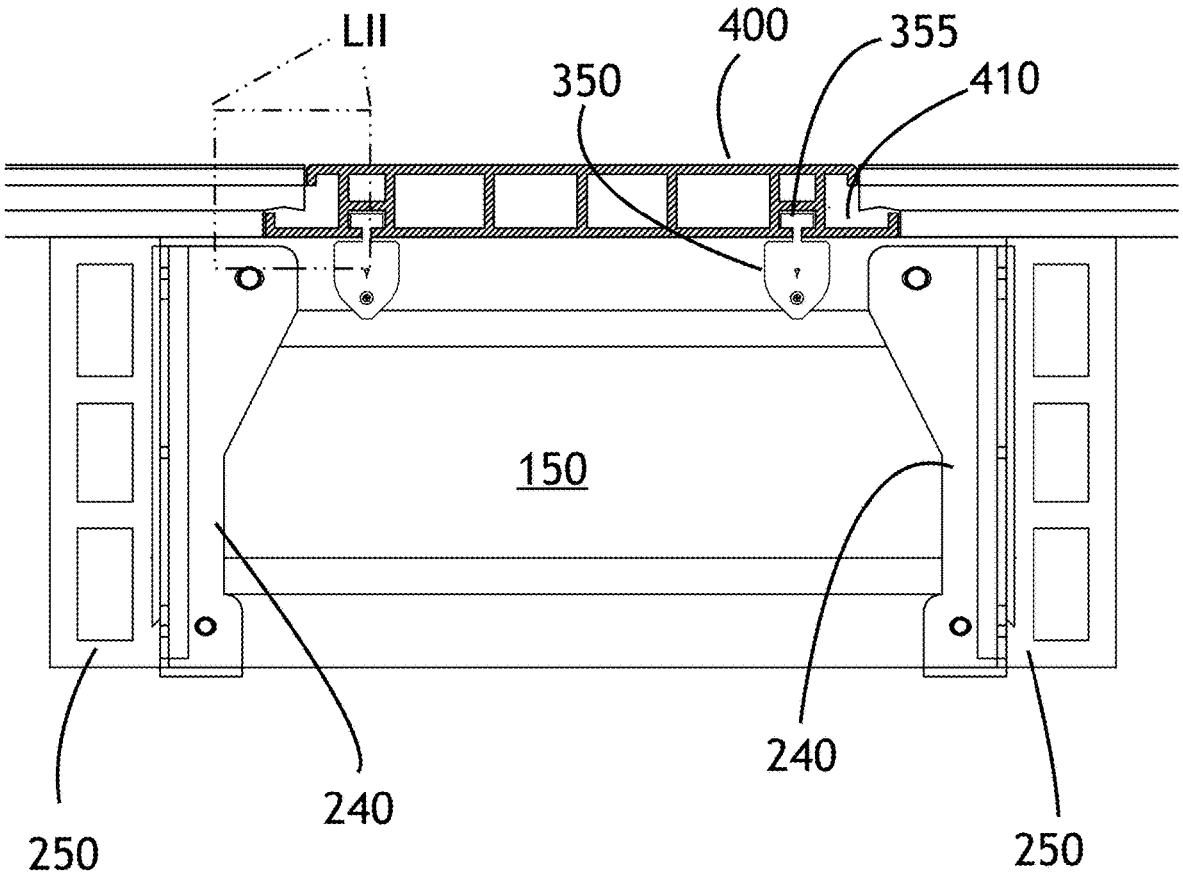
FIG. 39 is a front elevation of joist cross bridging support blocking positioned perpendicular underneath a field mullion, between two joists to support said field mullion.
Figure 40:
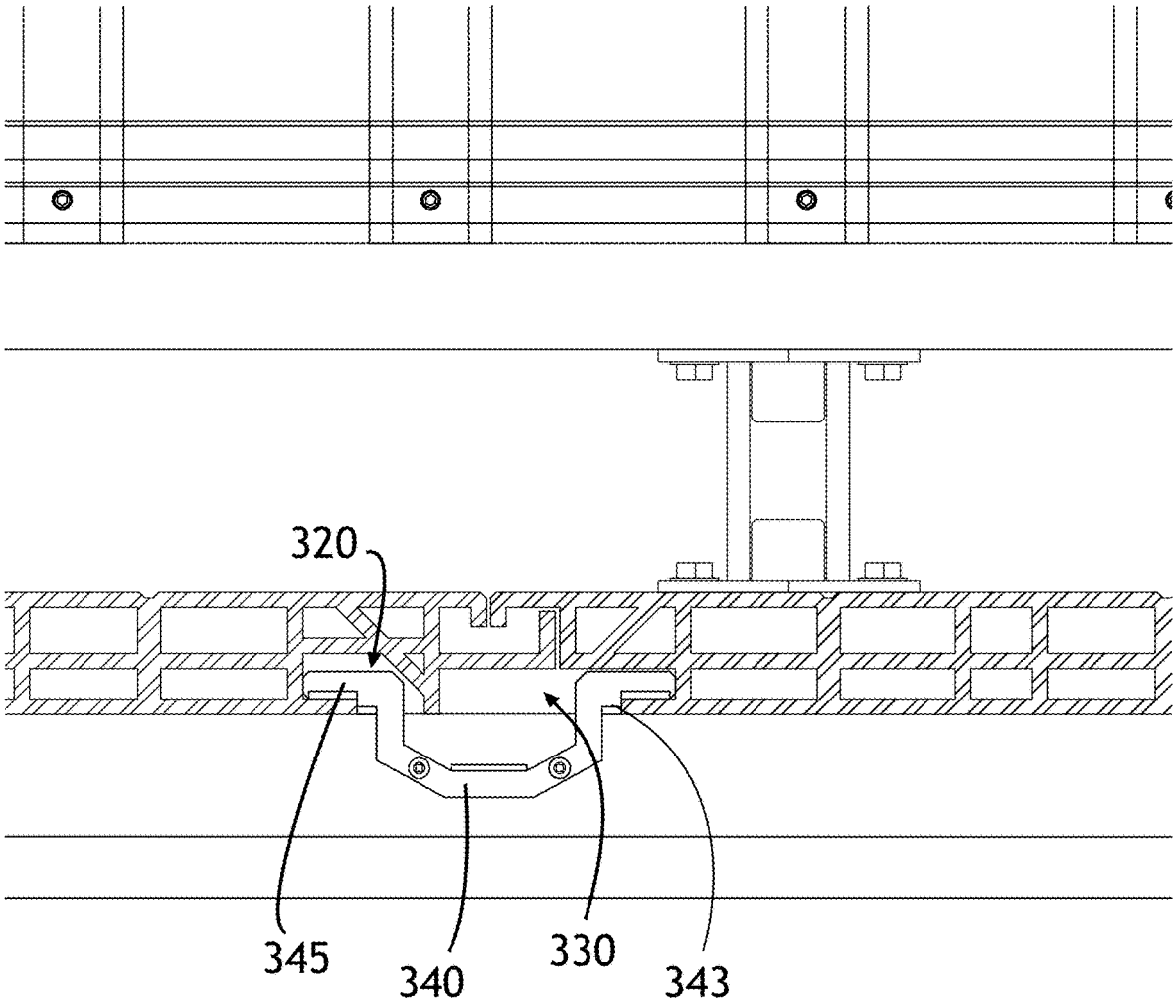
FIG. 40 is a close-up view of the deck landing of FIG. 29, focusing about the deck planks, railing bottom rail, removable square balusters, mid-span bottom rail railing support.

Field mullions 400 are more of a decorative plank allowing to cross grid and to eliminate unwanted butt joints (FIGS. 1 and 39). They also help in water control as is described later. These mullions 400 are generally perpendicular to the deck planks and feature two longitudinal edges that flare outward, thereby providing support shoulders. These flared bottom edges also present water troughs on which the deck planks will lie. Deck planks but-ends 300 are rabbeted with a V-tip drip edge that will lead deck surface water directly into the lower water trough 410 to avoid water vacuum formation on their cut ends to fit over the flared support edges of the mullions 400, and where applicable, the deck perimeter edge caps 500 where such components meet perpendicular to each other lengthwise. The mullions 400 may be fastened to the bridging supports between joists using the plank hold-down clips 350.

The deck perimeter edge cap 500, shown in FIG. 36, is a special plank constructed to fit and extend over the deck edge and contour to the side of the beam or joist and allow for a hidden outside edge of 500 positive connection of 500 to 270 beam or joists. The deck perimeter edge cap 500 features a locking slot 320 identical to a regular deck plank proximate an inner edge, though may be a sliding slot depending on construction preference. This continues the pattern with the surface plank interlock clip 340 for deck perimeter edge caps parallel to the deck planks 300. As the deck perimeter edge caps will also be positioned perpendicular to the deck planks, the inner edge also has a flared bottom rim 510, like a field mullion, that will provide an edge cap lower water trough/support shoulder and drainage when positioned perpendicular to the deck planks 300. The external edge of the deck perimeter edge cap 500 has a flared rim that extend over the edge of and will partially obscure the rim joists and an internal attachment flange 520. Between this broader rim and the attachment flange 520 is a hidden vertical groove 530 in which to slide and secure finishing beam aprons 540. If the deck is not built against a structure, the entire perimeter would be made of deck perimeter edge caps. The deck perimeter edge caps 500 may be directly screwed into the support beam 270 rather than relying on a tie down clip. As is shown, the securement screw may also serve to attach railing or other structures to the deck perimeter edge cap 500.

The wall transition plank 600, shown in FIG. 30 is fitted against the ledger board of the structure. Like the deck perimeter edge cap, it features either the locking or sliding slot common to regular deck planks, generally to opposite of the deck perimeter edge caps. This wall transition plank 600 also features many plank hold-down T-slots 360 as it is intended to be modified, shortened and or cut to size to create the modified surface cantilever to extend over the waterway trough to capture the water to maintain water control 301 so cut by exposure of the partial tie down slot structure. It should be noted that the requisite cut will not be wholly orthogonal to the plank but will follow the contours of the slot structures to create the requisite seam 301 with the neighboring plank. The opposite edge presents an upper finger cantilever 610 that will interface with wall transition waterway flashing trough 630 positioned in the wall transition waterway flashing 620 over the ledger board and assist with water control (FIGS. 30 and 31). Wall transition waterway flashing 620 features a back flange 636 that extends underneath the siding 45 of the wall 40. It may be attached directly to the wall via this flange 636 and rely on the siding to cover the joint.

Figure 41:
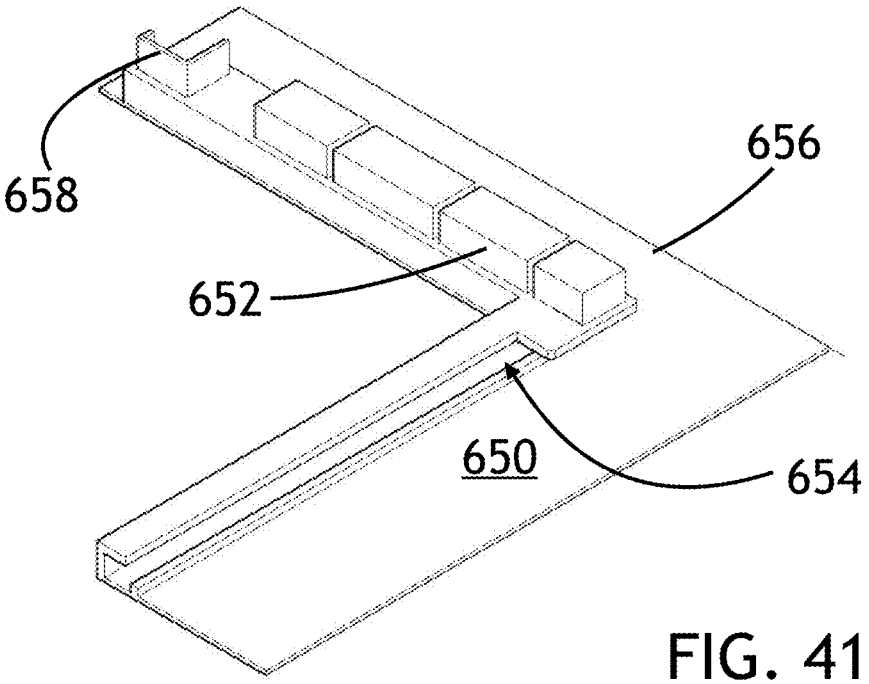
FIG. 41 is a perspective view of deck perimeter edge cap transition flashing as used in the deck.
Figure 42:
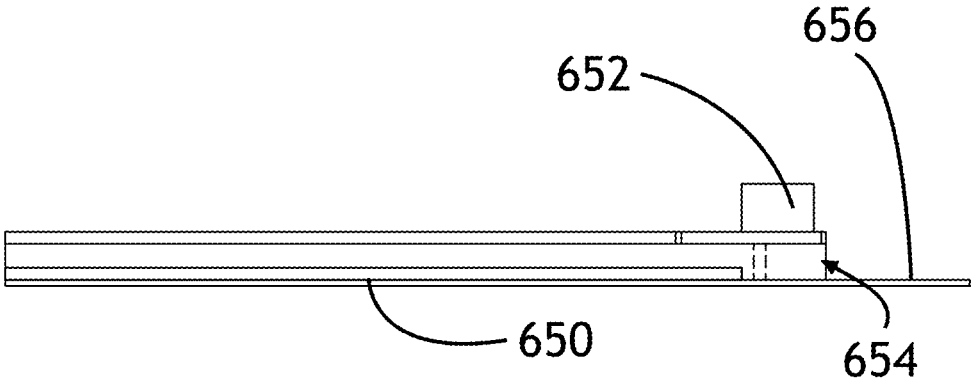
FIG. 42 is a side elevation of the deck perimeter edge cap transition flashing of FIG. 41.
Figure 43:
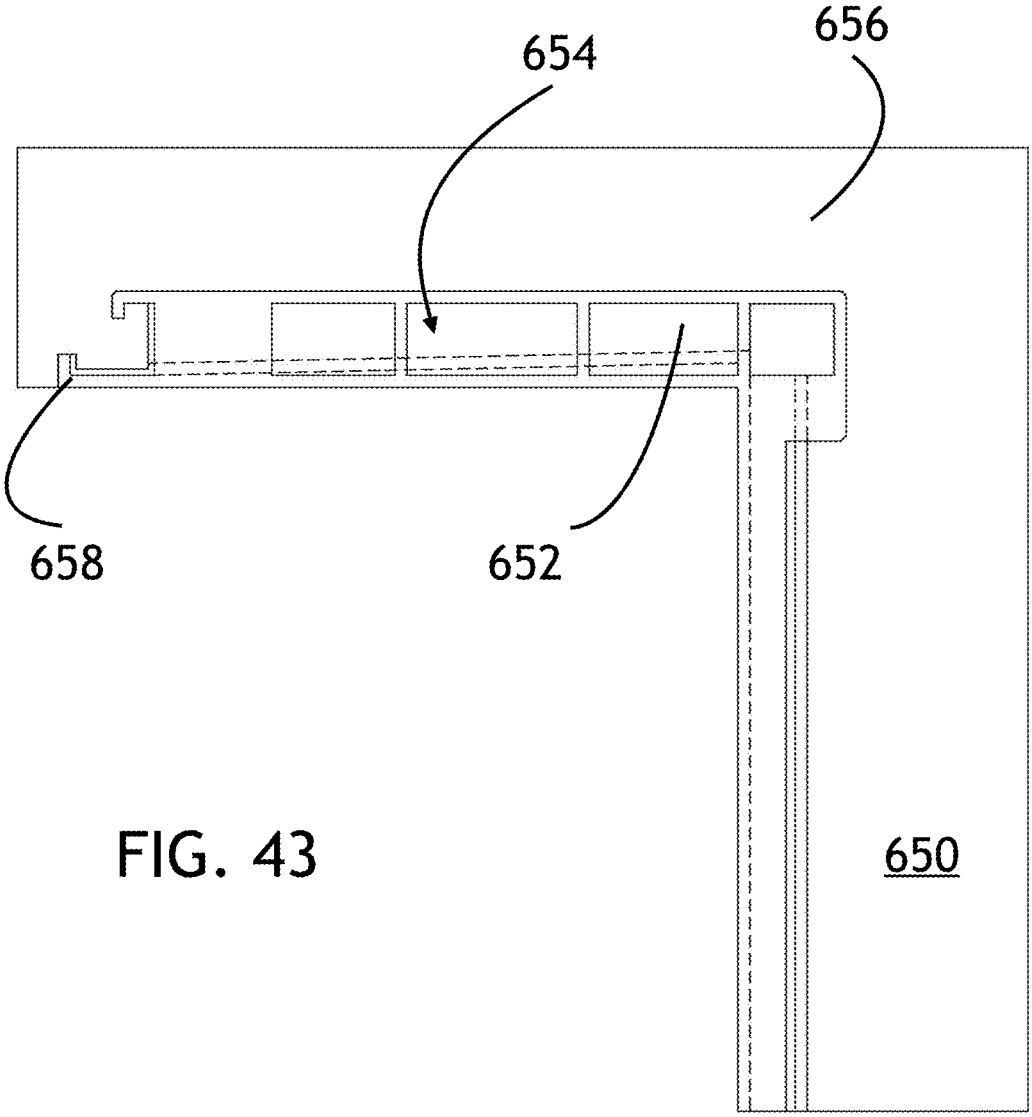
FIG. 43 is a front elevation of the deck perimeter edge cap transition flashing of FIG. 41.
Figure 44:
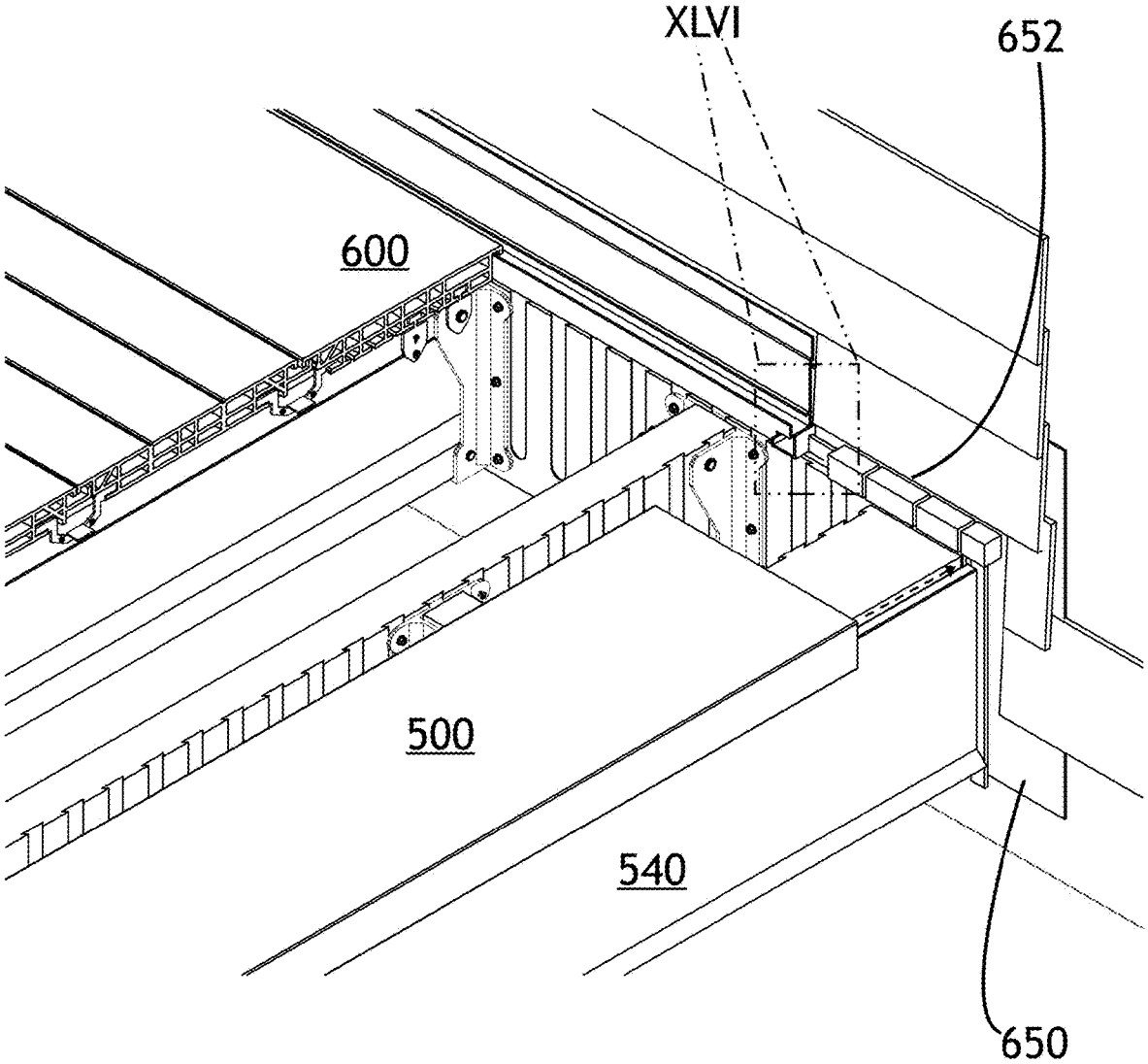
FIG. 44 is a partially exploded view of the deck of FIG. 1, focusing on a corner adjacent an exterior wall with siding.
Figure 48:
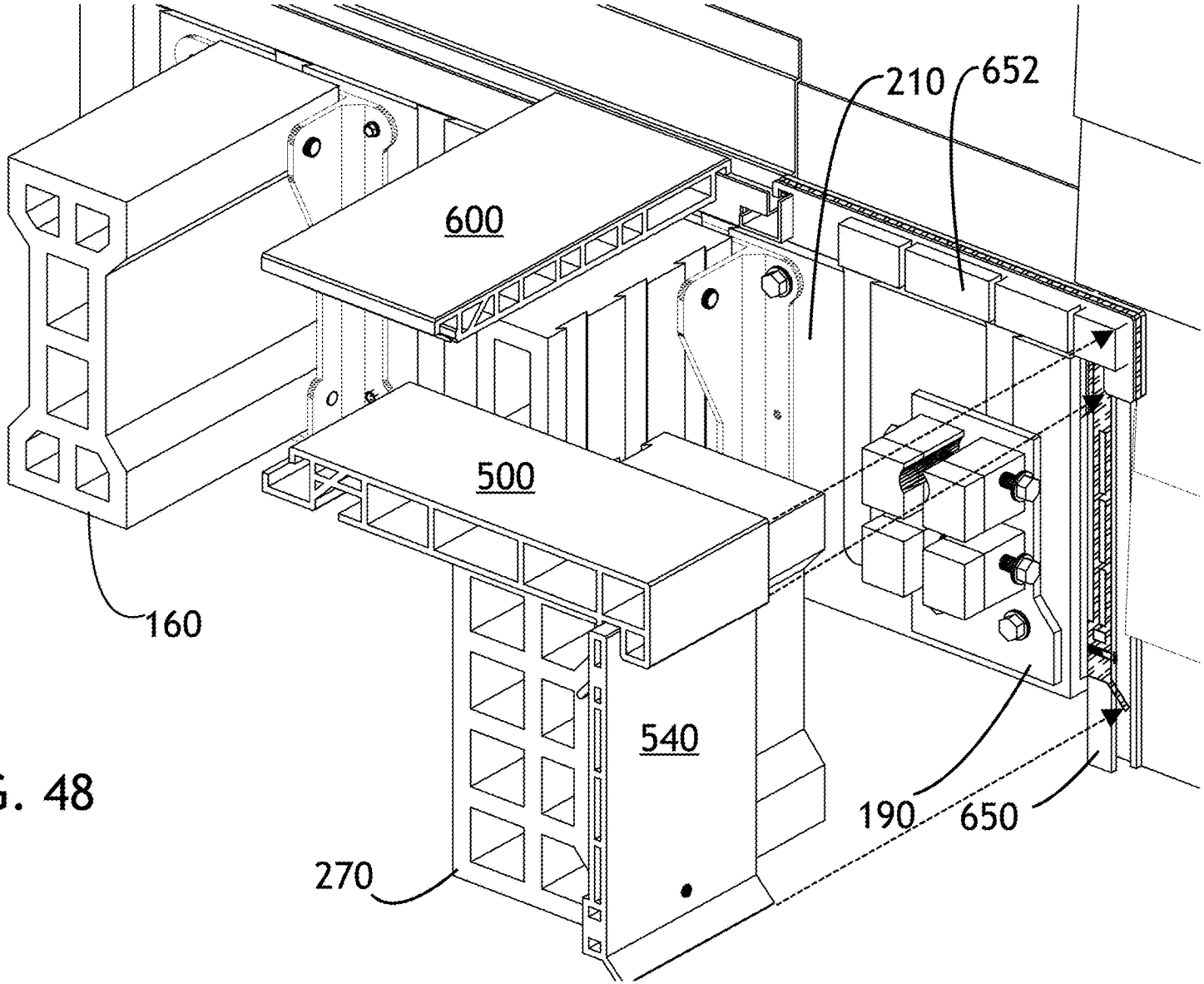
FIG. 48 is a close-up, partially exploded view of the corner of FIG. 41, showing the end cap transition flashing, beam to building flashing.
Figure 49:
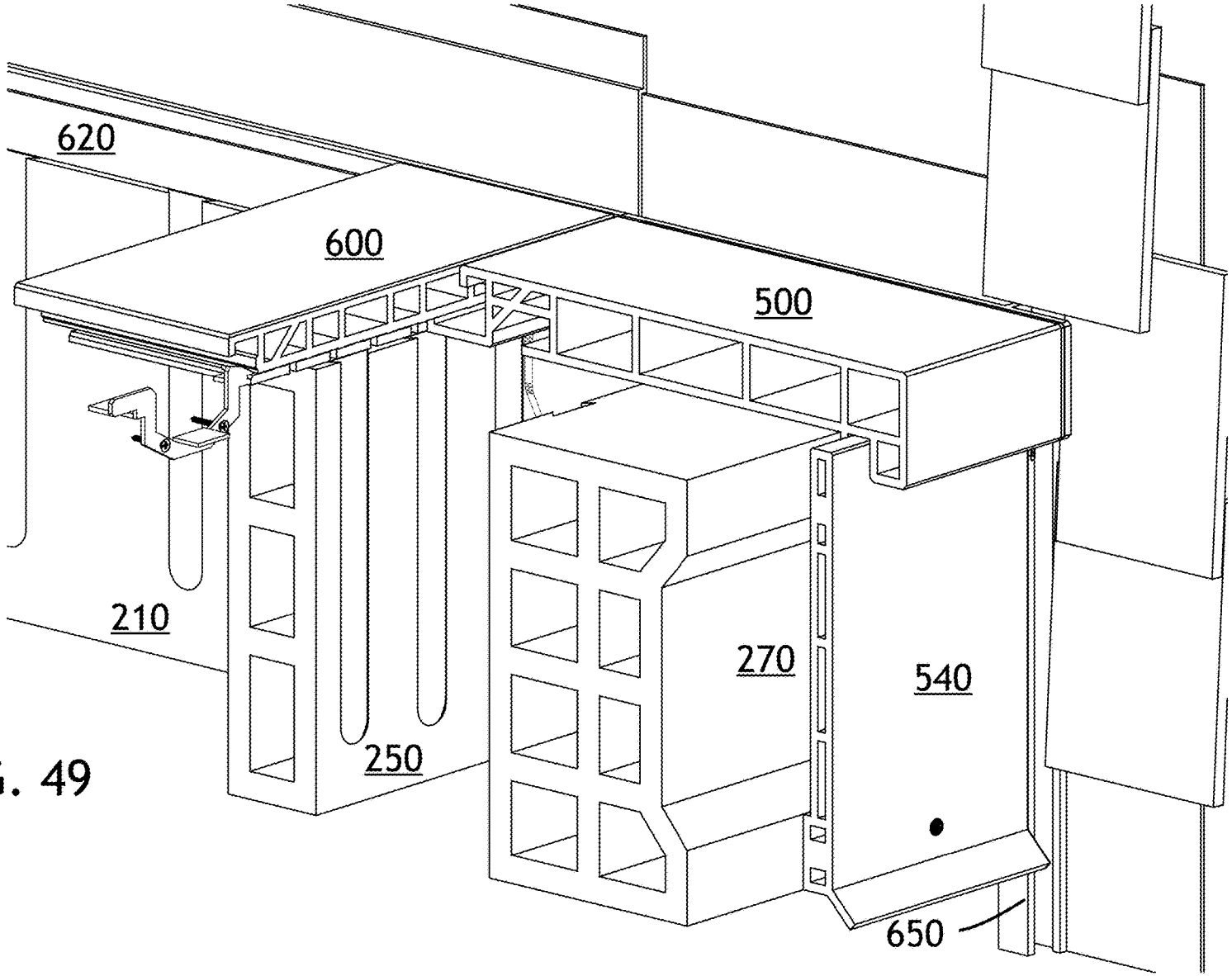
FIG. 49 is a close-up, cut-away view of FIG. 41, assembled, Showing the abutment, end cap transition flashing, beam to building abutment.

Deck perimeter edge caps 500 are used in the entire perimeter of the deck 10 (FIG. 1) except against the house. As such, two (or more) deck perimeter edge caps 500 will typically abut the wall 40, while other deck perimeter edge caps may be mitered into a corner for other joints. To facilitate these butt joints, deck perimeter edge cap transition flashing 650 is provided, as shown in FIGS. 41-43. The deck perimeter edge cap transition flashing 650 is a right-angled plate with a back flange 656 like the wall transition waterway flashing 620, and a waterway trough 654. However, the front wall of the trough 654 features a plurality of interface bosses 652 which are positioned and spaced to interface with the hollow spaces of an end of the deck perimeter edge cap 500. It also features a shoulder structure 658 in fluid communication with the waterway trough 654 that will spill into the lower water trough of the deck perimeter edge cap (FIG. 47), thereby connecting the waterways. The deck perimeter edge cap transition flashing 650 may fit on top building ledger connected to building 40 or just inside the hanger shield 210. To install the deck perimeter edge cap 500, it is simply pushed into position (FIGS. 48 & 49) over the bosses 652. The deck perimeter edge cap transition flashing will have both left and right mirrored versions, depending on the installed location.

Figure 45:
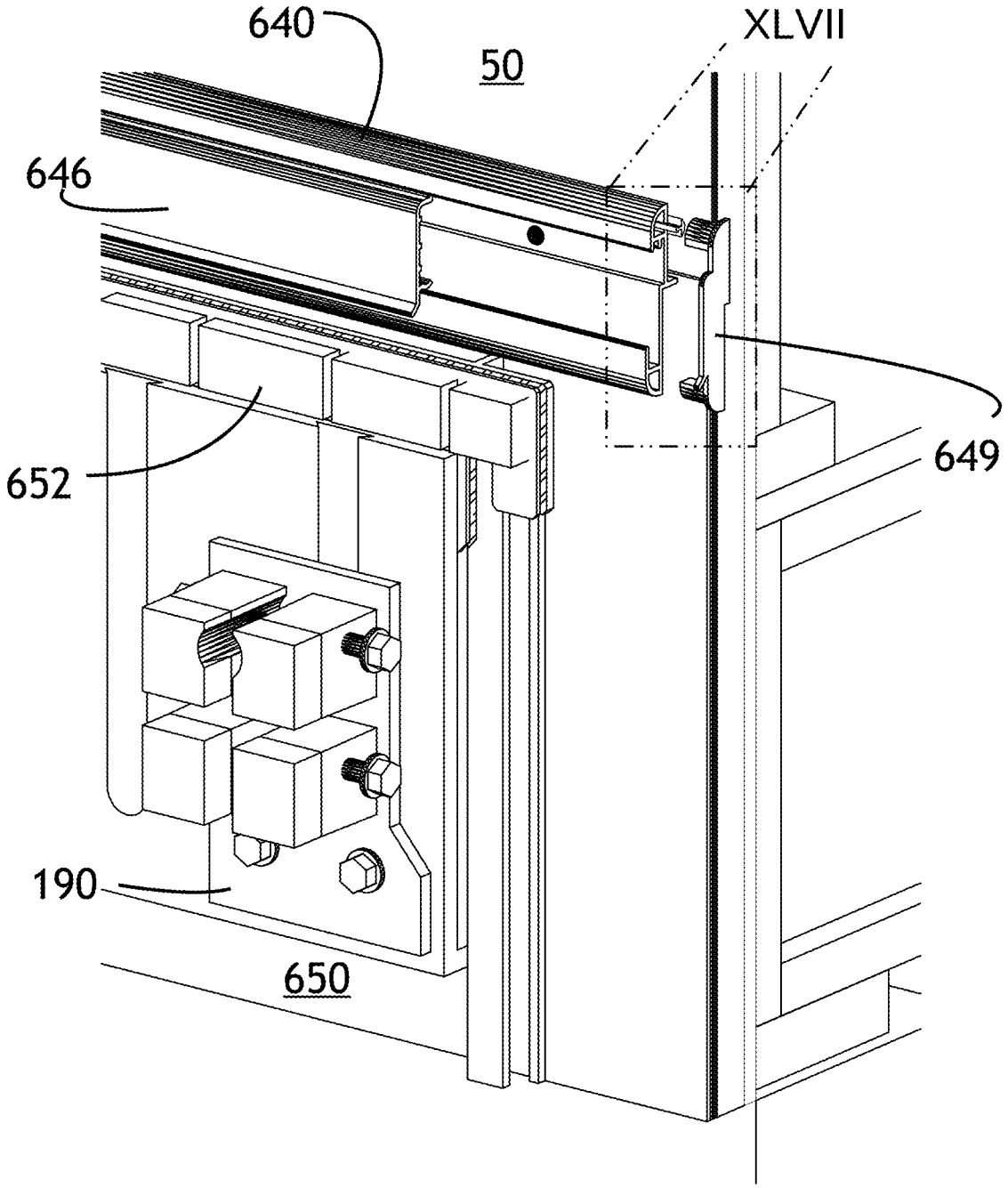
FIG. 45 is a partially exploded view of a deck, adjacent a stucco wall.
Figure 46:
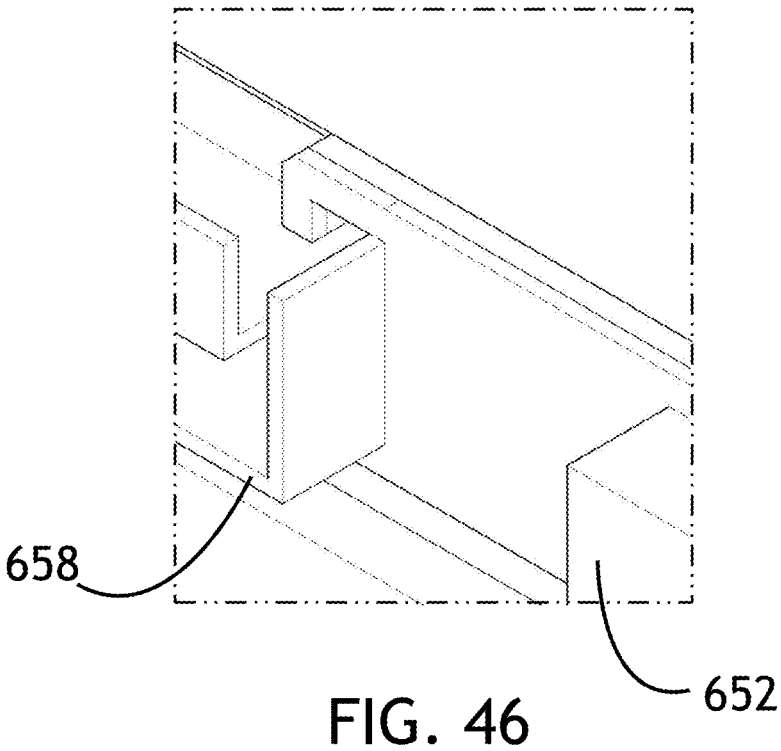
FIG. 46 is a close-up view of box XLVI of FIG. 44.
Figure 47:
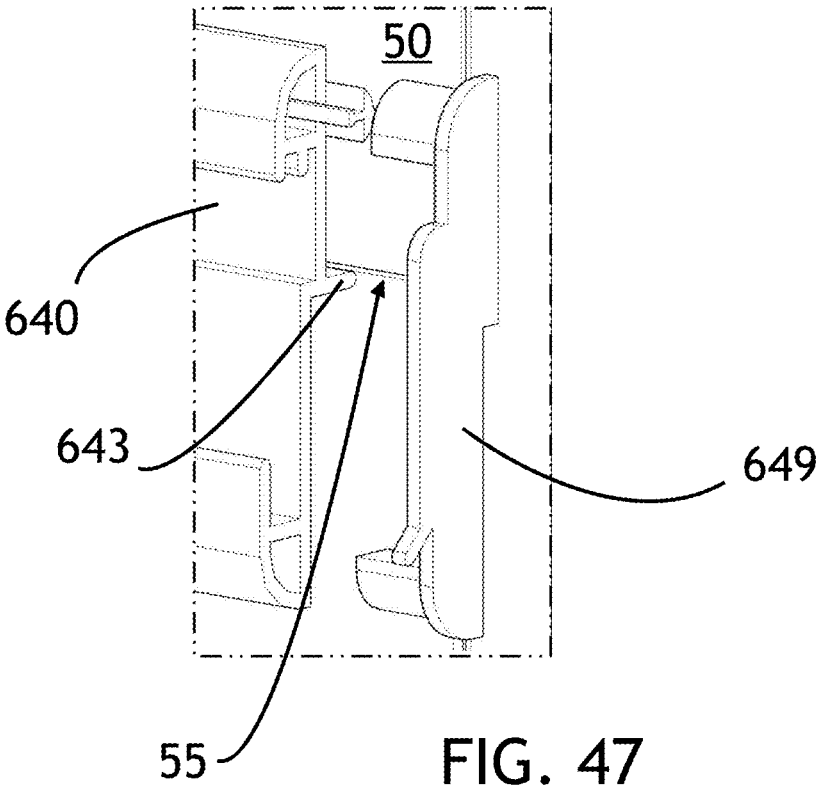
FIG. 47 is a close-up view of box XLVII of FIG. 45.

A specialized stucco adapter 640 is made to cover the back flanges of the wall transition waterway flashing 636 and the deck perimeter edge cap transition flashing 656 (FIGS. 45 and 47). The stucco adapter 640 is an extruded body with a back spline 643 which is fit into a groove 55 cut into a stucco wall 50. The adapter features spacing to cover the flashing and remain flush with the wall 50. Once positioned, it is fastened to the wall and a cover 646 is positioned over the face of the adapter, thereby covering any screws used in fastening the adapter to the wall. The adapter 640 may be cut to size and an end cap 649 is positioned on the end of the adapter 640 to finish and seal it.

Water Control System

Figure 50:
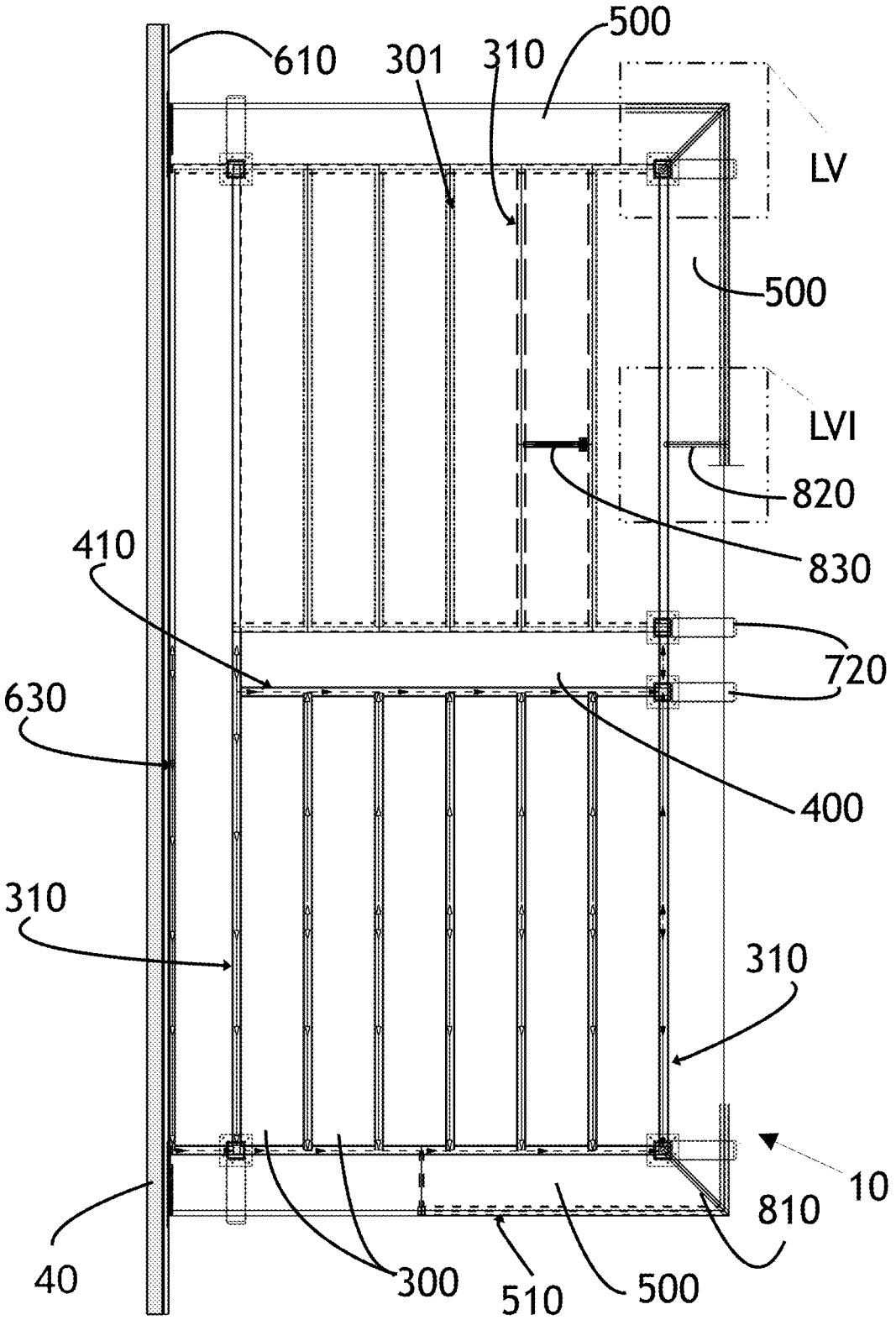
FIG. 50 is a top plan view of another exemplary deck, showing water ways going parallel and perpendicular at multiple elevations.
Figure 51:
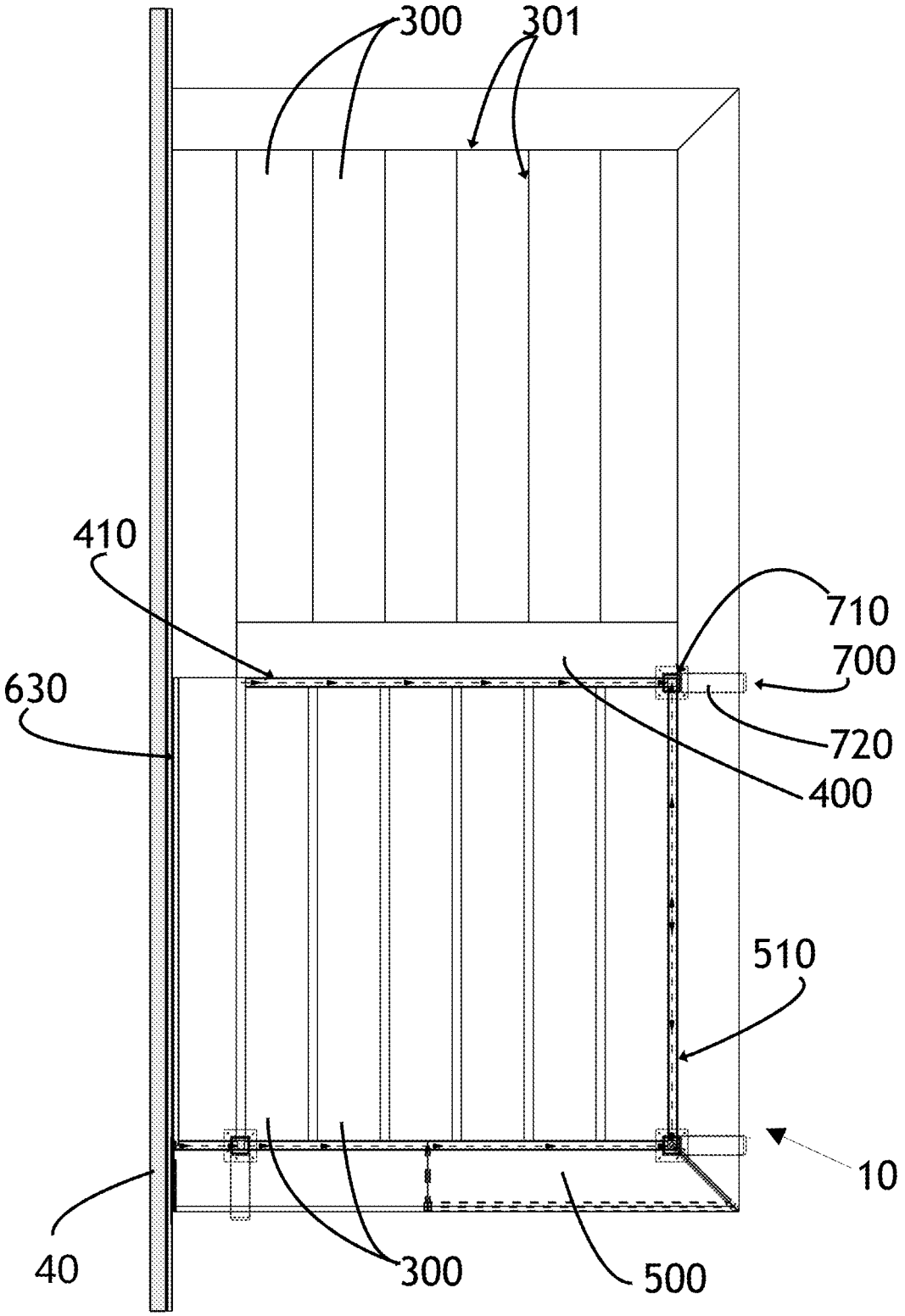
FIG. 51 is a partial cut-away view of the deck of FIG. 50.

The surface components, shown in FIGS. 50 and 51, contain a water diversion system to drain water from the surface (after cleaning, rain, or other precipitation) and divert that water to controlled ejection ports around the deck perimeter. This function not only keeps the deck surface drier, as draining is facilitated, but also diverts water away from the foundations of both the building and the deck and, for a two-story deck, prevents water from seeping through the deck and onto a lower, usable area. This drainage and diversion system is a two-tiered trough system purposely designed within the components of the deck construction system. For the most part, every surface component has at least one trough fashioned into it for the purpose of draining, collection, and diverting water from the deck's surface.

Figure 52:
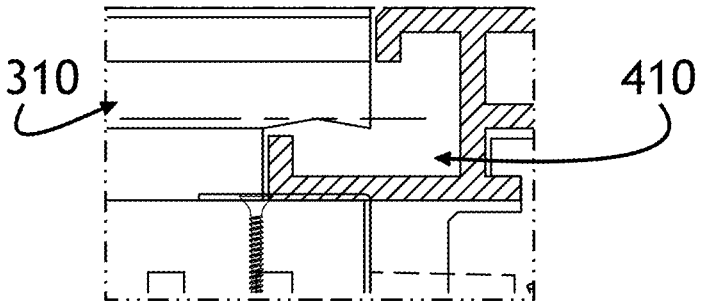
FIG. 52 is a close-up view taken in box LII of FIG. 39, showing a lower perimeter waterway trough FIG. 51.
Figure 53:
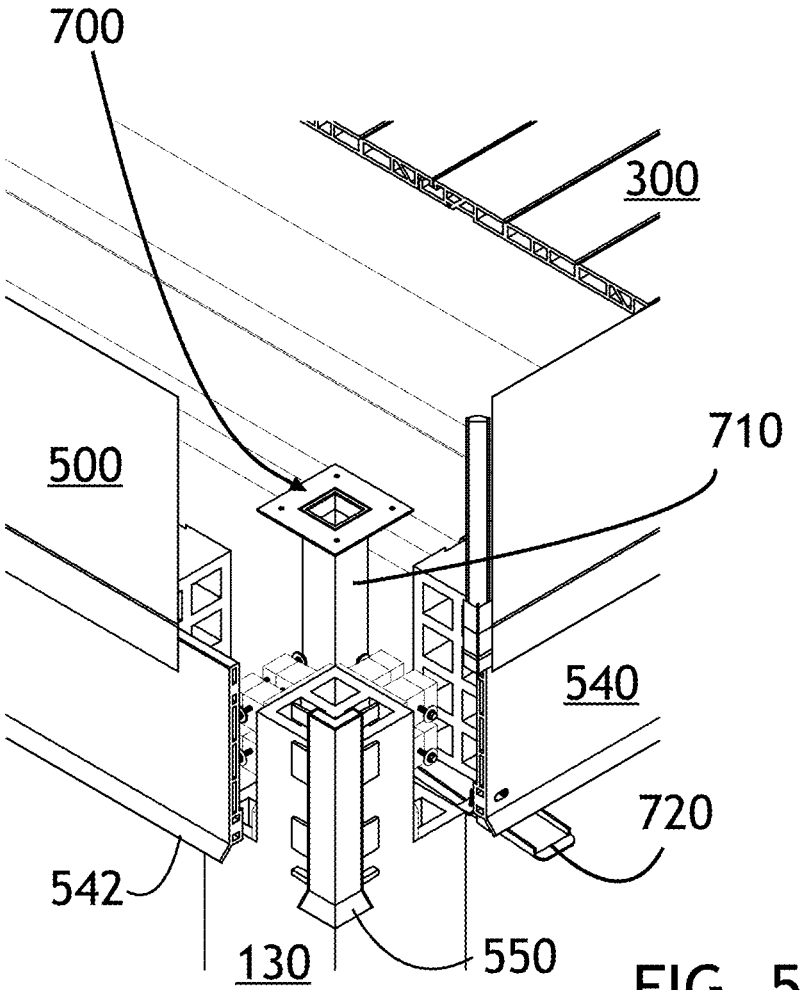
FIG. 53 is an exploded view of an exterior corner of the deck of FIG. 50.
Figure 54:
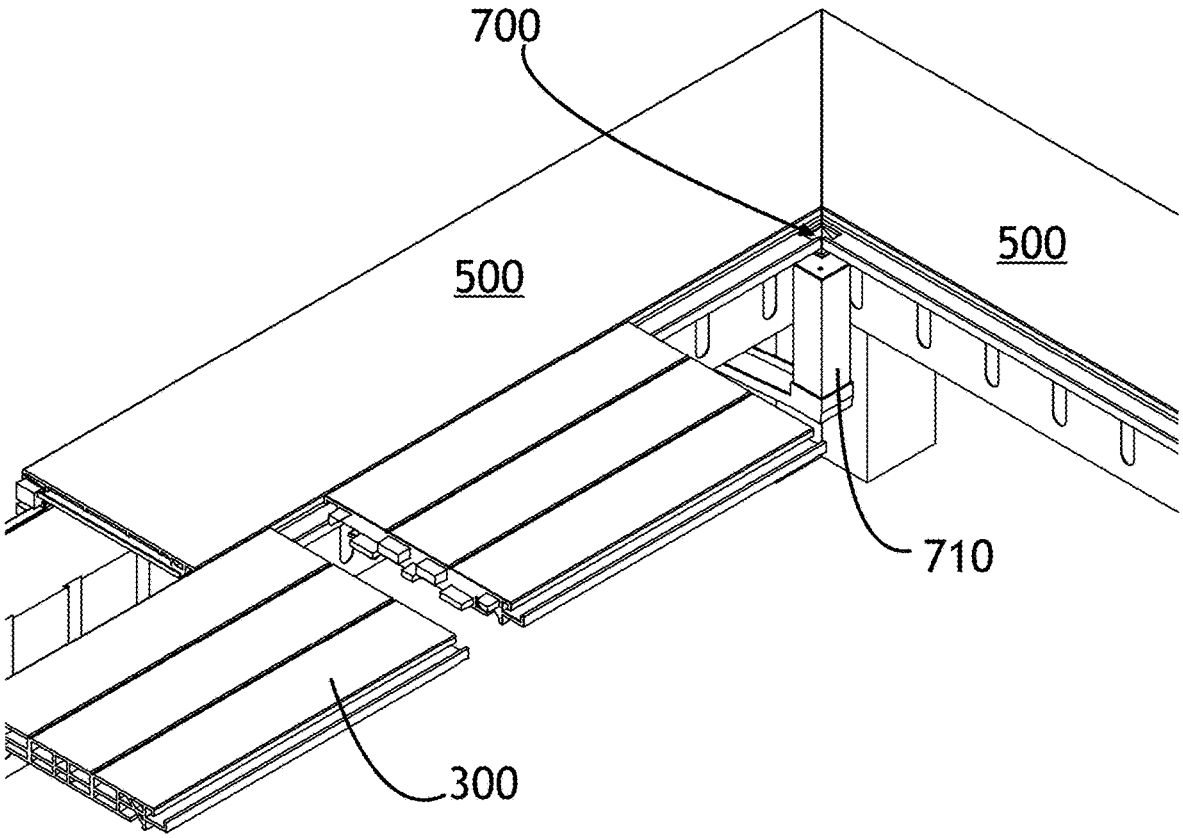
FIG. 54 is an alternate view of the corner of FIG. 50, inside of the post, looking out.
Figure 55:
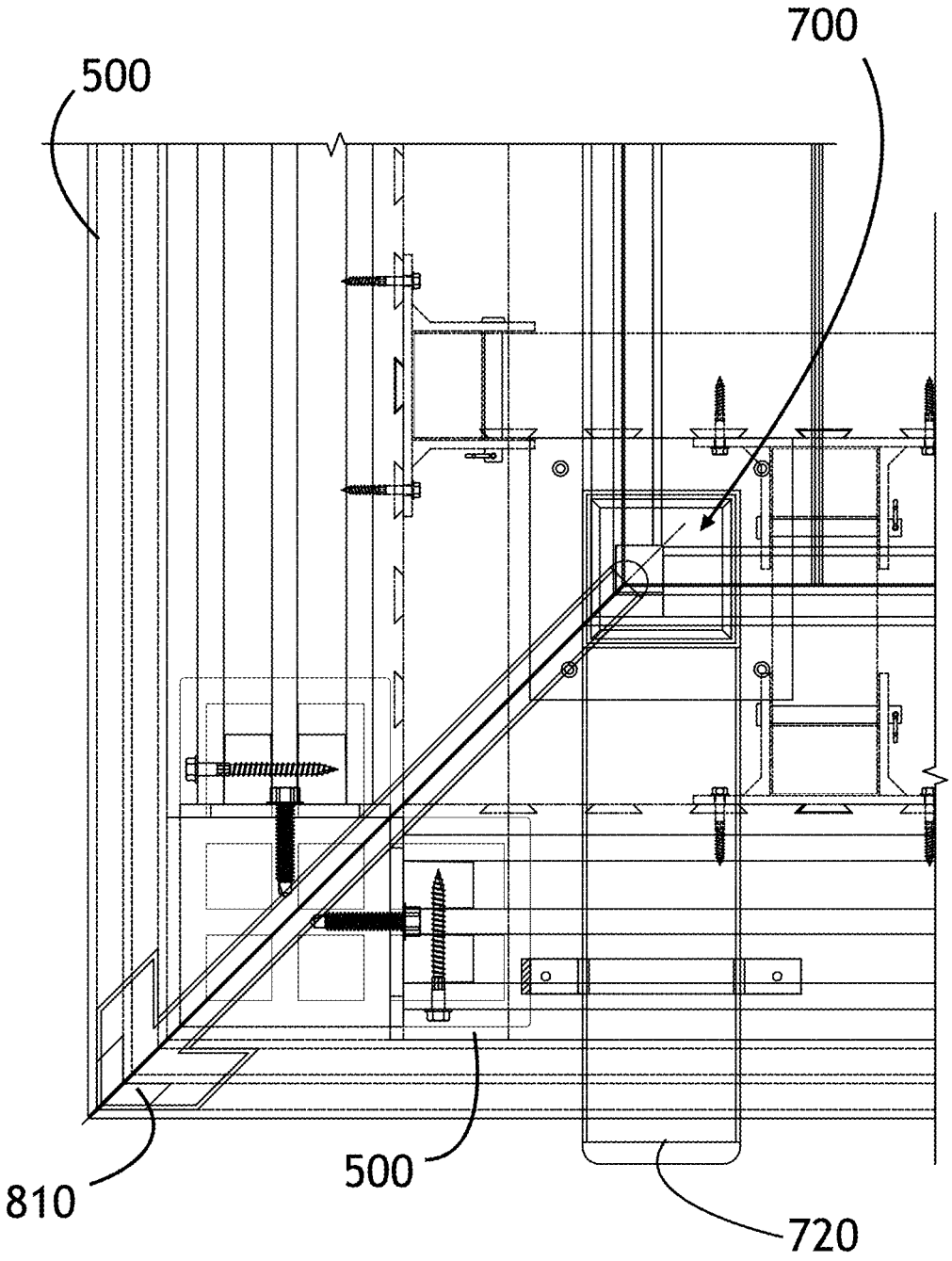
FIG. 55 is a partial cut-away and close-up plan view of the joint taken in box LV of FIG. 47.
Figure 56:
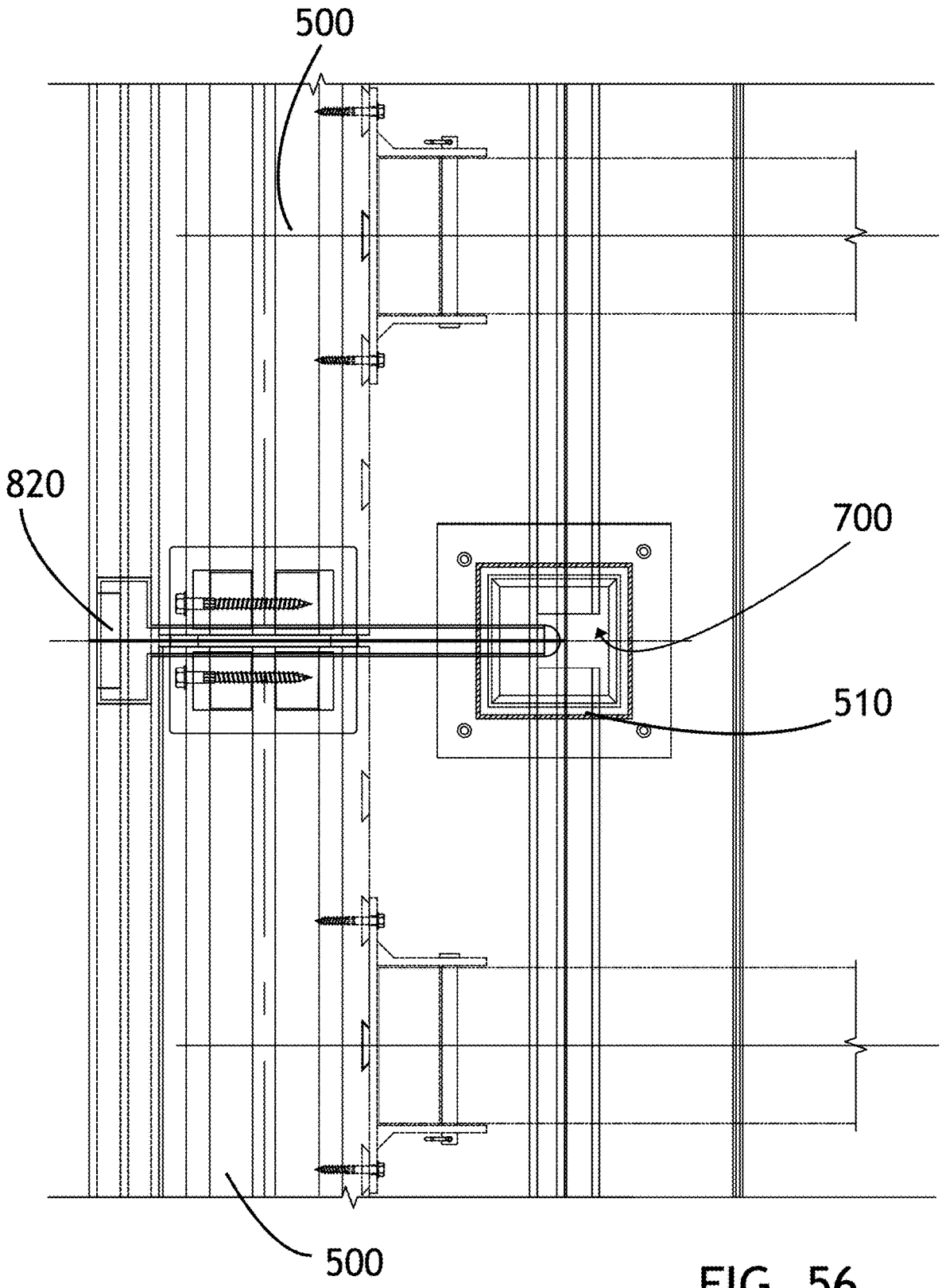
FIG. 56 is a partial cut-away and close-up plan view of the joint taken in box LVI of FIG. 50.
Figure 57:
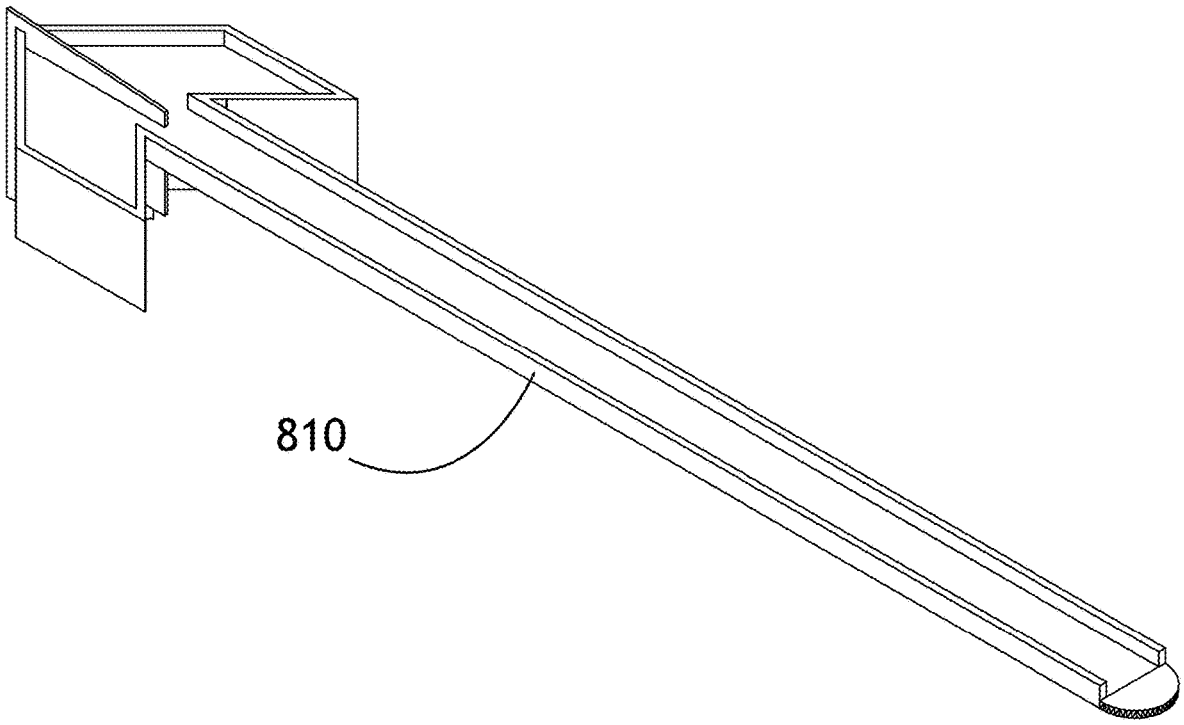
FIG. 57 is a perspective view of a Deck Perimeter Edge Cap Corner Joint Water Control Spline
Figure 58:
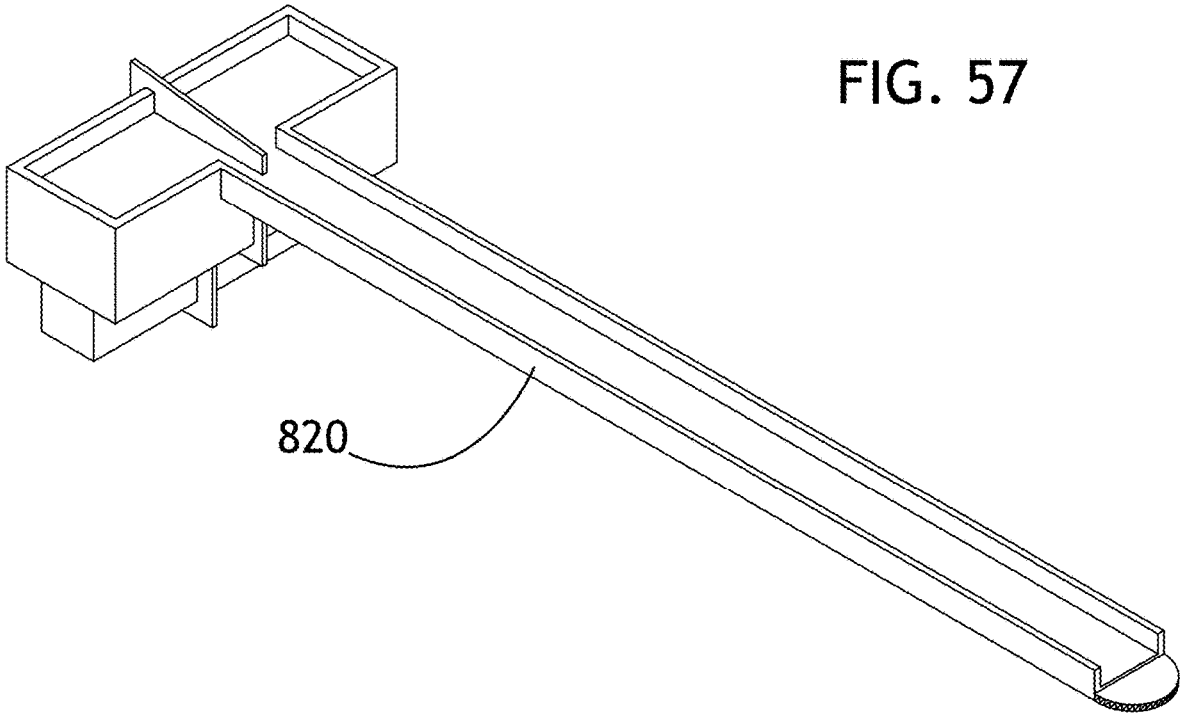
FIG. 58 is a perspective view of a Deck Perimeter Edge Cap Butt Joint Water Control Spline

Referring for FIGS. 53 and 54, the water drainage and diversion system comprises two sets of troughs on two tiers within the edges of the deck components. The upper trough 310 is formed along the side edges of the deck planks 300. In the illustrated deck 10, these troughs run parallel to the side of the building 40. Water seeps through seams 301 into upper troughs 310 and gravity will then force water to flow towards the end edges of each deck plank 300. From there, water drops into the second set of troughs 410, 510, found along the side edges of the field mullion 400 (FIG. 52) and the deck perimeter edge caps 500, and the wall transition waterway flashing trough 630. Generally, these will run perpendicular to the deck planks 300, though not exclusively so. As with the deck plank troughs 310, gravity will force water into the lower troughs that drives water towards water ejection points 700. Water ejection structures 700 Shown in FIGS. 53 and 54, feature a port 710 and a down spout 720 that drains water from the system waterways and directs it away from the foundation. To collect water from joints in the structure, water control splines are provided for corner joints, such as the water control spline 810 in the corner joint formed by perpendicularly interfacing deck perimeter edge caps 500, as shown in FIGS. 55 and 57, or butt joints, such as the water control splines for a deck plank butt joint or a deck perimeter edge cap butt joint 820, shown in FIGS. 56 and 58. The provided water control splines collect water and drain into the nearest lower trough or into the ejection structure 700 directly.

Deck Finishing

Figure 59:
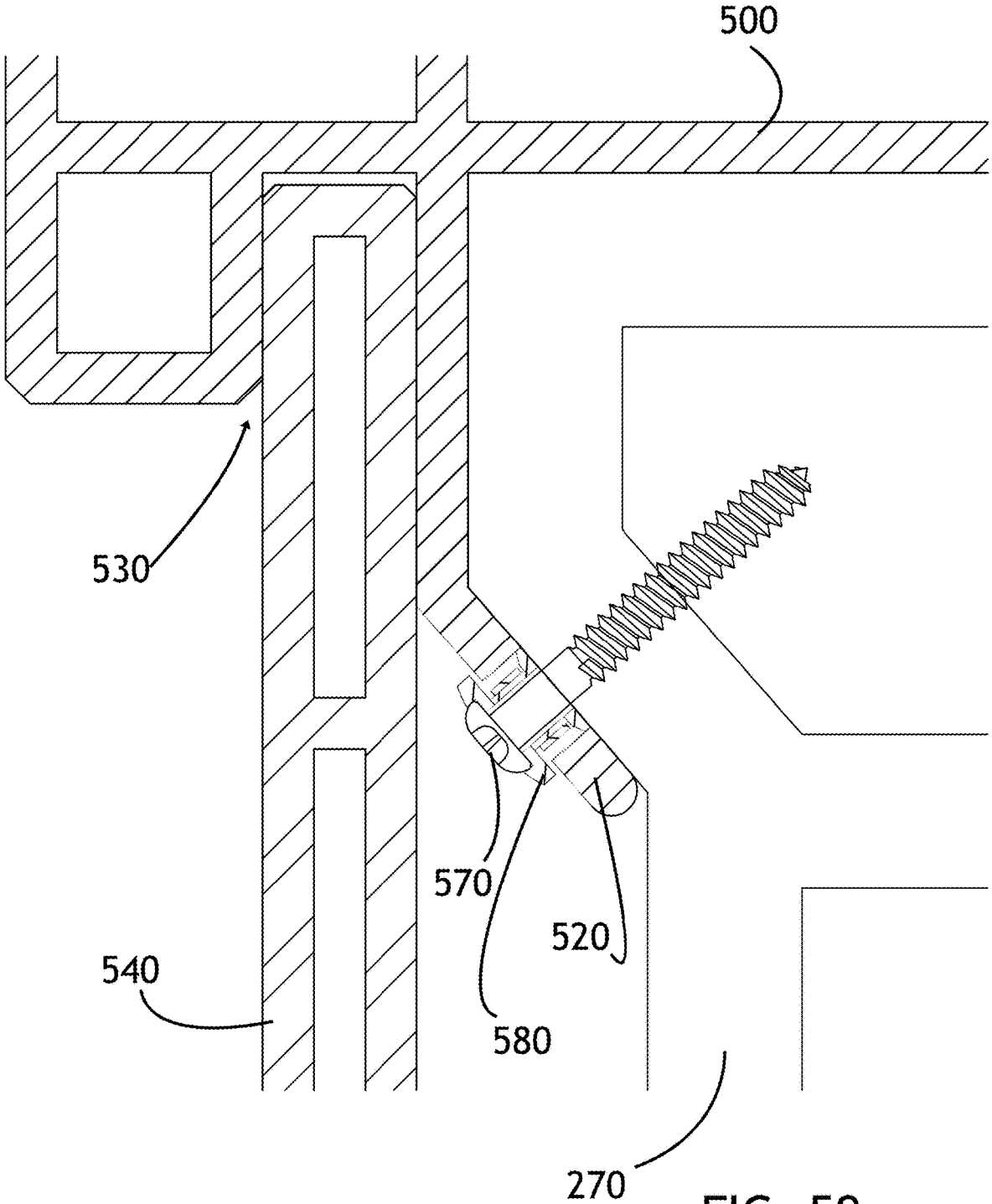
FIG. 59 is a sectional view of a Deck Edge Cap attached to a beam.
Figure 60:
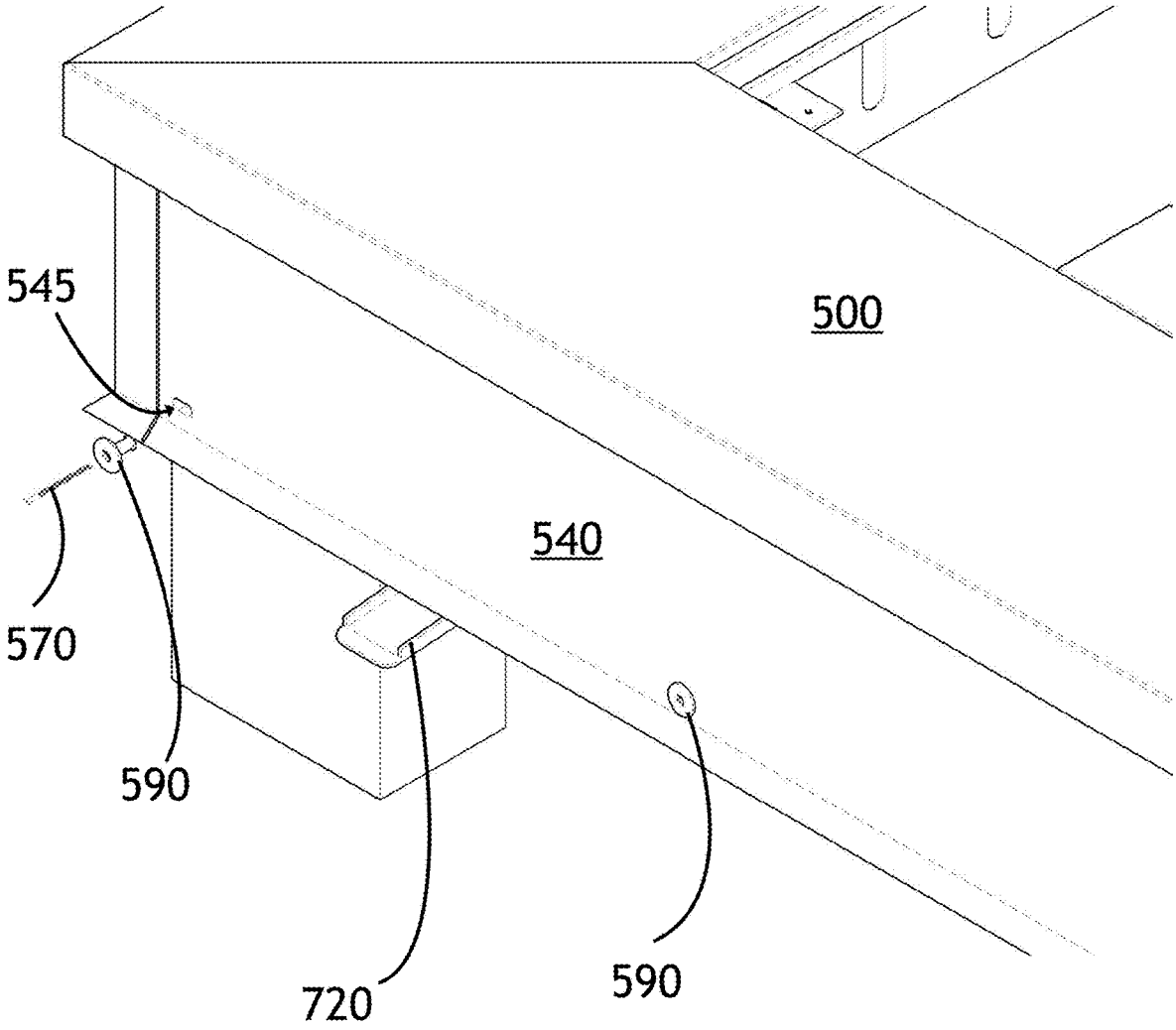
FIG. 60 is a perspective view of a Deck Beam Apron being fastened to a beam.
Figure 61:
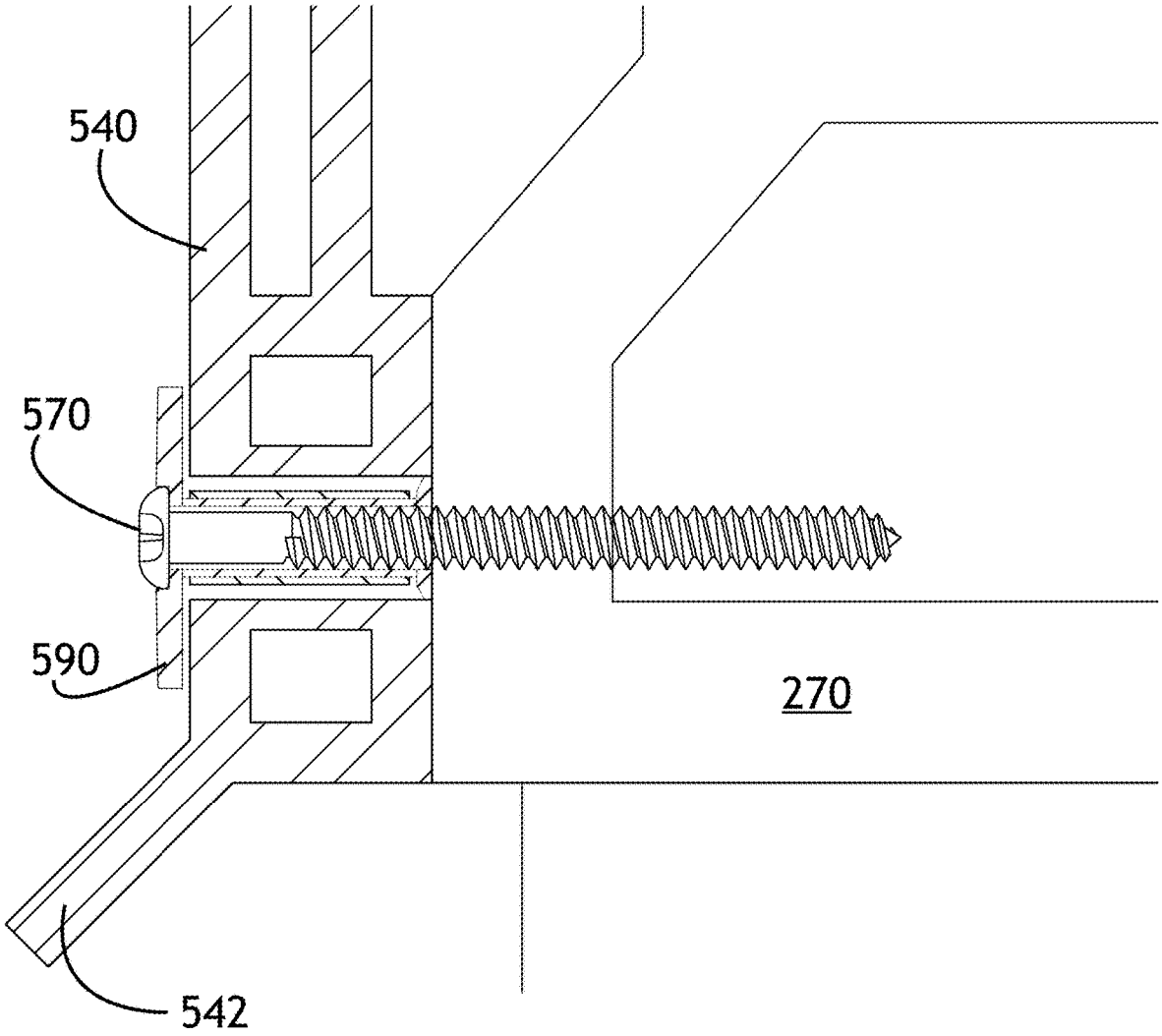
FIG. 61 is a sectional view of the Deck Beam Apron of FIG. 60.

As stated before, the deck perimeter edge caps 500 (FIG. 36) extend over the edge of the rim joist 270 and partially obscure an attachment flange 520 and an attachment slot 530. A closer view is shown in FIG. 59. The attachment flange 520 is fitted with a grommet 580 and positioned against the beam exterior 270. It is then screwed into pace with an attachment screw 570. A beam apron 540 is then slid into the concealed attachment slot 530 and likewise secured to the beam, as shown in FIGS. 60 and 61. A screw shoulder 590 is fitted into an oblong hole 545 in the lower portion of the beam apron 540 and a screw 570 then driven into the beam 270, through the shoulder 590. The lower screw 570 secures the lower half of the apron while the attachment slot 530 secures the top. The apron also effectively hides the attachment of the edge cap 500. The use of the shoulder 590 and grommet 580, in particular with oblong holes, allows for structural expansion due to weather without overly stressing the trim components.

Figure 62:
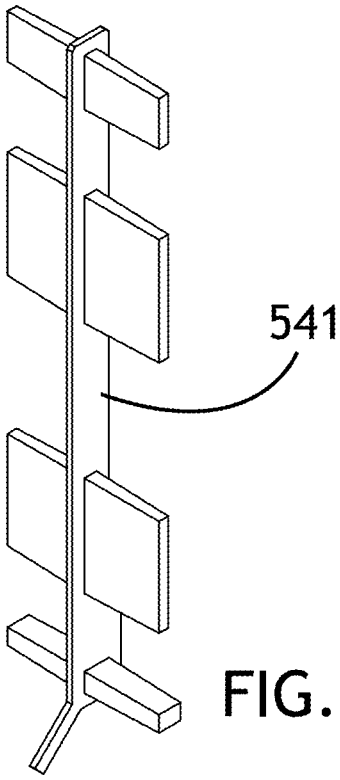
FIG. 62 is a perspective view of a Deck Apron Straight Spline.
Figure 63:
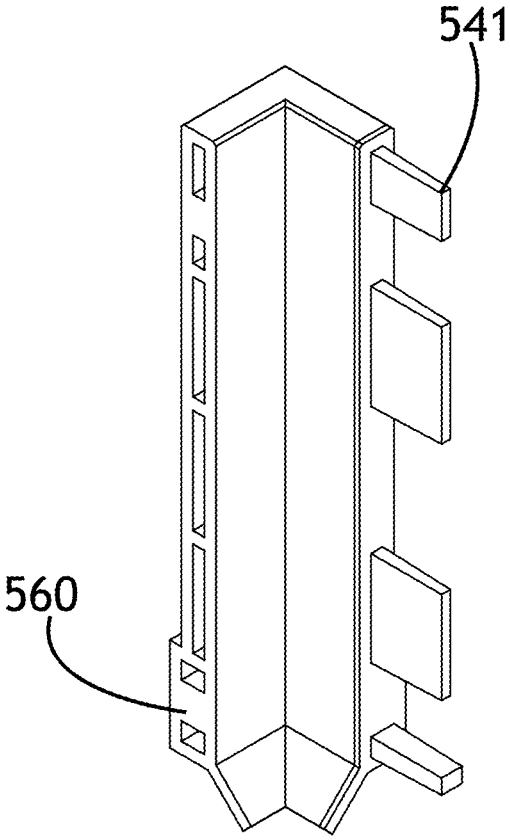
FIG. 63 is a perspective view of a Deck Apron Interior Corner, with an affixed Straight Spline of FIG. 62.
Figure 64:
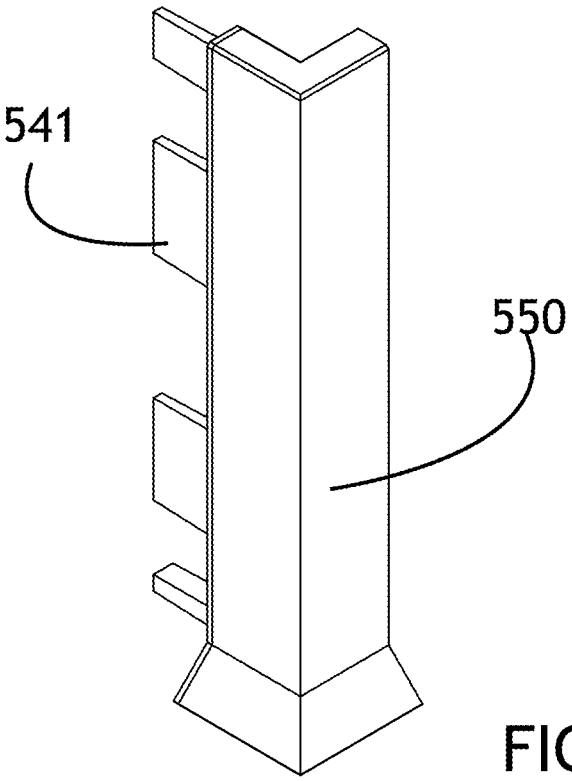
FIG. 64 is a perspective view of a Deck Apron Exterior Corner, with an affixed Straight Spline of FIG. 62.
Figure 65:
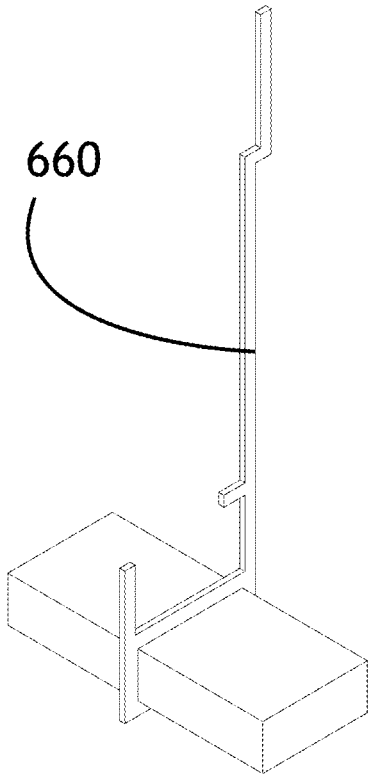
FIG. 65 is a perspective view of a wall transition waterway straight spline.
Figure 66:
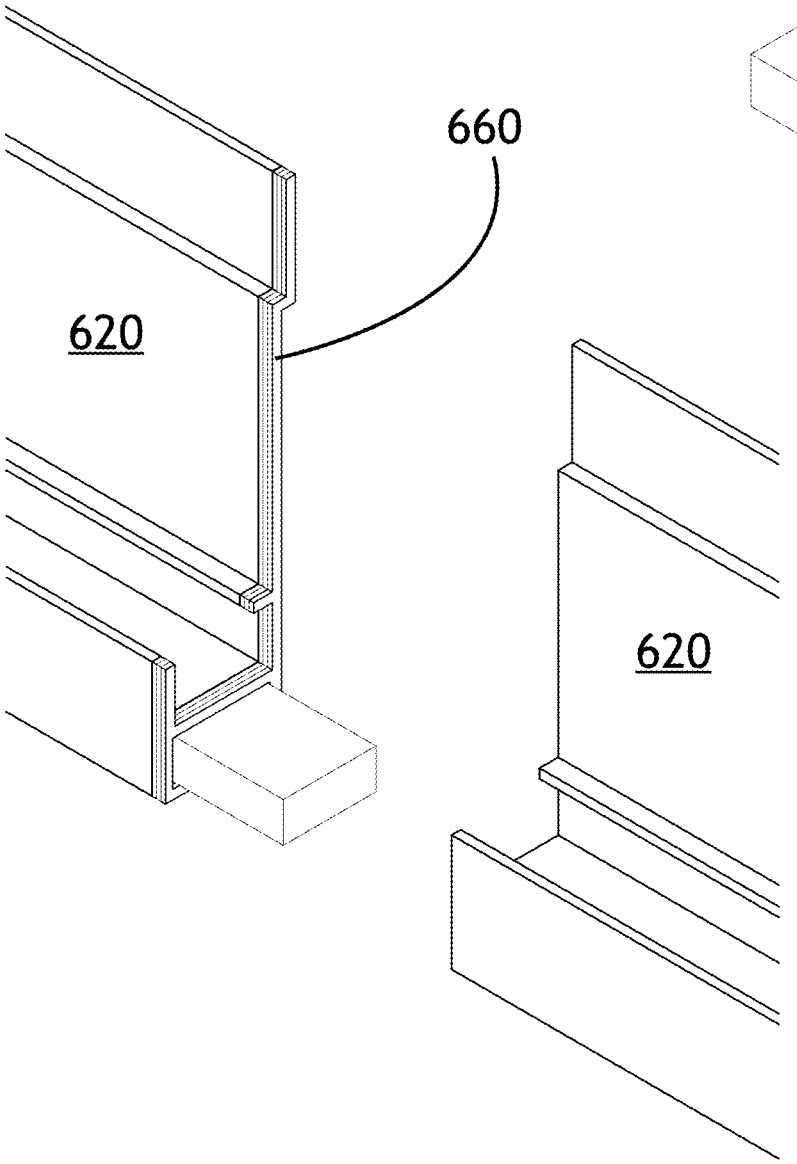
FIG. 66 is a perspective view of the wall transition waterway straight spline of FIG. 66 being used to join adjacent wall transition waterway components.
Figure 67:
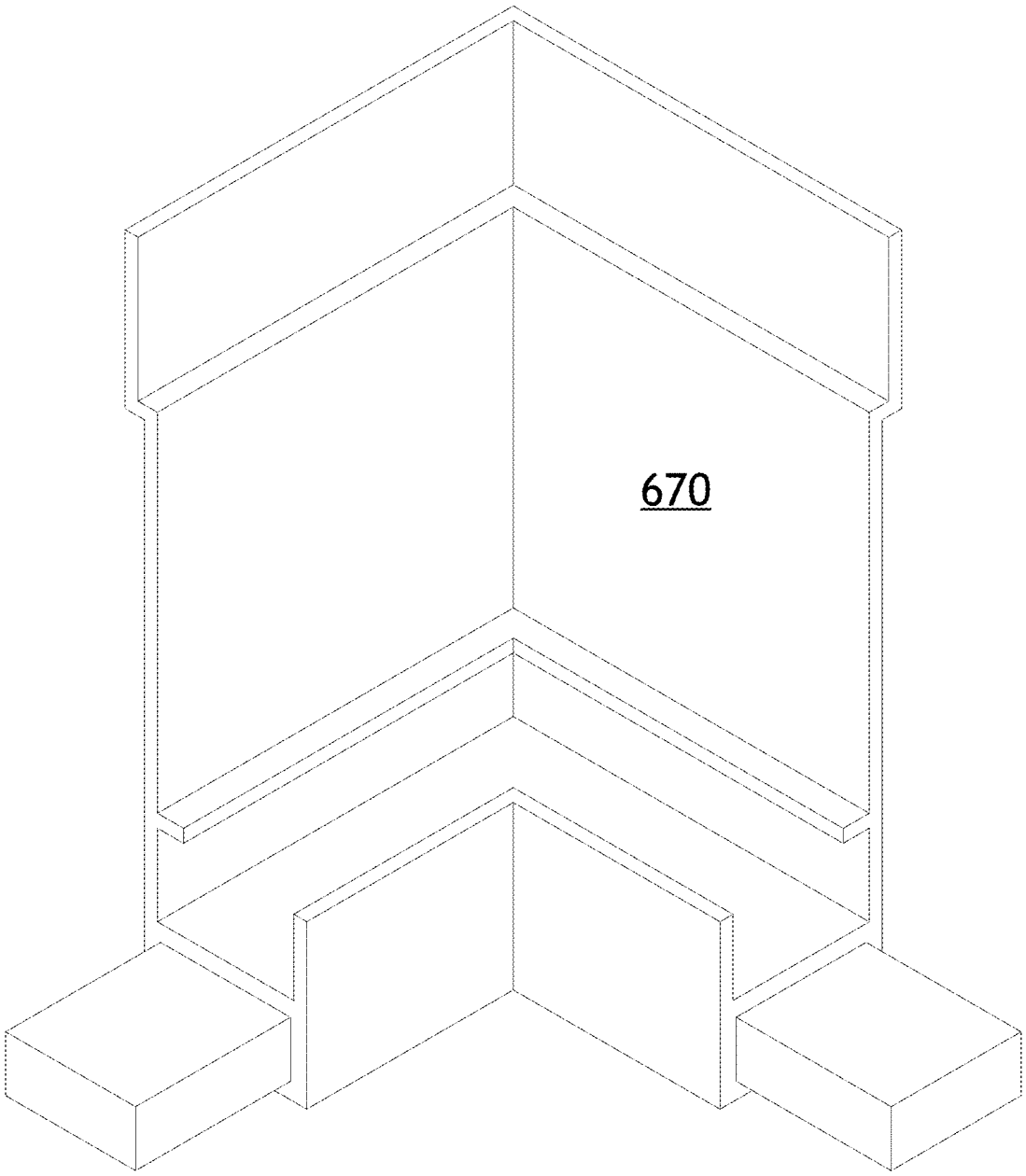
FIG. 67 is a perspective view of an interior corner wall transition waterway component with integrated tenons.
Figure 68:
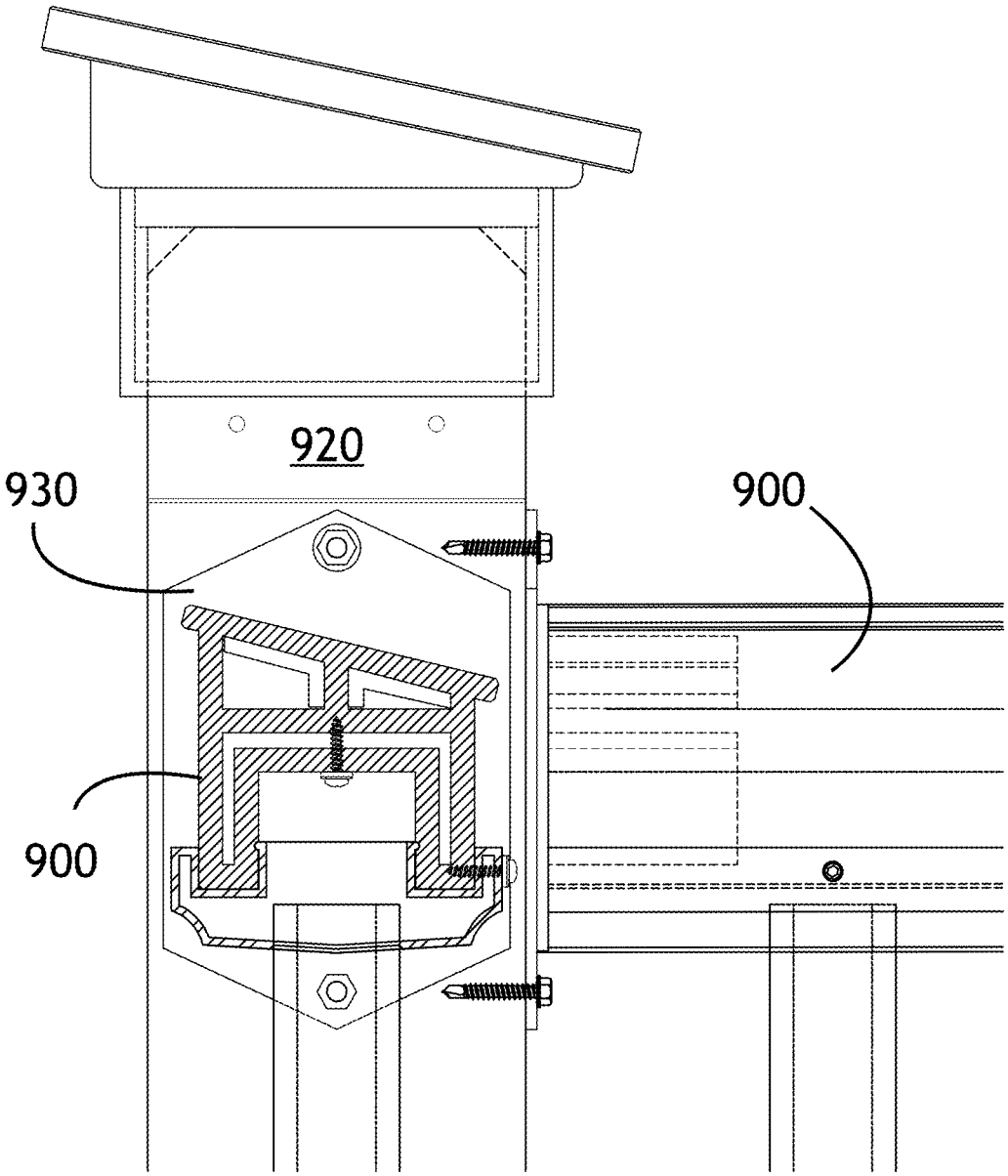
FIG. 68 is a sectional view of the railing of the deck shown in FIG. 1.

Another feature that allows for structural expansion is the use of mortise and tenon interfaces between the trim components. The introduction of a straight spline coupler 541, shown in FIG. 62, and interior 560 and exterior trim corners 570, FIGS. 63 & 64, allow for beam aprons 540 to be secured together. The tenons provided on the butt joint coupler fit within the cells shown in each deck apron 540 and the corner components. This same concept may be used in the transition waterways between the deck and the attached wall with a transition waterway straight spline 660, shown in FIG. 65, which may fit between two waterway flashing components 620 (FIG. 66). It should be understood that the tenons may be integrated with any terminal component, such as an internal or external corner piece, as is shown with the flashing component 670 in FIG. 67, and the principles of this aspect of the deck construction will still be followed—the use of a mortise and tenon joint for these components facilitates the expansion and contraction of structural components and minimizes stress on trim and other connections.

Figure 69:
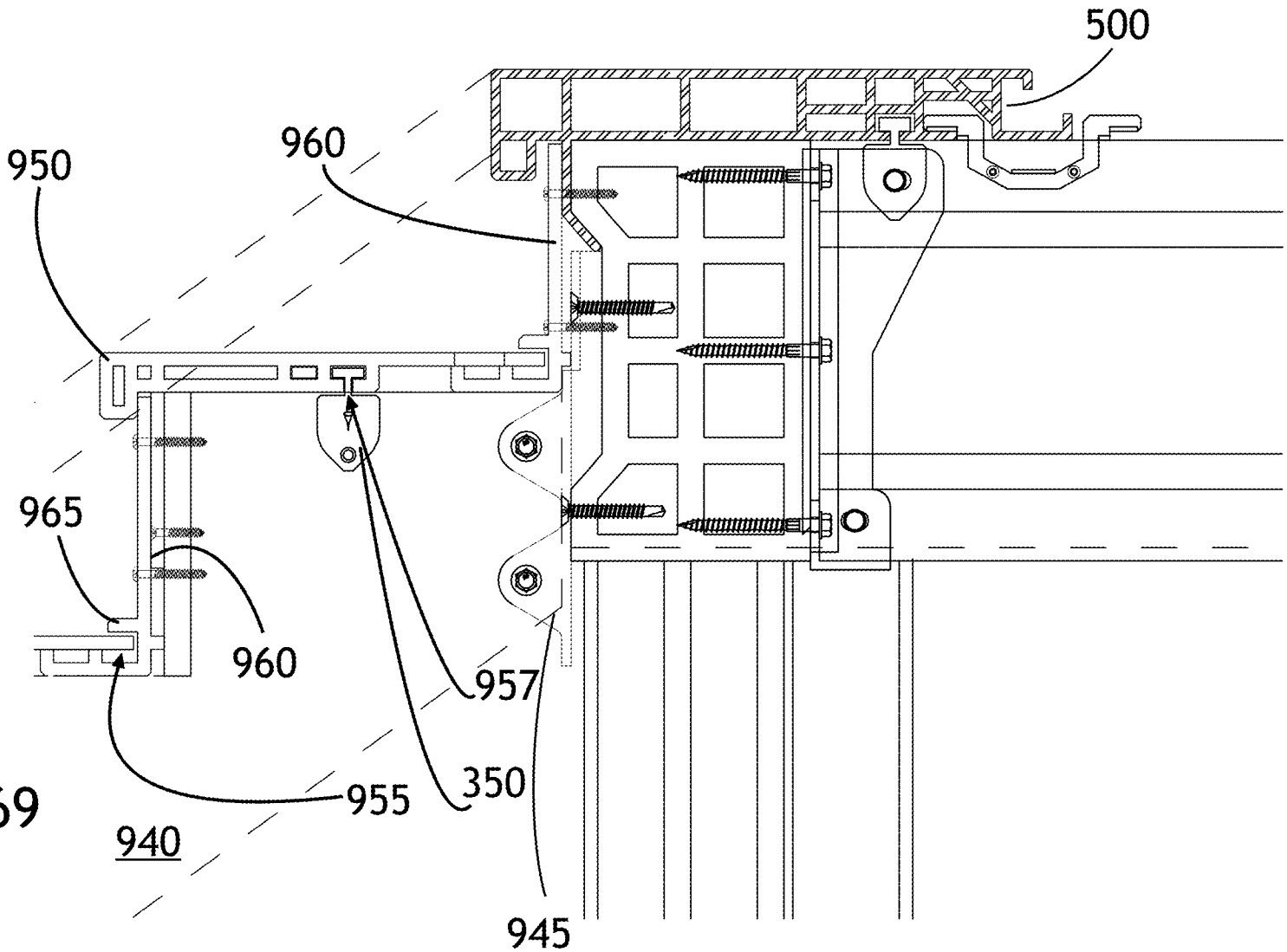
FIG. 69 is a sectional view of the stairs of the deck shown in FIG. 1.
Figure 70:
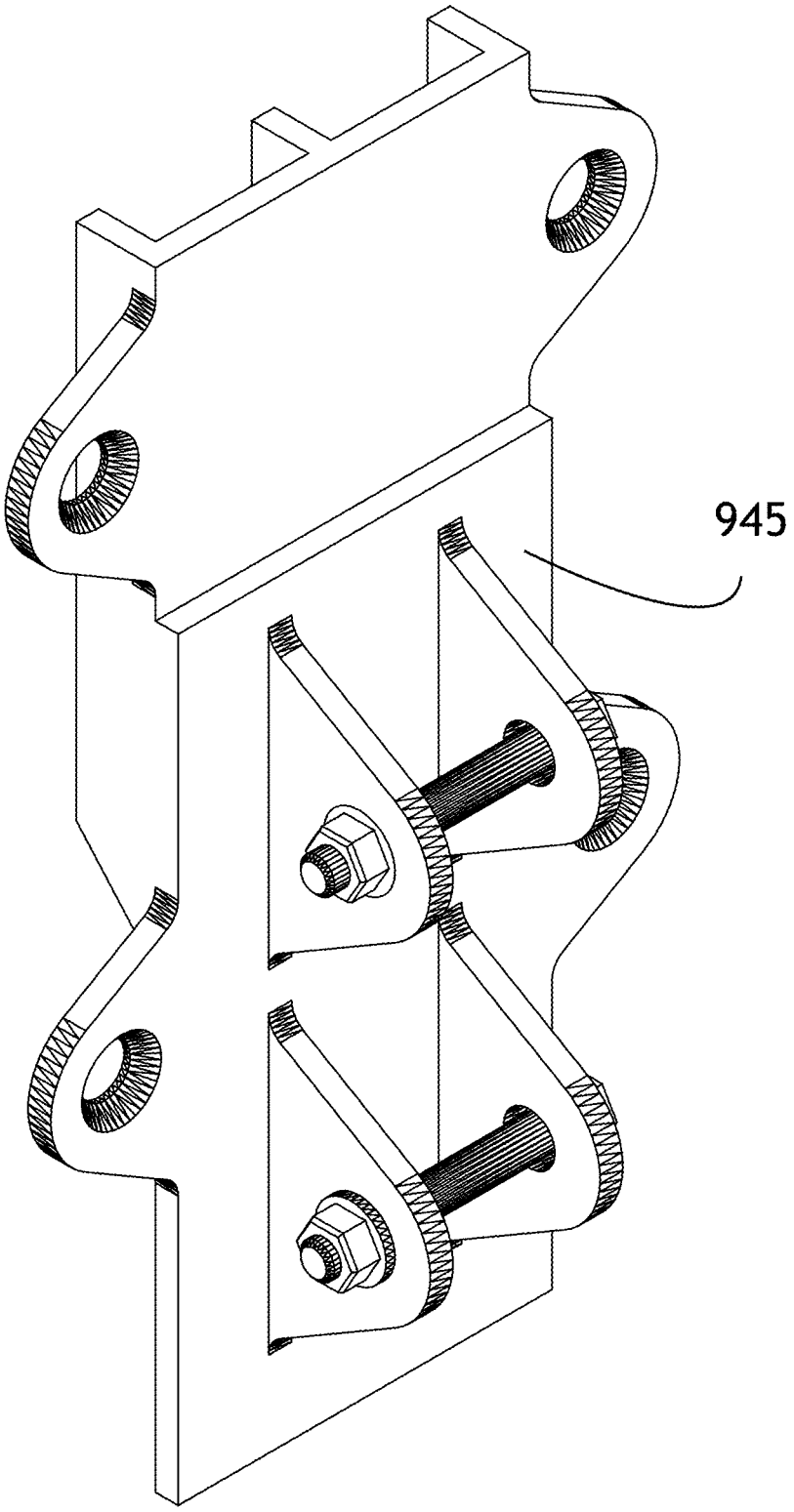
FIG. 70 is a perspective view of a stair runner bracket, such as used in FIG. 69.
Figure 71:
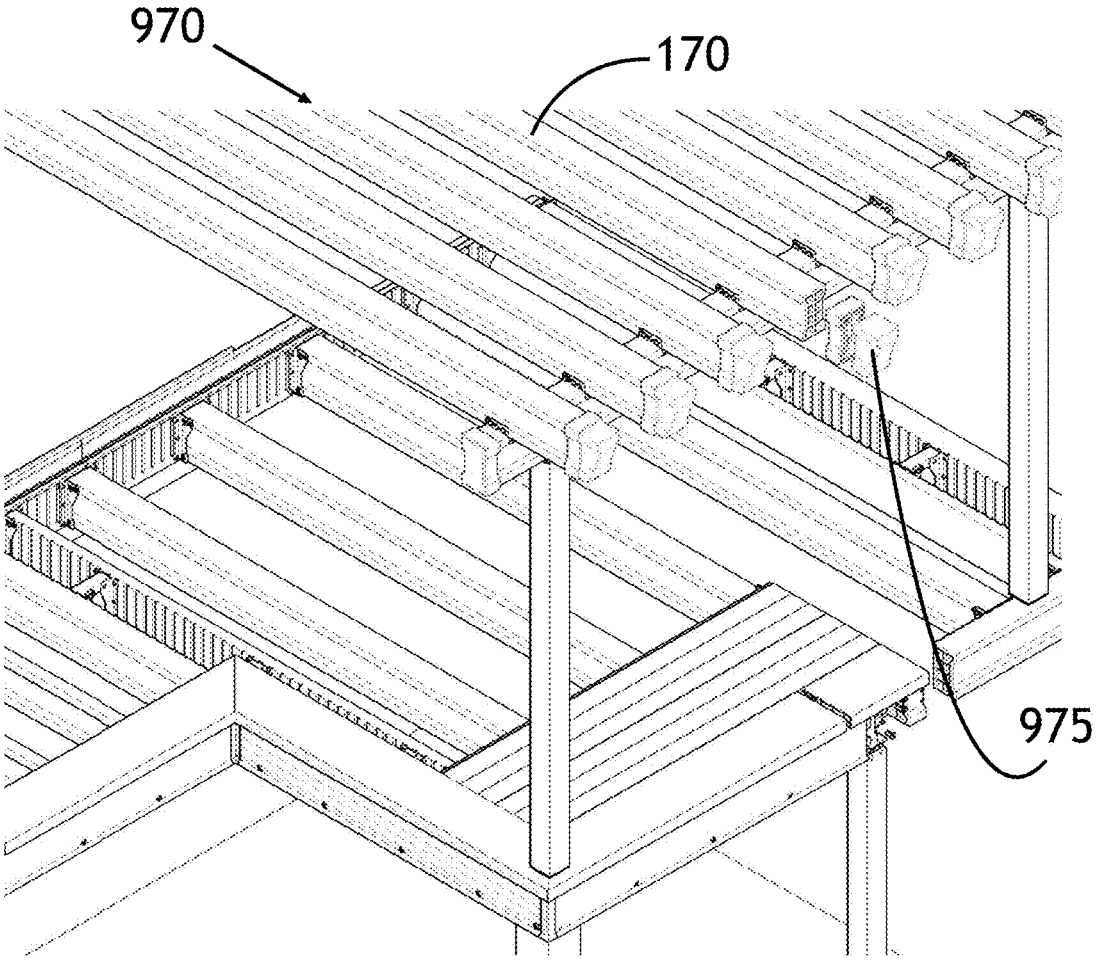
FIG. 71 is a perspective view of a trellis attached to a deck like that in FIG. 1.

Railing 900 is easily added by affixing an anchor 910 to a deck perimeter edge cap 500 and installing a post 920 to the anchor 910 (FIG. 37). Railing can take any form and may also be extruded and cut to length, with a railing post bracket 930 to affix railing pieces to installed posts (FIG. 54). Stairs (FIG. 55) may be installed with a dimensional 2×12 redwood stair stringer 940 or equivalent and attached to a deck perimeter edge cap 500 and triple joist 170 (FIG. 69) then nail the 2×4 redwood stair stringer spreader to the concrete or ground. Exposed wood may then be clad in composite material, per local code. Stairs 950 may then be conventionally placed on the stair stringer 940 with stair risers 960 extending from different leveled stairs. The beam apron 540 may serve as the upper stair riser or a stair riser 960 may serve as the beam apron in that area. The stair stringer 940 is fastened to the beam 270 with a specialized stair stringer bracket 945 which is contoured to fit the concave outer surface of the beam 270. Stair treads 950 may be cut to length and finished with an end cap with internal gravity water evection. However, it is preferred that the inner side of the stairs feature a water control trough 955 and each riser feature a foot 965 that covers the trough and provides the desired finished look. Stair treads 950 may be secured by plank hold-down clips (350 against the stair stringer 940 through slots 957 provided as with the other components.

Beams and planks may be used to create other components for a deck, including but not limited to furniture, planter boxes, or trellises. All that is required is that an appropriate cap or adapter be made to accommodate the design. As an example, in FIG. 56, a trellis 970 is constructed of triple joists 170 and finished with trellis end caps 975.

Figure 72:
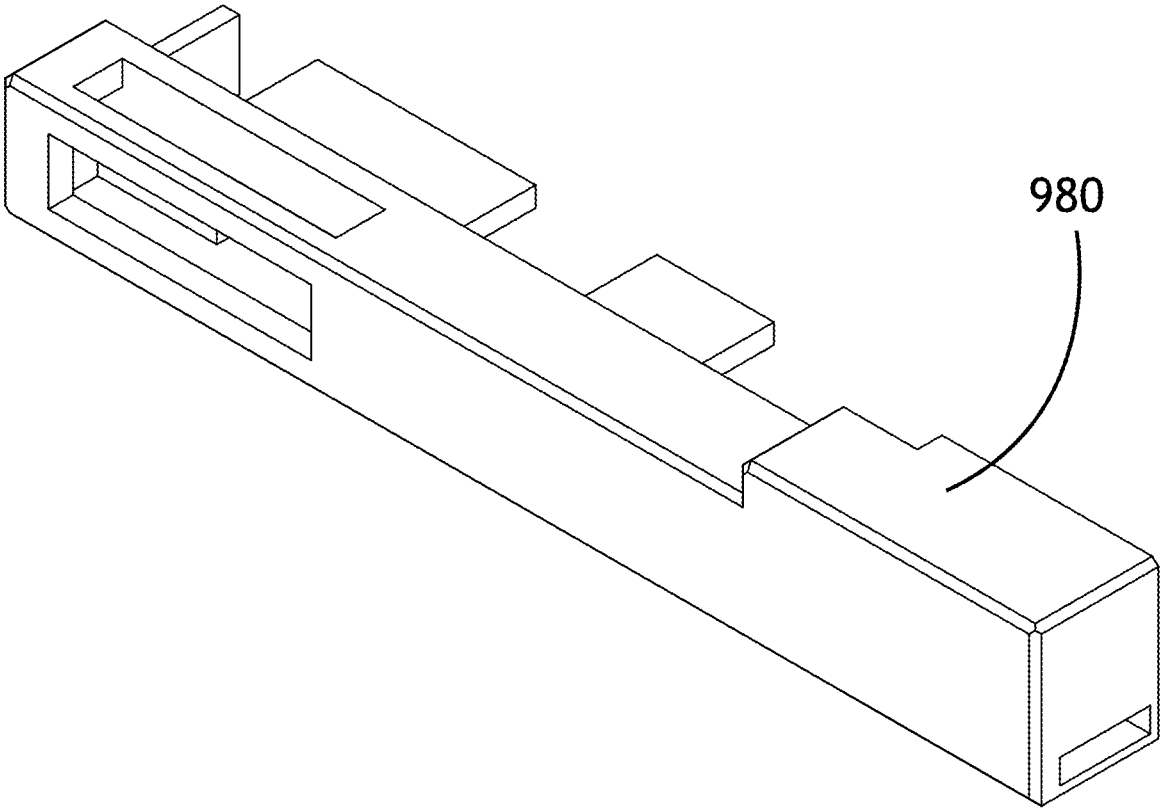
FIG. 72 is a perspective view of a stair tread end cap adapted for use with LED lights and a solar cell.

As components are manufactured for their purposes, it is possible to design individual components with multiple purposes. For instance, end caps for deck railing and stair components could be fitted with LED lights and/or solar cells, such as the end cap 980 in FIG. 72, in an effort to provide a measure of safety lighting to the end construction. Of course, such modifications would have to be properly engineered to fit within constraints of the final dimensions of the attached components to their supporting components.

INDUSTRIAL APPLICABILITY

The present invention has industrial applicability because it can be made or used in industry. Although the present invention has been described with reference to preferred embodiments, numerous modifications and variations can be made and still the result will come within the scope of the invention. The described embodiments are to be considered in all respects only as illustrative and not restrictive. No limitation with respect to the specific embodiments disclosed herein is intended or should be inferred. Therefore, the scope of the invention is indicated by the appended claims rather than by the foregoing description. All changes which come within the meaning and range of equivalency of the claims are to be embraced within their scope.

What is claimed is:

1. A deck comprising:

a plurality of deck planks providing an upper surface, the deck planks further comprising:

an upper surface, a lower surface proximate the substructure, said upper and lower surfaces defining a height, two opposed lateral edges and a first and a second opposed longitudinal edges;

two upper ledges cantileverally extending from the upper surface along the first and second longitudinal edges; and a medial trough cantileverally extending from the second longitudinal edge between the upper and lower surfaces, such that when adjacent planks are placed longitudinal edge to longitudinal edge, the upper ledges will meet above the medial trough;

a structural support system underneath the deck surface and raising the same from the ground, the structural support system further comprising:

a plurality of joists fitted with joist end caps, each end cap featuring a boss, at least one perimeter beam having a plurality of parallel slots located on an interior side of said perimeter beam to receive bosses of the joist end caps;

at least one post supporting the at least one perimeter beam.

2. The deck of claim 1, further comprising a plurality of deck edge caps that extend beyond a perimeter defined by the structural support system, the deck edge caps further comprising:

a flange extending beneath an upper surface of the deck edge caps and interfacing with at least one beam;

a slot located forward and proximate the flange for receiving a deck apron.

3. The deck of claim 1 further comprising at least one hanger shield resident proximate a ledger board and having a plurality of slots to receive a boss of at least one end cap.

4. The deck of claim 1, further comprising a wall transition structure which also provides at least one upper water control trough.

5. The deck of claim 1, further comprising a plurality of bridging support anchors fastened upon an inner side of the at least one perimeter beam.

6. A deck construction system comprising:

a structural support further comprising a plurality of beams and a plurality of joists forming a substructure;

a plurality of deck planks residing upon the substructure, each deck plank further comprising:

an upper surface, a lower surface proximate the substructure, said upper and lower surfaces defining a height, two opposed lateral edges and a first and a second opposed longitudinal edges;

two upper ledges cantileverally extending from the upper surface along the first and second longitudinal edges; and a medial trough cantileverally extending from the second longitudinal edge between the upper and lower surfaces, such that when adjacent planks are placed longitudinal edge to longitudinal edge, the upper ledges will meet above the medial trough;

at least one deck perimeter edge cap designed to fit over and around an upper surface of at least one beam while interfacing with the lateral edges of adjacent deck planks, said perimeter edge cap further comprising a lower trough cantileverally extending from the lower surface towards the lateral edges of adjacent deck planks, such that the lower trough is at a lower level than the medial troughs and the medial troughs will empty into the lower trough;

wherein the lower trough is in fluid communication with a drain and all troughs are located within the height of a deck plank.

7. The deck construction system of claim 6, further comprising a plurality of splines, residing underneath joints between adjacent perimeter edge caps which empty into the lower troughs of the perimeter edge caps.

8. The deck construction system of claim 6, further comprising at least one field mullion plank which further comprises: an upper surface, a lower surface proximate the substructure, said upper and lower surfaces defining a height approximate to that of a deck plank, two opposed lateral edges, a first and a second opposed longitudinal edges each presenting a lower trough cantileverally extending from the lower surface towards lateral edges of adjacent deck planks, such that each lower trough is at a lower level than the medial troughs such that the medial troughs will empty into the lower troughs.

9. The deck construction system of claim 8, further comprising a plurality of splines, residing underneath joints between adjacent perimeter edge caps which empty into the lower troughs of the perimeter edge caps.

10. A deck construction system comprising:

a structural support further comprising a plurality of perimeter beams and a plurality of transverse joists forming a substructure;

a plurality of deck planks residing upon the substructure across the transverse joists, each deck plank further comprising:

an upper surface, a lower surface proximate the substructure, said upper and lower surfaces defining a height, two opposed lateral edges and a first and a second opposed longitudinal edges;

a first ventral longitudinal slot parallel and proximate to the first longitudinal edge and a second ventral longitudinal slot parallel and proximate to the second edge;

a plurality of interlock clips, each interlock clip further comprising a bent body with two, opposed, flared tenons;

the flared tenons interfacing with the first longitudinal slot of one deck plank and the second longitudinal slot of an adjacent deck plank;

wherein the interface clips may then be fastened to individual transverse joists to secure the adjacent deck planks thereon.

11. The deck construction system of claim 10, the first longitudinal slot further comprising two opposed stop walls contained therein, and the second longitudinal slot further comprising a single stop wall contained therein.

12. The deck construction system of claim 10, further comprising at least one deck perimeter edge cap designed to fit over and around an upper surface of at least one perimeter beam and further comprising a longitudinal slot corresponding with one of the longitudinal slots of an adjacent deck plank.

13. The deck construction system of claim 12, the at least one deck perimeter edge cap further comprising a longitudinal T-shaped slot, and the system further comprising at least one undermount clip having a T-shaped head which interfaces with said T-shaped slot and fastens to a joist.

14. The deck construction system of claim 12, further comprising at least one field mullion plank which further comprises: an upper surface, a lower surface proximate the substructure, said upper and lower surfaces defining a height approximate to that of a deck plank, two opposed lateral edges, a first and a second opposed longitudinal edges each presenting a lower trough cantileverally extending from the lower surface towards lateral edges of adjacent deck planks, supporting the same.

15. The deck construction system of claim 14, the at least one field mullion further comprising two ventral longitudinal T-shaped slots, and the system further comprising at least one undermount clip having a T-shaped head which interfaces with said T-shaped slot and fastens to a bridging support located between two adjacent joists.

16. The deck construction system of claim 10, further comprising at least one deck perimeter edge cap designed to fit over and around an upper surface of at least one perimeter beam and further comprising a longitudinal T-shaped slot, and the system further comprising at least one undermount clip having a T-shaped head which interfaces with said T-shaped slot and fastens to a joist.

17. The deck construction system of claim 16, further comprising at least one field mullion plank which further comprises: an upper surface, a lower surface proximate the substructure, said upper and lower surfaces defining a height approximate to that of a deck plank, two opposed lateral edges, a first and a second opposed longitudinal edges each presenting a lower trough cantileverally extending from the lower surface towards lateral edges of adjacent deck planks, supporting the same.

18. The deck construction system of claim 17, the at least one field mullion further comprising two ventral longitudinal T-shaped slots, and the system further comprising at least one undermount clip having a T-shaped head which interfaces with said T-shaped slot and fastens to a bridging support located between two adjacent joists.

* * * * *